US011952195B2

(12) United States Patent
Roth et al.

(10) Patent No.: US 11,952,195 B2
(45) Date of Patent: Apr. 9, 2024

(54) CLEANING FLUID DRAWER FOR AN APPLIANCE

(71) Applicant: Sub-Zero Group, Inc., Madison, WI (US)

(72) Inventors: Keith Harold Roth, Crystal Lake, IL (US); Thomas Michael Lasecki, Waterloo, WI (US); Jeffrey Otto Zur, Lodi, WI (US)

(73) Assignee: Sub-Zero Group, Inc., Madison, WI (US)

( * ) Notice: Subject to any disclaimer, the term of this patent is extended or adjusted under 35 U.S.C. 154(b) by 22 days.

(21) Appl. No.: 17/866,662

(22) Filed: Jul. 18, 2022

(65) Prior Publication Data

US 2024/0017901 A1 Jan. 18, 2024

(51) Int. Cl.

| | |
|---|---|
| ***F25D 23/00*** | (2006.01) |
| ***B65D 81/18*** | (2006.01) |
| ***F25C 1/00*** | (2006.01) |
| ***F25C 5/18*** | (2018.01) |

(52) U.S. Cl.

CPC ..... *B65D 81/18* (2013.01); *F25C 1/00* (2013.01); *F25C 5/18* (2013.01); *F25C 2400/12* (2013.01); *F25C 2500/06* (2013.01); *F25D 23/00* (2013.01)

(58) Field of Classification Search

CPC ..... B65D 81/18; F25C 2400/12; F25D 23/00

See application file for complete search history.

(56) References Cited

U.S. PATENT DOCUMENTS

| | | | | |
|---|---|---|---|---|
| 9,056,337 | B2 * | 6/2015 | Walker | A23G 9/30 |
| 9,803,907 | B2 * | 10/2017 | Erbs | F25C 1/12 |
| 9,885,511 | B2 * | 2/2018 | Brunner | F25C 5/182 |
| 10,174,984 | B2 | 1/2019 | Vorosmarti, III et al. | |
| 11,506,438 | B2 * | 11/2022 | Huckaby | F25C 1/12 |
| 2016/0290697 | A1 * | 10/2016 | Broadbent | F25C 1/25 |
| 2018/0058743 | A1 * | 3/2018 | Vorosmarti, III | F25C 5/182 |
| 2018/0106521 | A1 * | 4/2018 | Broadbent | F25C 1/25 |
| 2020/0041187 | A1 * | 2/2020 | Huckaby | F25C 1/12 |

* cited by examiner

*Primary Examiner* — Filip Zec

(74) *Attorney, Agent, or Firm* — Bell & Manning, LLC; Callie M. Bell

(57) ABSTRACT

A drawer includes a drawer base mounted to a housing, a drawer, and a bottom tray. The drawer slides relative to the drawer base and includes a front wall and a receptacle that includes a bottom wall with a front edge and a back edge. The front edge is mounted to the front wall. The bottom wall forms a first funnel that slopes downward from the front edge to the back edge. The bottom tray is mounted to the drawer base below the receptacle not to slide relative to the drawer base. The bottom tray includes a tray wall and a drain aperture wall. The tray wall includes a front edge and a back edge and forms a second funnel that slopes downward from the front edge to the back edge. The drain aperture wall is mounted to the tray wall at a lowest elevation of the second funnel.

20 Claims, 44 Drawing Sheets

CLEANING FLUID DRAWER FOR AN APPLIANCE

BACKGROUND

Cleaning and/or sanitizing fluid may be provided to various appliances to clean and/or sanitize portions of the appliance. For example, clothes washing detergent may be provided to a washing machine. As another example, cleaning fluid may be provided to a stand-alone ice maker assembly to clean an ice maker. A cleaning fluid drawer may simplify the provision of the fluid by a user so that the fluid reaches the approach location within the appliance.

SUMMARY

In an example embodiment, a drawer assembly is provided. The drawer assembly includes, but is not limited to, a drawer base, a drawer, and a bottom tray. The drawer base is mounted to a housing. The drawer slides relative to the drawer base and includes, but is not limited to, a front wall and a receptacle. The receptacle includes, but is not limited to, a bottom wall with a front edge and a back edge. The front edge is mounted to the front wall. The bottom wall forms a first funnel that slopes downward from the front edge to the back edge at a first angle of at least one degree. The bottom tray is mounted to the drawer base below the receptacle not to slide relative to the drawer base. The bottom tray includes, but is not limited to, a tray wall and a drain aperture wall. The tray wall includes, but is not limited to, a front edge and a back edge and forms a second funnel that slopes downward from the front edge of the tray wall to the back edge of the tray wall at a second angle of at least one degree. The drain aperture wall is mounted to the tray wall at a lowest elevation of the second funnel.

In another example embodiment, an appliance is provided. The appliance includes, but is not limited to, a housing and the drawer assembly.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
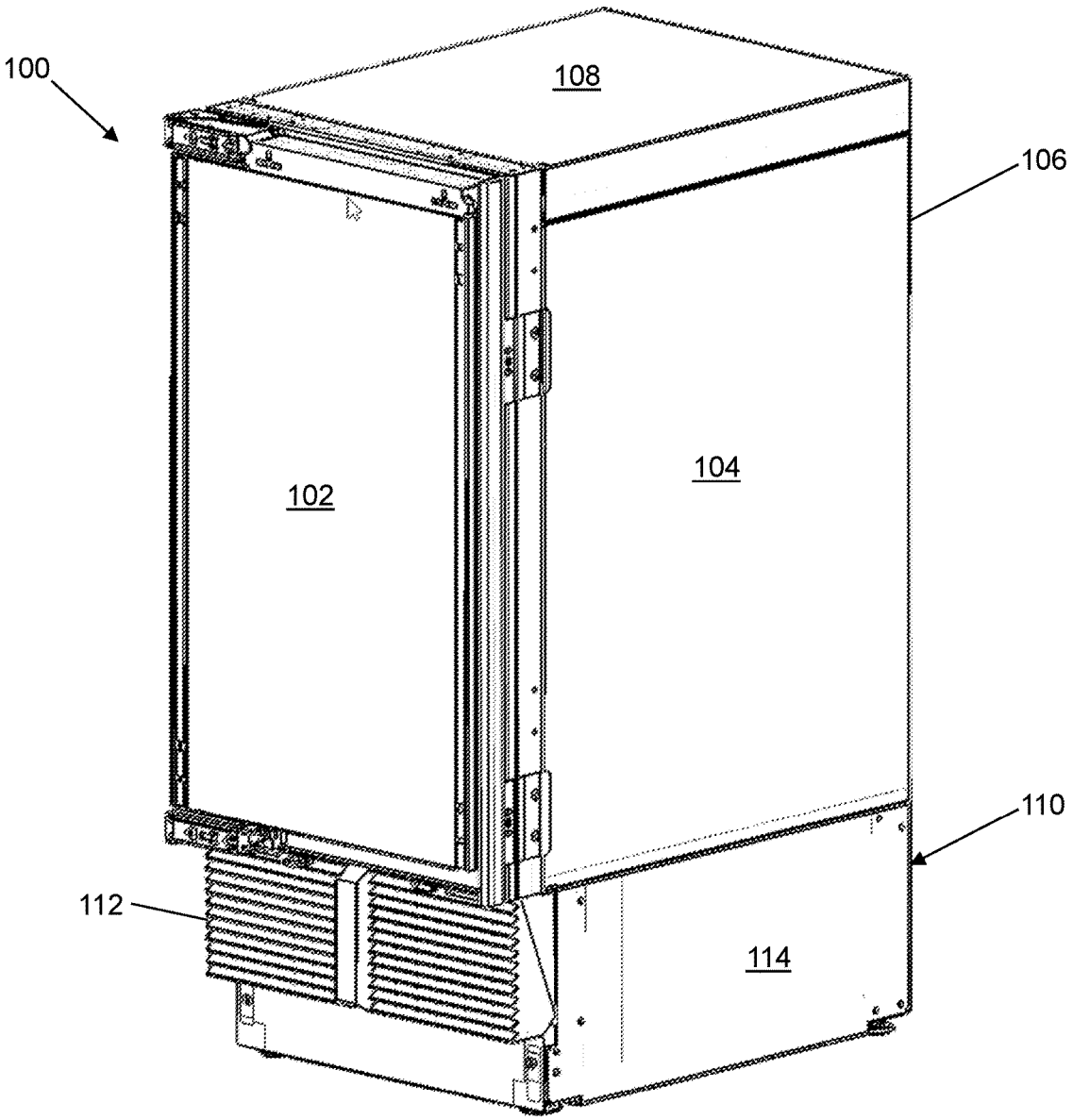
FIG. 1 depicts a right, front perspective view of an ice maker assembly in accordance with an illustrative embodiment.
Figure 2A:
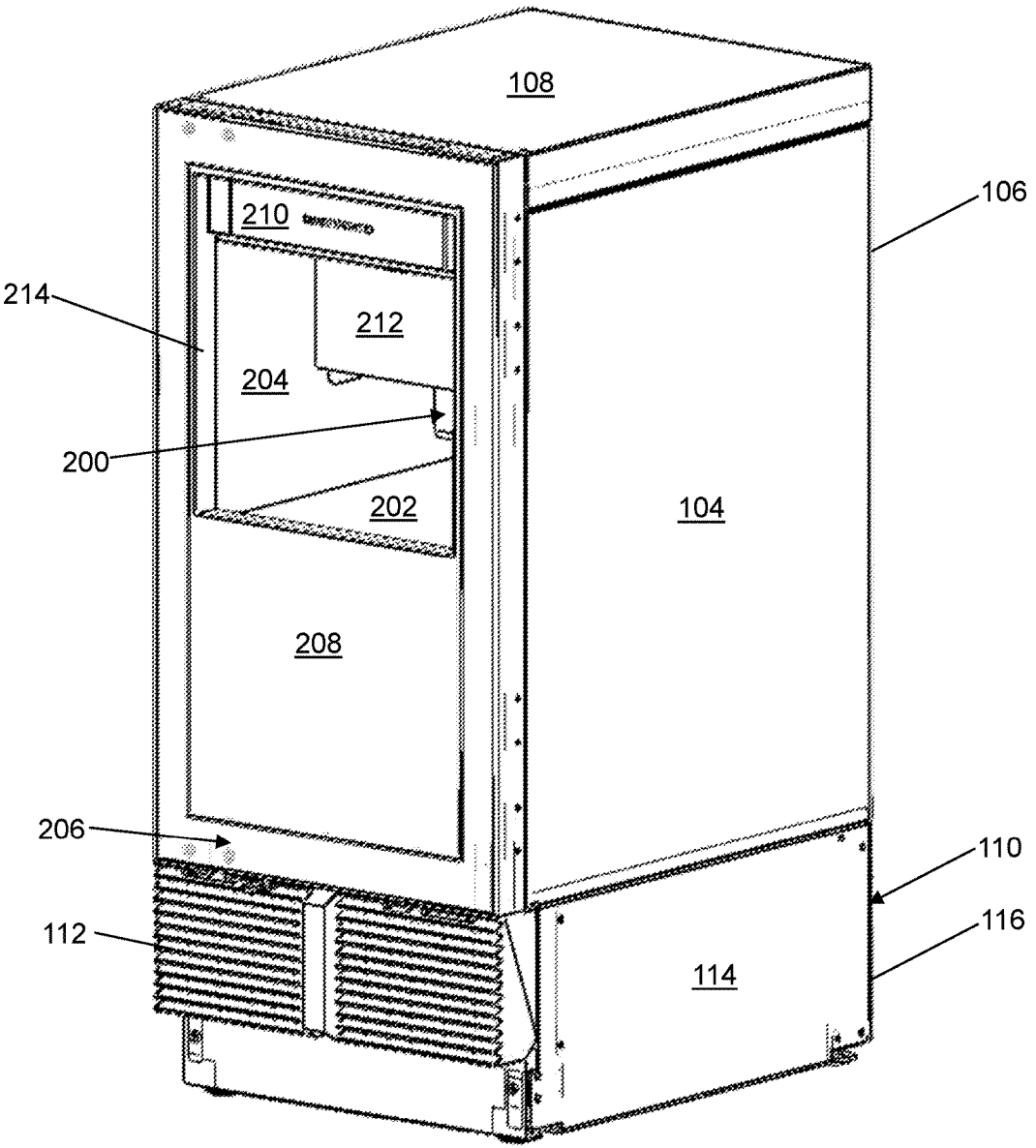
FIG. 2A depicts a right, front perspective view of the ice maker assembly of FIG. 1 with a door removed in accordance with an illustrative embodiment.
Figure 2B:
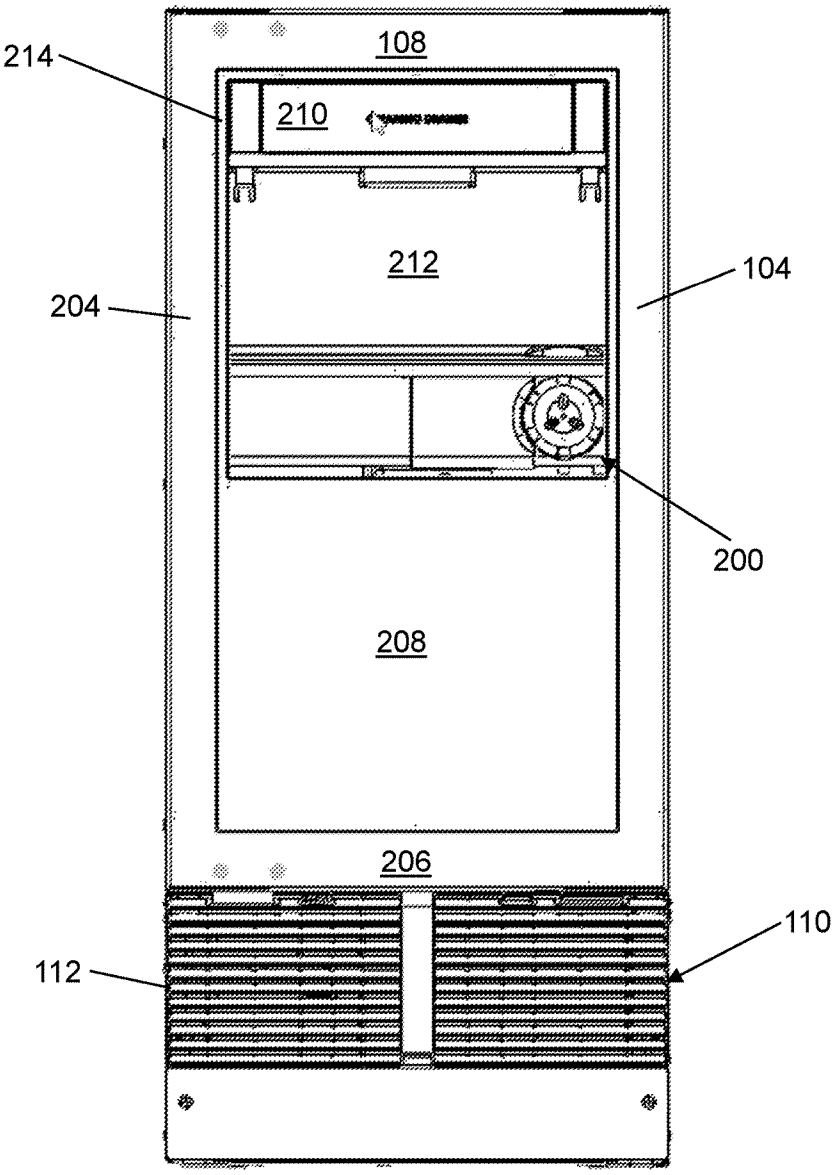
FIG. 2B depicts a front view of the ice maker assembly of FIG. 2A in accordance with an illustrative embodiment.

Referring to FIG. 1, a right, front perspective view of an ice maker assembly 100 is shown in accordance with an illustrative embodiment. Referring to FIG. 2A, a right, front perspective view of ice maker assembly 100 with a door 102 removed is shown in accordance with an illustrative embodiment. Referring to FIG. 2B, a front view of ice maker assembly 100 with door 102 removed is shown in accordance with an illustrative embodiment. In the illustrative embodiment, ice maker assembly 100 is a standalone ice making machine that includes an ice maker 200 that makes ice and directs the ice for storage in a bin 202. Ice maker assembly 100 may include door 102, a right side wall 104, a back wall 106, a left side wall 204, a top wall 108, a bottom wall 206, and a base compartment 110. In the illustrative embodiment, door 102 is rotatably mounted to top wall 106 and bottom wall 206 adjacent left side wall 204 using two hinges. In an alternative embodiment, door 102 may be rotatably mounted to different walls of ice maker assembly 100 using a fewer or a greater number of hinges. In an alternative embodiment, door 102 may not be mounted to bin 202.

Door 102 provides access to bin 202 that holds ice and may generally be defined by top wall 106, right side wall 104, back wall 106, left side wall 204, a bin front wall 208, and bottom wall 206. In the illustrative embodiment, a cleaning fluid drawer 210, an ice backstop 212, and ice maker 200 may be mounted adjacent top wall 106 within bin 202. Bin front wall 208 may include an aperture wall 214 that defines an opening through which ice may be withdrawn from bin 202 by a user. In the illustrative embodiment, aperture wall 214 defines a rectangular opening though other shapes may be used to define the aperture through which ice is withdrawn. In the illustrative embodiment, cleaning fluid drawer 210 is mounted at a top of aperture wall 214 and is recessed from a plane defined by a front face of bin front wall 208 though cleaning fluid drawer 210 may be mounted to other locations on ice maker assembly 100 and may not be recessed. When door 102 is in a closed position, ice cannot be withdrawn from bin 202.

As understood by a person of skill in the art, the walls and door 102 that form ice maker assembly 100 are insulated walls that include insulation to assist in maintenance of the desired temperature in bin 202. Electrical wiring and various conduits may further be located in the insulated walls. For example, during a manufacturing process, a space between exterior walls of ice maker assembly 100 and an interior liner may be filled with an insulating foam material that provides insulation.

Use of directional terms, such as top, bottom, right, left, front, back, etc. are merely intended to facilitate reference to the various surfaces and elements of the described structures relative to the orientations shown in the drawings and are not intended to be limiting in any manner. For consistency, the components of ice maker assembly 100 are labeled such that door 102 defines a front of ice maker assembly 100.

Though shown in the illustrative embodiment as forming a generally rectangular shaped enclosure, ice maker assembly 100 may form any shaped enclosure including other polygons as well as circular or elliptical enclosures. As a result, door 102, the walls forming ice maker assembly 100, and other components may have any shape including other polygons as well as circular or elliptical shapes.

Figure 3A:
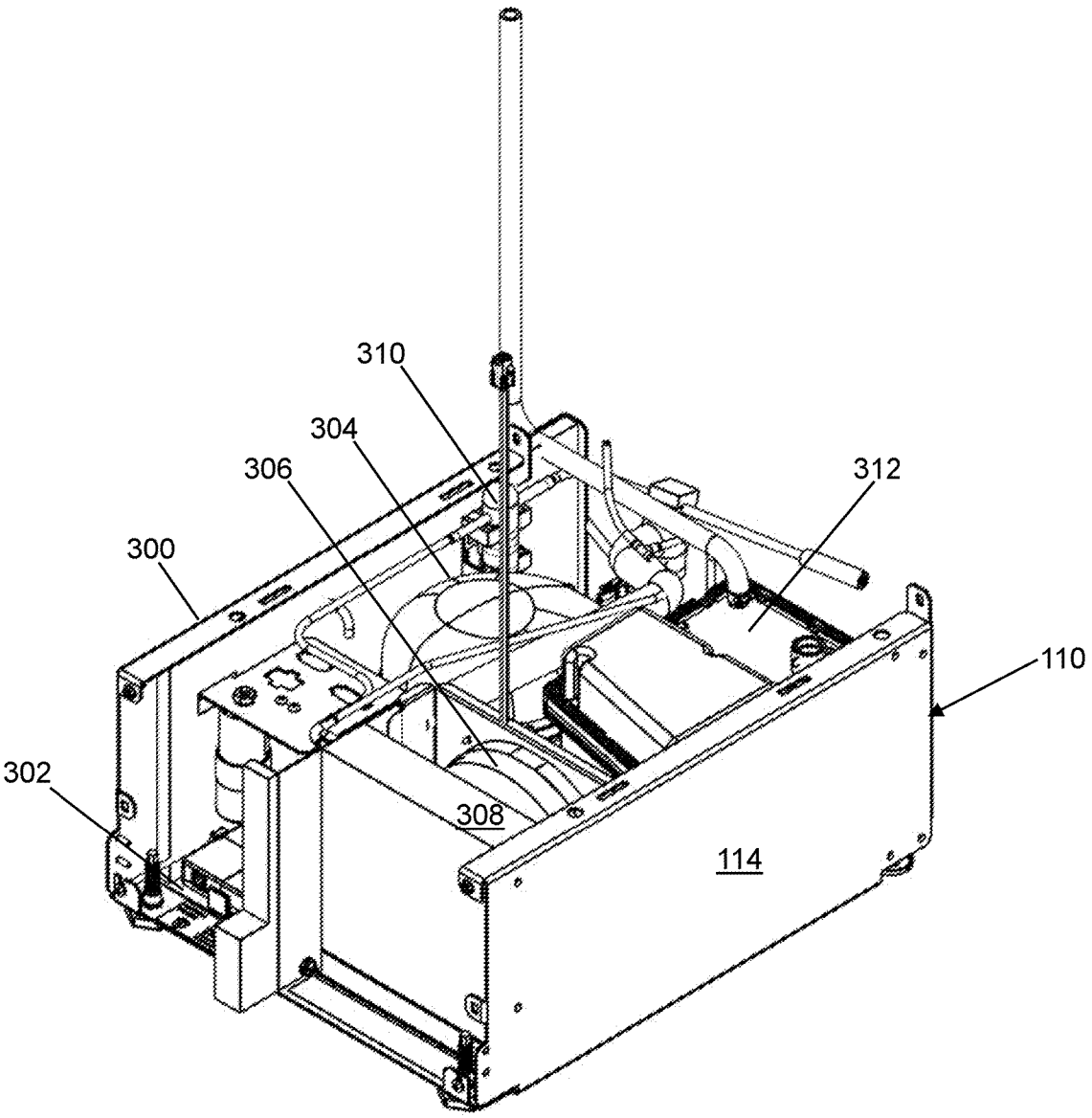
FIG. 3A depicts a right, front perspective view of a base compartment of the ice maker assembly of FIG. 1 in accordance with an illustrative embodiment.
Figure 3B:
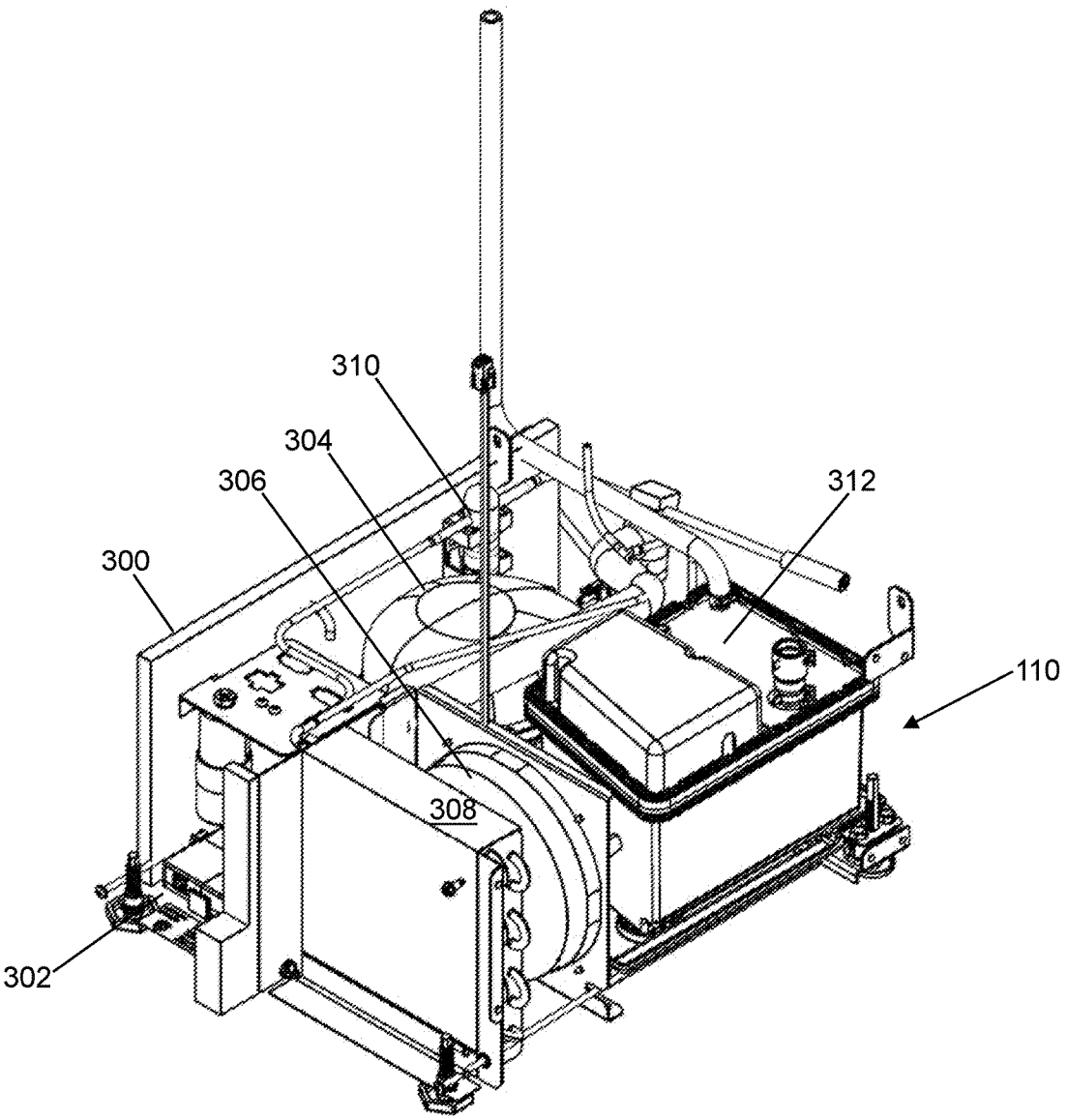
FIG. 3B depicts a right, front perspective view of the base compartment of FIG. 3 with walls removed to show refrigeration components of the ice maker assembly of FIG. 1 in accordance with an illustrative embodiment.

Referring to FIG. 3A, a right, front perspective view of base compartment 110 is shown in accordance with an illustrative embodiment. Referring to FIG. 3B, a right, front perspective view of base compartment 110 with walls removed is shown in accordance with an illustrative embodiment. Base compartment 110 may include a vent plate 112, a base right side wall 114, a base left side wall 300, and a base bottom wall 302. Base compartment 110 provides a housing for some of the refrigeration components of ice maker assembly 100. Base compartment 110 is mounted below bin 202 though base compartment 110 may be positioned at alternative locations relative to bin 202 in alternative embodiments. For example, base compartment 110 may be mounted above bin 202 or behind bin 202 in alternative embodiments. In the illustrative embodiment, bottom wall 206 forms a top wall of base compartment 110. Vent plate 112 includes louvers mounted across a face thereof to provide a flow of ambient air across the refrigeration components of ice maker assembly 100 mounted within base compartment 110.

The refrigeration components of ice maker assembly 100 cool ice mold 416 to a temperature that promotes the formation of ice as understood by a person of skill in the art. The refrigeration components may include a compressor, a condenser, an evaporator, a drier, etc., mounted to various walls of ice maker assembly 100 either within the walls, on an exterior of the walls relative to ice maker assembly 100, and/or on an interior of the walls relative to ice maker assembly 100. For example, the refrigeration components mounted within base compartment 110 may include a compressor 304, a fan 306, a condenser 308, a drier 310, and a sump water pump 312. Additional refrigeration components may be mounted closer to ice maker 200 as described further below. Various tubing may connect the refrigeration components to provide a refrigeration cycle as understood by a person of skill in the art.

Figure 4:
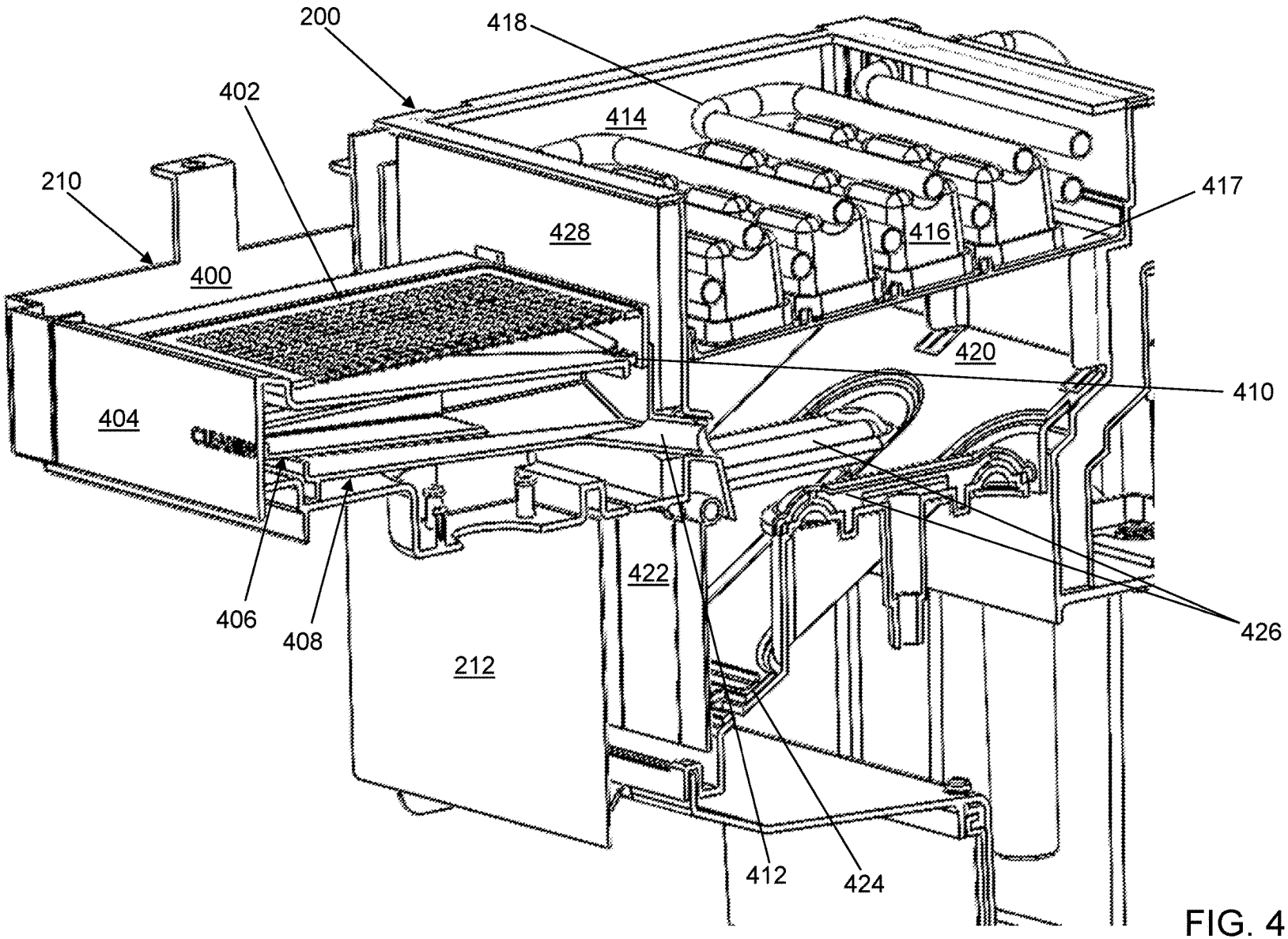
FIG. 4 depicts a right, front perspective cross-sectional view of a cleaning fluid drawer and an ice maker of the ice maker assembly of FIG. 1 in accordance with an illustrative embodiment.

Referring to FIG. 4, a right, front perspective cross-sectional view of cleaning fluid drawer 210, ice backstop 212, and ice maker 200 are shown in accordance with an illustrative embodiment. Cleaning fluid drawer 210 is shown in a fully closed position. Cleaning fluid drawer 210 may include a drawer base 400, a splash guard tray 402, a drawer 404, a transition tray 406, a bottom tray 408, a top drawer drain 410, and a drain tube 412. Drawer base 400 mounts cleaning fluid drawer 210 to ice maker assembly 100. For example, drawer base 400 mounts cleaning fluid drawer 210 to an interior side of top wall 108 of ice maker assembly 100. Drawer 404 is slidably mounted to drawer base 400. Bottom tray 408 is mounted to drawer base 400 so that bottom tray 408 does not slide with drawer 404. Transition tray 406 is mounted between drawer 404 and bottom tray 408 in a stacked manner such that splash guard tray 402 is mounted above drawer 404, drawer 404 is mounted above transition tray 406, and transition tray 406 is mounted above bottom tray 408.

Top drawer drain 410 is located on a floor of drawer 404 to provide a drain for fluid poured into drawer 404. The fluid travels through or over top drawer drain 410 onto a floor of transition tray 406 and/or onto a floor of bottom tray 408. Drain tube 412 is mounted to extend from the floor of bottom tray 408. Drain tube 412 receives the fluid poured into drawer 404 and provides a conduit to transport the fluid to an intended location within ice maker 200.

Figure 5A:
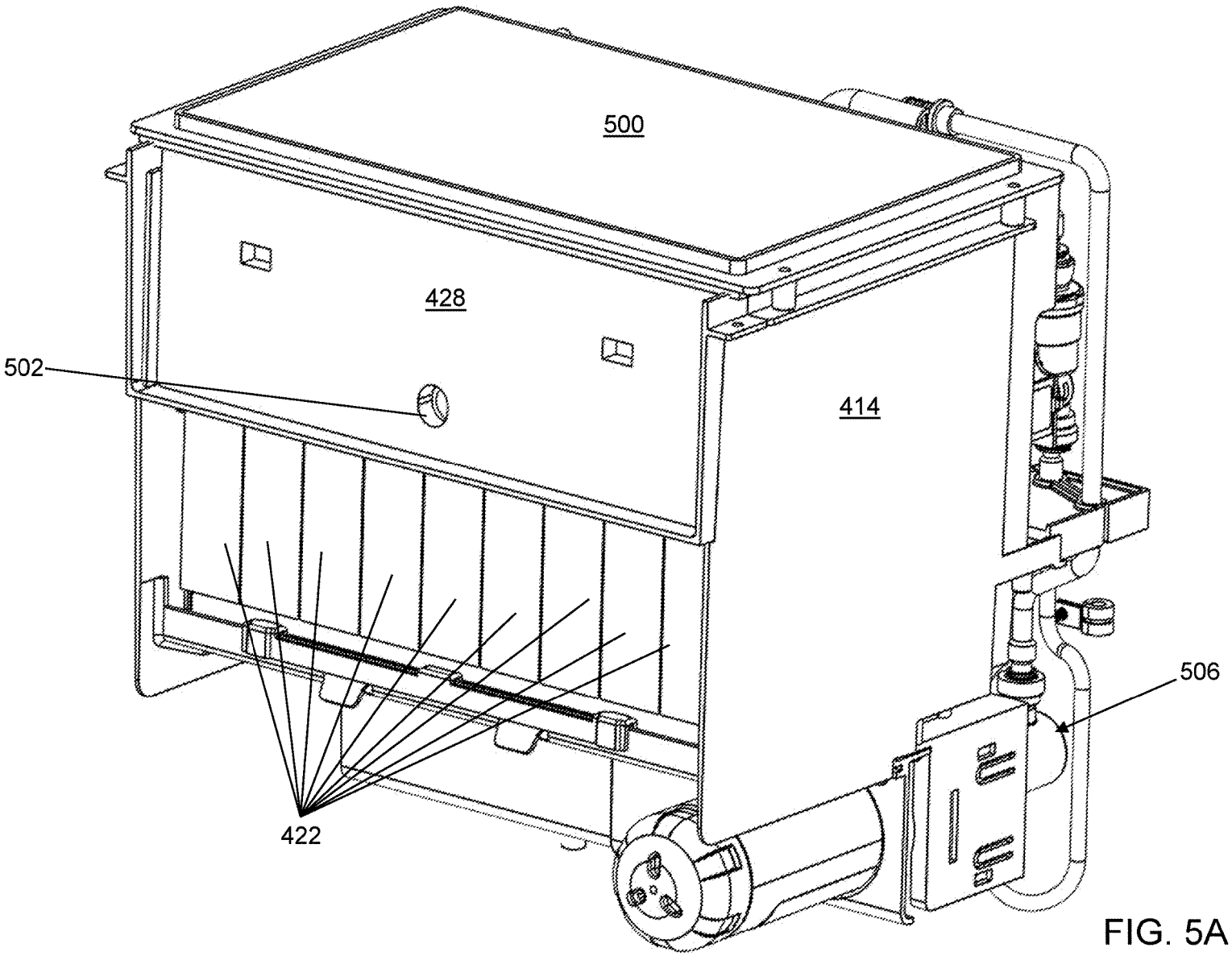
FIG. 5A depicts a right, front perspective view of the ice maker of the ice maker assembly of FIG. 1 in accordance with an illustrative embodiment.
Figure 5B:
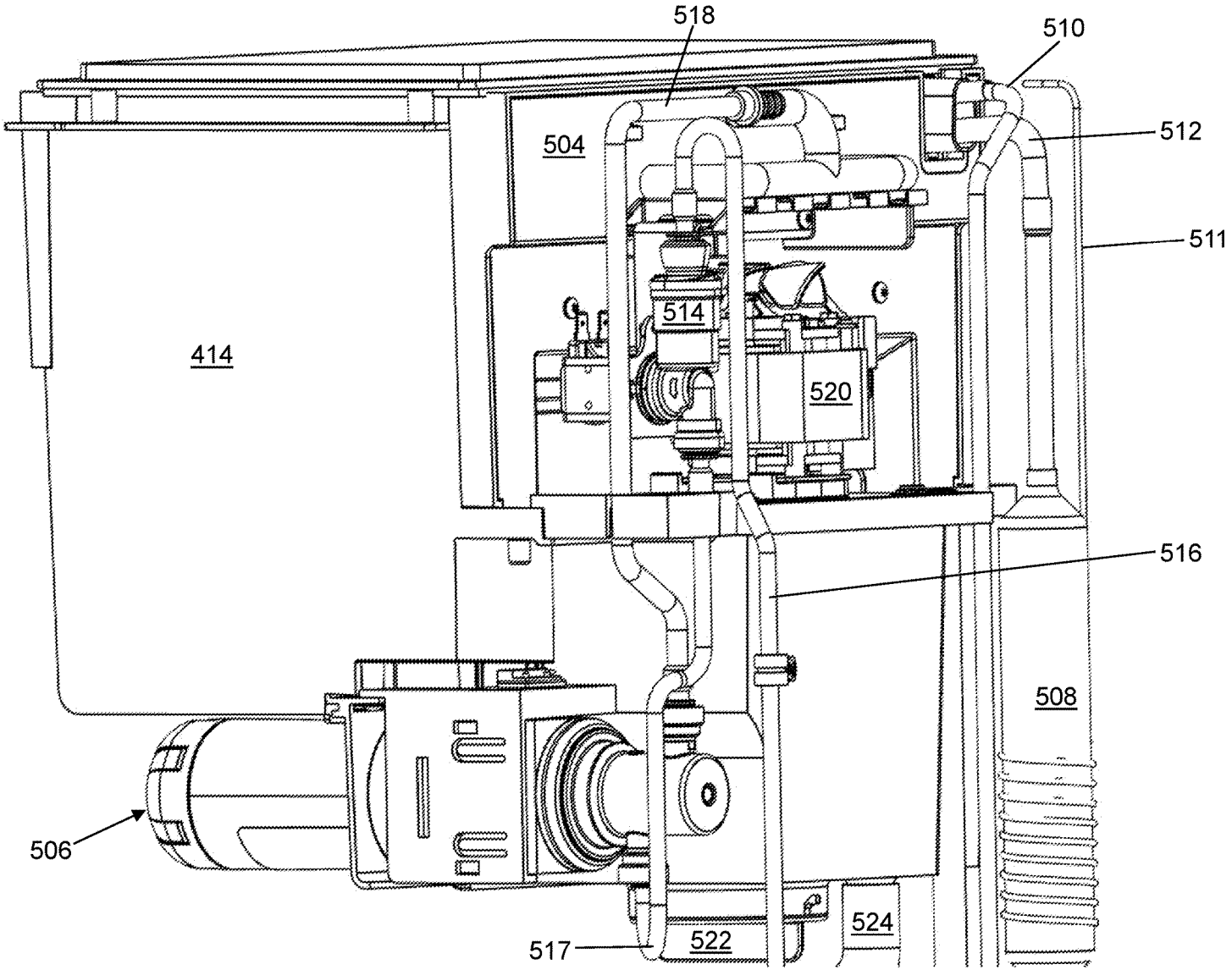
FIG. 5B depicts a right, back perspective view of the ice maker of FIG. 5A in accordance with an illustrative embodiment.

Ice maker 200 may include a sump housing 414, an ice mold 416, a mold tray 417, an evaporator coil 418, an ice chute 420, curtain fingers 422, drain aperture walls 424, a plurality of sprayers 426, and a cover 428. Referring to FIG. 5A, a right, front perspective view of ice maker 200 is shown in accordance with an illustrative embodiment. Referring to FIG. 5B, a right, back perspective view of ice maker 200 is shown in accordance with an illustrative embodiment. A housing for ice maker 200 may include sump housing 414, an ice maker top wall 500, cover 428, curtain fingers 422, and an ice maker back wall 504. A drain aperture wall 502 is formed through cover 428 and is positioned to align with drain tube 412 when bottom tray 408 is mounted to ice maker 200. The fluid poured into drawer 404 flows through drain aperture wall 502 and into an interior of ice maker 200 that may be referred to as a sump.

Ice maker 200 further may include a filter assembly 506, an accumulator 508, a warm refrigerant intake conduit 510, a refrigerant intake conduit 511, a refrigerant outtake conduit 512, a valve 514, a water intake conduit 516, a filter intake conduit 517, a filtered water conduit 518, a sump water pump 520, a drain cap 522, and an overflow drain tube 524. In an alternative embodiment, ice maker 200 may not include filter assembly 506.

Warm refrigerant intake conduit 510 may be connected to receive warm refrigerant from compressor 304. Warm refrigerant intake conduit 510 is connected to provide the warm refrigerant to evaporator coils 418 to trigger release of ice from ice mold 416. Refrigerant intake conduit 511 may be connected to receive refrigerant from condenser 308. Refrigerant intake conduit 511 is connected to provide the refrigerant to evaporator coils 418 to form the ice in ice mold 416. Refrigerant outtake conduit 512 is connected to receive the refrigerant from evaporator coil 418 after cooling ice mold 416. Accumulator 508 is mounted to receive refrigerant from refrigerant outtake conduit 512 to prevent liquid refrigerant from reaching compressor 304 that is designed to move vapor refrigerant in the form of a gas. Accumulator 508 is connected to provide the refrigerant in the form of a gas to compressor 304. Compressor 304 is connected to provide the refrigerant to condenser 308 that condenses the gaseous refrigerant back to a liquid state. Drier 310 is connected between condenser 308 and refrigerant intake conduit 511. Fan 306 is mounted to cool condenser 308. An ice maker controller (not shown) may control a flow of refrigerant through condenser 308, drier 310, evaporator coils 418, accumulator 508, and compressor 304 to control a temperature of ice mold 416 and within bin 202.

Figure 6:
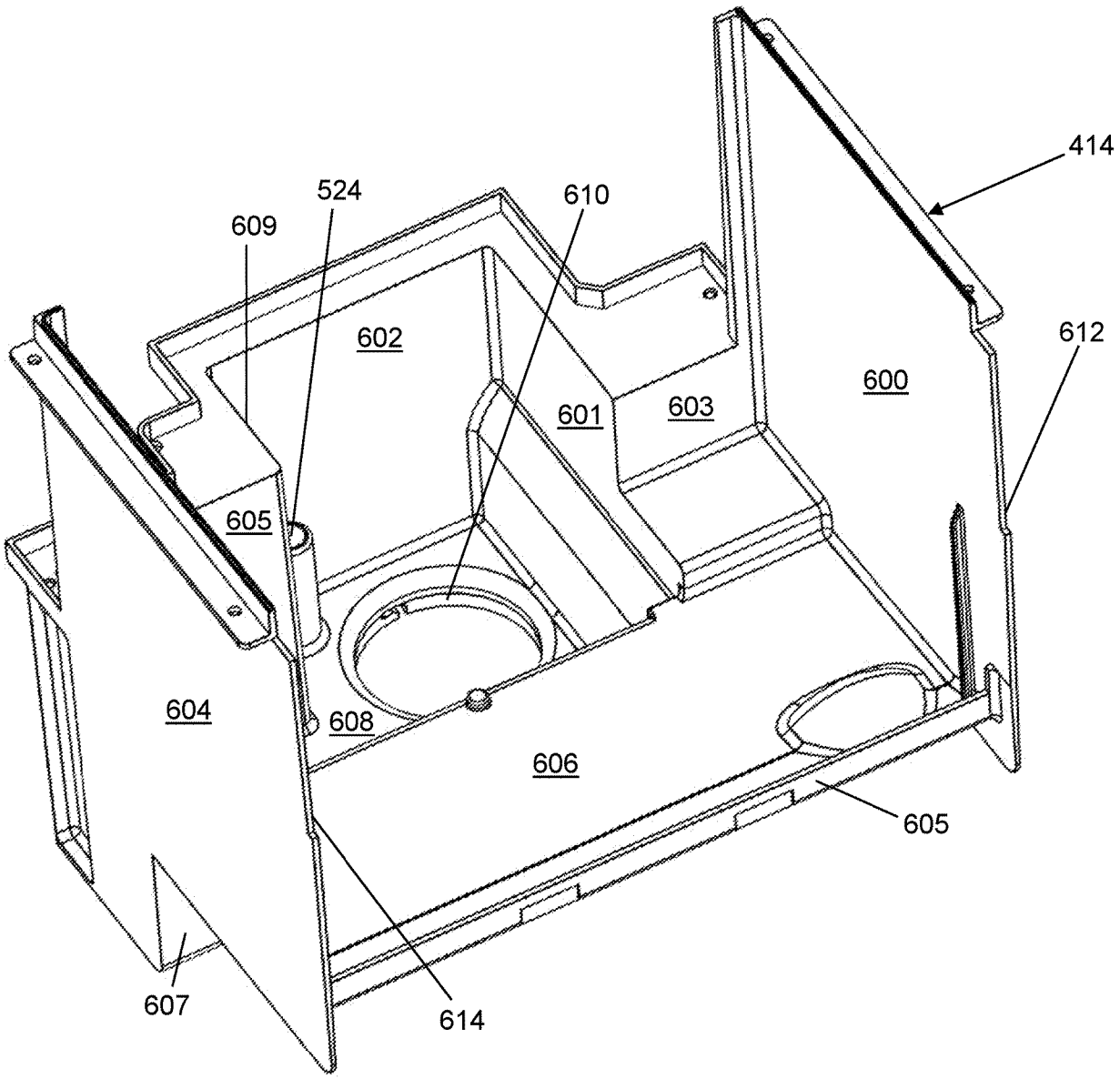
FIG. 6 depicts a left, front perspective view of a sump housing of the ice maker of FIG. 5A in accordance with an illustrative embodiment.

Referring to FIG. 6, a left, front perspective view of sump housing 414 is shown in accordance with an illustrative embodiment. Sump housing 414 may include an upper sump right side wall 600, a lower sump right side wall 601, a right sump back wall 603, a center sump back wall 602, a left sump back wall 605, an upper sump left side wall 604, a lower sump left side wall 609, a sump front lip 605, an upper sump bottom wall 606, a lower sump front wall 607, a lower sump bottom wall 608, a sump drain aperture wall 610, and a sump overflow drain tube 612. Cover 428 mounts to an upper portion of a front edge 612 of sump right side wall 600 and a front edge 614 of sump left side wall 604. Curtain fingers 422 are mounted just behind sump front lip 605 to block water from exiting the sump cavity when ice is being formed. Upper sump bottom wall 606 slopes downward toward lower sump bottom wall 608 to feed fluid into a lower portion of the sump. Upper sump right side wall 600 and lower sump right side wall 601 form a right sidewall of ice maker 200. Upper sump left side wall 604 and lower sump left side wall 609 form a left sidewall of ice maker 200. Right sump back wall 603, center sump back wall 602, and left sump back wall 605 mount to ice maker back wall 504 and form a lower portion of a back wall of ice maker 200 below ice maker back wall 504. Lower sump front wall 607, lower sump right side wall 601, center sump back wall 602, lower sump left side wall 609, left sump back wall 605, and lower sump bottom wall 608 form the sump cavity.

Sump drain aperture wall 610 is formed through lower sump bottom wall 608. Drain cap 522 is sized and shaped to mount to sump drain aperture wall 610. Drain cap 522 can be removed to empty any fluid or solid materials that accumulate in the sump cavity formed by sump housing 414.

Overflow drain tube 524 extends through lower sump bottom wall 608. A portion of overflow drain tube 524 extends above lower sump bottom wall 608. Overflow drain tube 524 provides a sump overflow drain tube that may be connected to sump water pump 312 to receive excess water within the sump cavity. For example, overflow drain tube 524 may be selected to extend above lower sump bottom wall 608 a height that is less than a height of lower sump front wall 607 to ensure that fluid does not overflow the sump cavity above upper sump bottom wall 606.

Figure 7A:
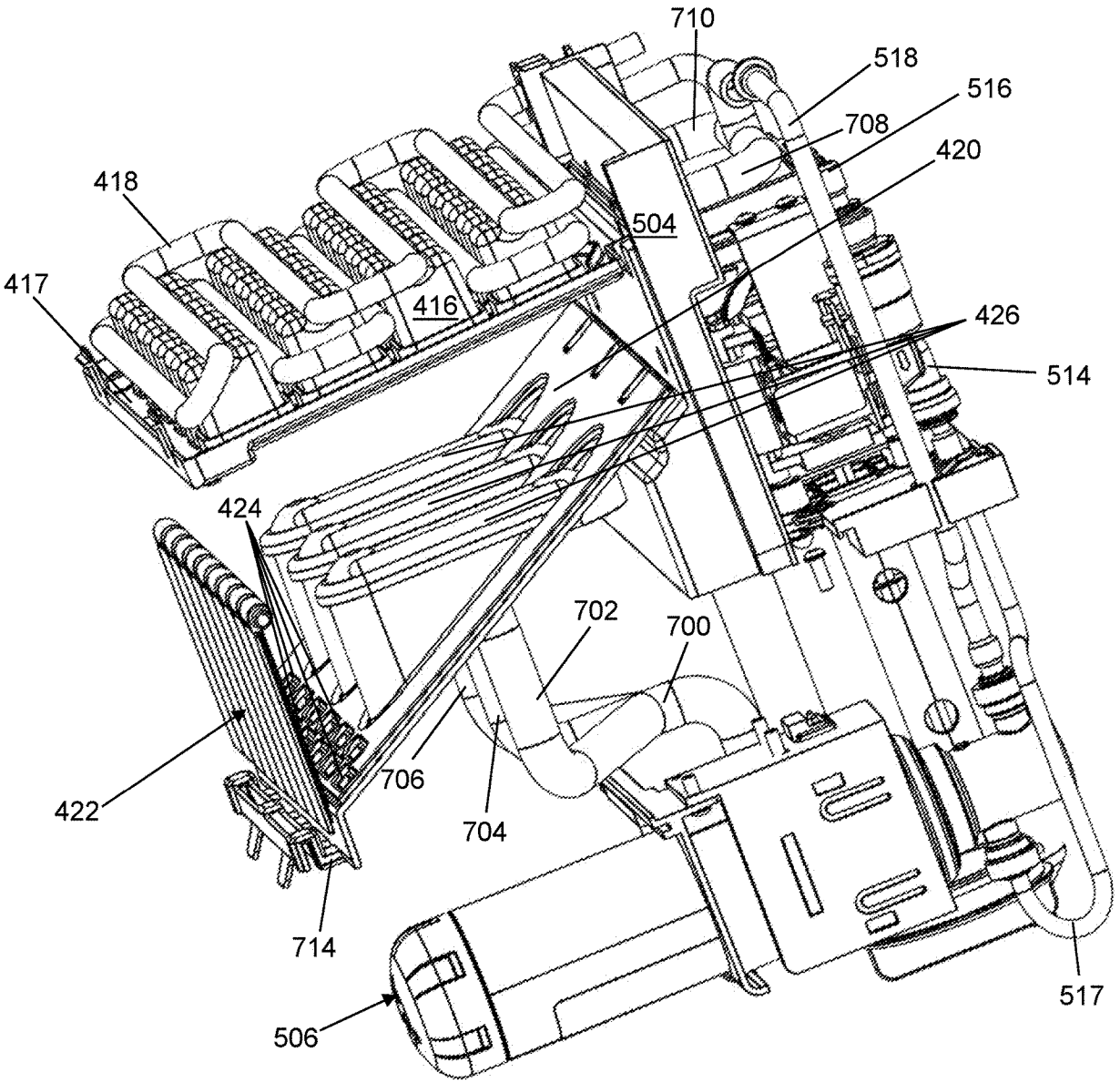
FIG. 7A depicts a right, front perspective view of ice making components of the ice maker of FIG. 5A in accordance with an illustrative embodiment.
Figure 7B:
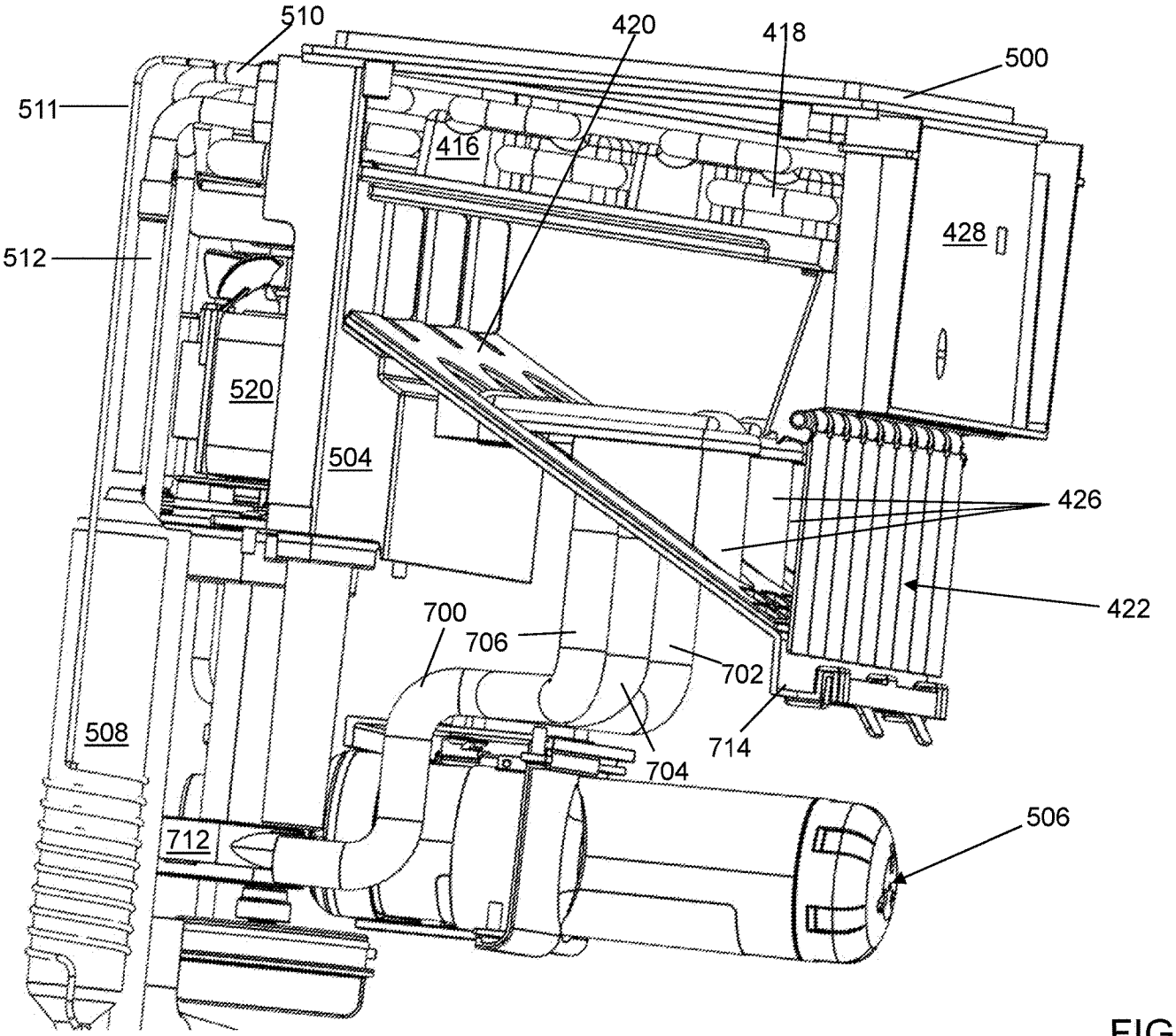
FIG. 7B depicts a left perspective view of the ice making components of FIG. 7A in accordance with an illustrative embodiment.
Figure 7C:
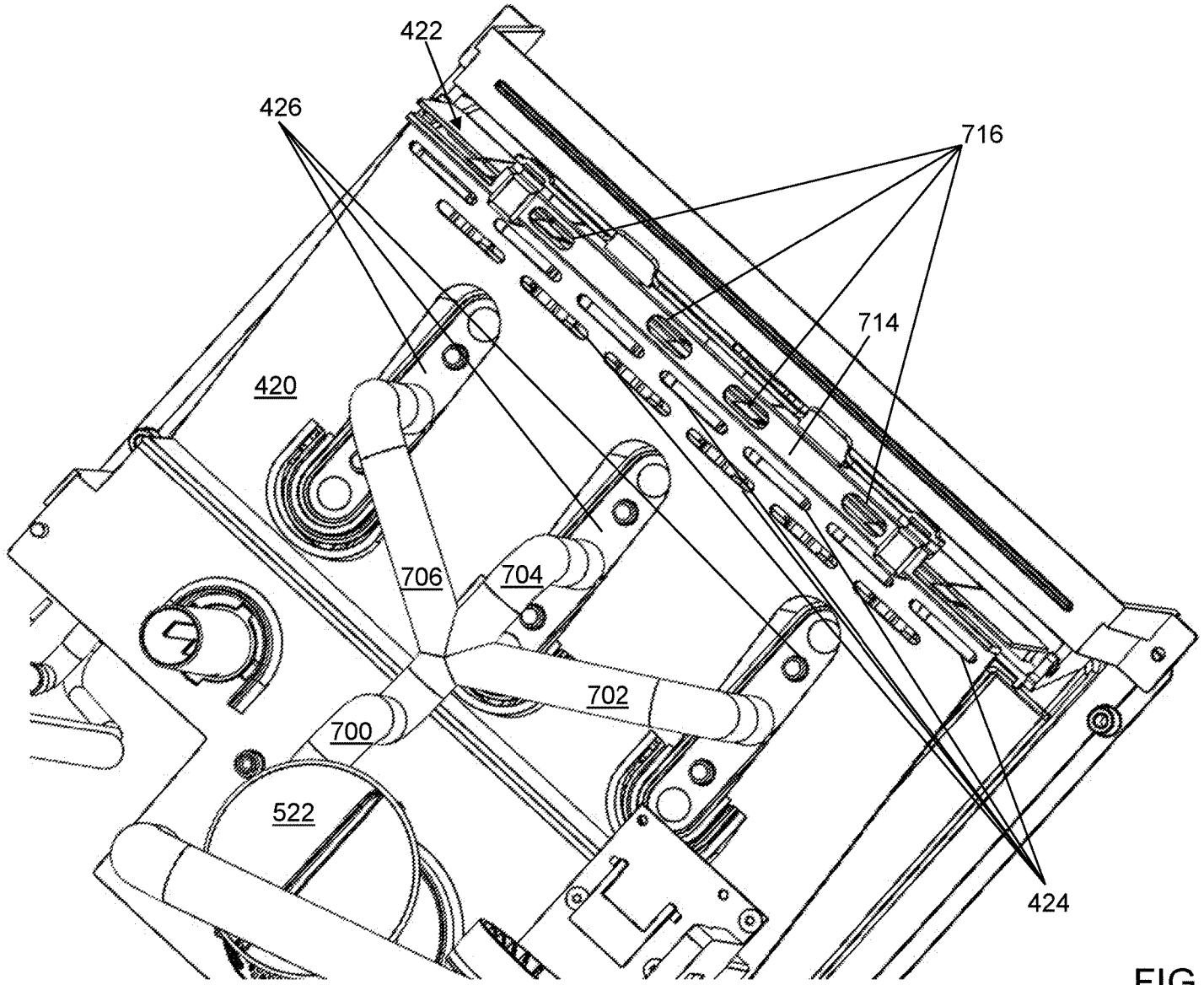
FIG. 7C depicts a bottom perspective view of the ice making components of FIG. 7A in accordance with an illustrative embodiment.

Referring to FIG. 7A, a right, front perspective view of ice making components of ice maker 200 are shown in accordance with an illustrative embodiment. Referring to FIG. 7B, a left perspective view of the ice making components are shown in accordance with an illustrative embodiment. Referring to FIG. 7C, a bottom perspective view of the ice making components are shown in accordance with an illustrative embodiment. Sump housing 414 has been removed so that the ice making components are visible.

Evaporator coil 418 forms a two-level serpentine pattern above a top of each ice piece mold of ice mold 416 and between each row of molds of ice mold 416. For example, in the illustrative embodiment, ice mold 416 includes four rows of generally rectangular molds with six molds in each row to form 24 ice pieces. Each mold may form other shapes and be larger or smaller than those shown in the illustrative embodiment. Ice mold 416 may form a greater or a fewer number of ice pieces in alternative embodiments. Each ice piece may be formed to have a variety of shapes including spheres, cylinders, multi-sided polygons, etc. The size of the ice piece is further not intended to be limiting Ice mold 416 is formed using a material that can be kept at or below freezing by evaporator coil 418 to form the ice pieces. Illustrative materials include stainless steel and copper with or without plating. Ice mold 416 is surrounded by mold tray 417. Mold tray 417 includes mold aperture walls within which each mold of ice mold 416 fits. Mold tray 417 slopes downward toward a front of ice maker 200.

A sprayer conduit 700 is connected to receive water from a pump head 712 of sump water pump 520 that pumps water from the sump cavity into sprayer conduit 700. Sprayer conduit 700 splits into a first sprayer conduit 702, a second sprayer conduit 704, and a third sprayer conduit 706. Each sprayer conduit is connected to a different sprayer of the plurality of sprayers 426. For example, in the illustrative embodiment, the plurality of sprayers 426 includes three sprayers. First sprayer conduit 702 is connected to a first sprayer of the plurality of sprayers 426. Second sprayer conduit 704 is connected to a second sprayer of the plurality of sprayers 426. Third sprayer conduit 706 is connected to a third sprayer of the plurality of sprayers 426. There may be a greater or a fewer number of sprayers of the plurality of sprayers 426, for example, based on dimensions of ice mold 416.

An ice chute drip channel 714 is a channel formed across a front edge of ice chute 420. Channel drain aperture walls 716 are formed through a bottom of ice chute drip channel 714.

Figure 8:
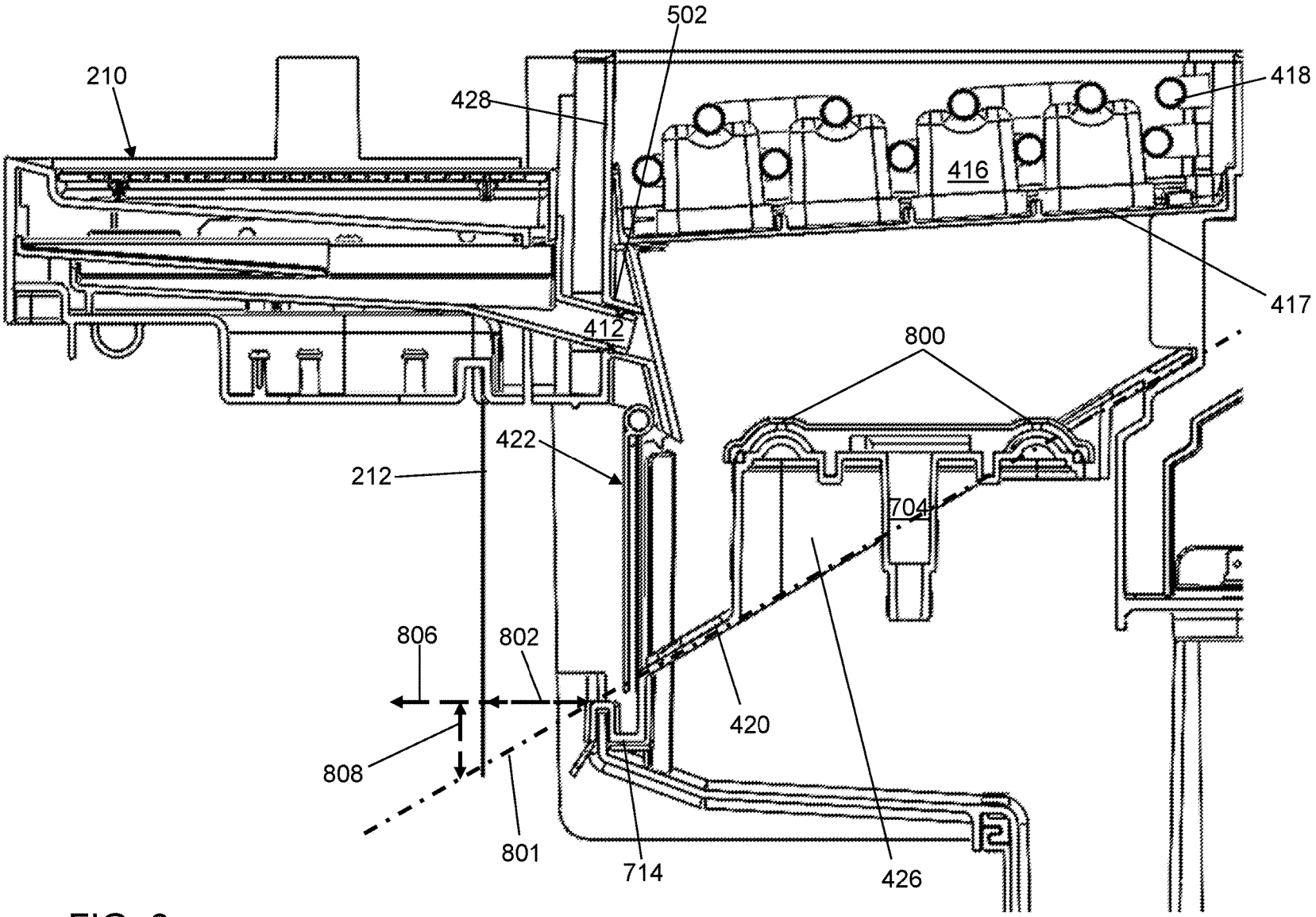
FIG. 8 depicts a right-side cross-sectional view of the cleaning fluid drawer and the ice maker of FIG. 5 in accordance with an illustrative embodiment.

Referring to FIG. 8, a right-side cross-sectional view of cleaning fluid drawer and ice maker are shown in accordance with an illustrative embodiment. In the illustrative embodiment, each sprayer includes a pair of nozzles 800. There may be a greater or a fewer number of nozzles in each sprayer, for example, based on dimensions of ice mold 416 and a size of a spray cone generated by each nozzle. Each ice piece mold of ice mold 416 is open downwards toward the plurality of sprayers 426. Each nozzle sprays water upward into ice mold 416.

To form ice, valve 514 is connected to receive water or another type of fluid in an alternative embodiment. Valve 514 controls a flow of the water into filter intake conduit 517 that is connected between valve 514 and filter assembly 506. Filter assembly 506 filters the water and provides the filtered water to filtered water conduit 518 that is connected to a first intake conduit 708 and a second intake conduit 710 that extend through aperture walls formed through ice maker back wall 504 and open onto mold tray 417.

The water from first intake conduit 708 and second intake conduit 710 flows down mold tray 417 through apertures (not shown) formed in a front of mold tray 417. The water from mold tray 417 flows down through drain aperture walls 424 of ice chute 420 and channel drain aperture walls 716 of ice chute drip channel 714 onto upper sump bottom wall 606 and downward into the sump cavity where it can be pumped by sump water pump 520 into sprayer conduit 700. In particular, water striking curtain fingers 422 flows down into ice chute drip channel 714 and through channel drain aperture walls 716. Curtain fingers 422 primarily keep the water from flowing exterior of ice maker 200.

Sprayer conduit 700 splits the pumped water into first sprayer conduit 702, second sprayer conduit 704, and third sprayer conduit 706 that are each connected to a sprayer of the plurality of sprayers 426. Each nozzle of the plurality of sprayers 426 sprays the water upward into ice mold 416 to form the ice pieces as the sprayed water freezes. Unfrozen water falls back onto ice chute 420 and flows down through drain aperture walls 424 of ice chute 420 and channel drain aperture walls 716 of ice chute drip channel 714 onto upper sump bottom wall 606 and downward into the sump cavity where it can again be pumped by sump water pump 520 into sprayer conduit 700. The ice pieces formed by ice maker 200 may be referred to as "clear ice" due to a reduction in minerals trapped in the ice pieces. Minerals not removed by filter assembly 506 collect in a bottom of the sump cavity.

Once the ice maker controller determines that sufficient water has been provided to form the ice pieces, valve 514 is switched closed to stop the flow of water into filter assembly 506 or directly into filtered water conduit 518 when ice maker 200 does not include filter assembly 506. Once the ice maker controller determines that formation of the ice pieces is complete, the ice maker controller triggers a release of the ice pieces from ice mold 416. Warm refrigerant may be provided through warm refrigerant intake conduit 510 to release the ice from ice mold 416, for example. The ice pieces travel by gravity down ice chute 420 through curtain fingers 422 and into bin 202.

Typically, the ice pieces fall and collect toward a front of bin 202 instead of distributing evenly across a top surface of bottom wall 206 of bin 202 due to the downward slope of ice chute 420 towards the front of bin 202 as indicated by an ice chute plane 801. The ice pieces may strike a top of the ice pile and tumble from the ice pile toward a back of bin 202. Nevertheless, the ice pile is biased towards the front of bin 202 with the ice pile high toward the front and low toward the back of bin 202.

Figure 9:
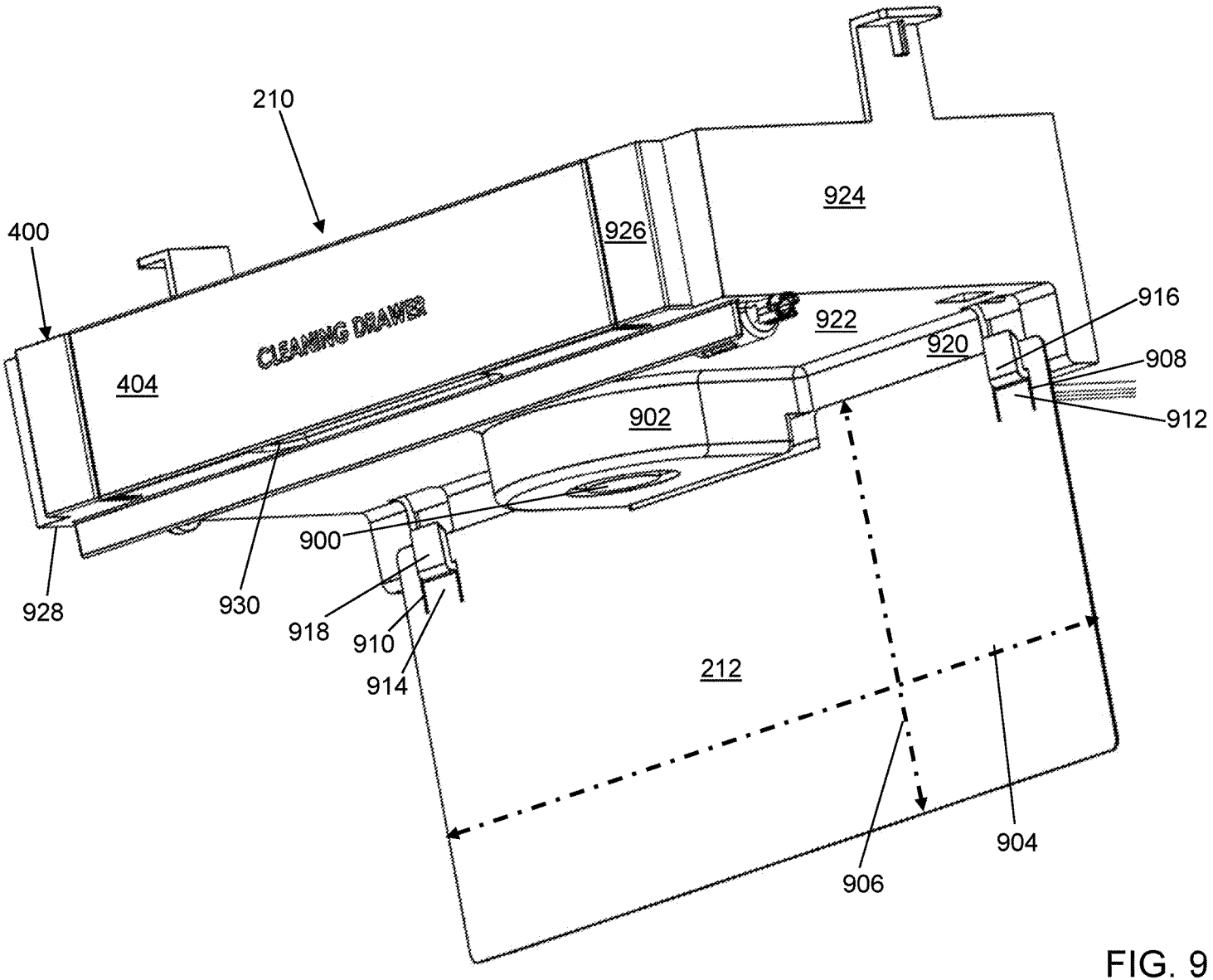
FIG. 9 depicts a right, front perspective view of the cleaning fluid drawer of FIG. 5 with an ice stop in accordance with an illustrative embodiment.
Figure 10:
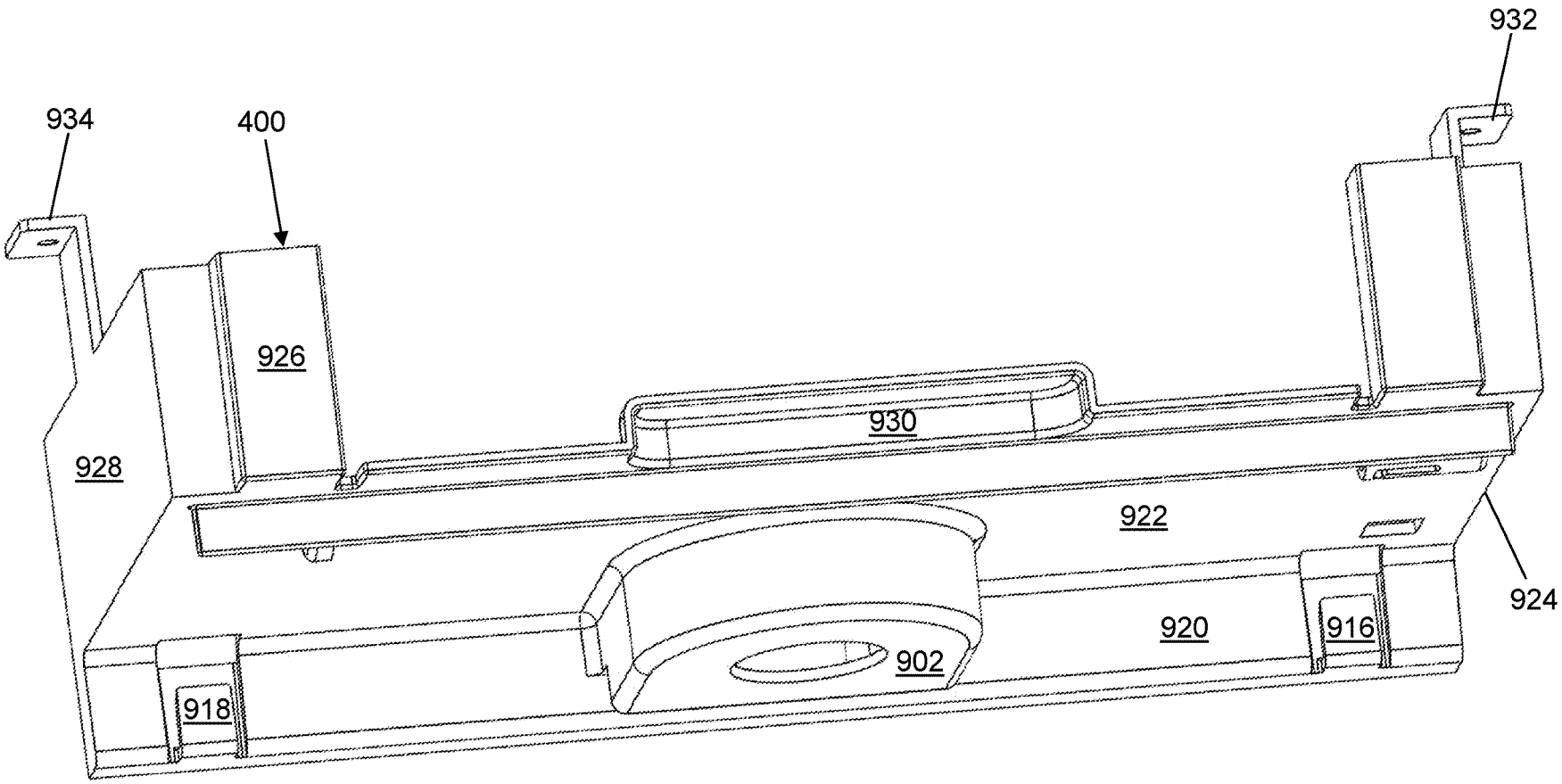
FIG. 10 depicts a left, front perspective view of a drawer base of the cleaning fluid drawer of FIG. 5 with ice stop mounting hooks in accordance with an illustrative embodiment.

Referring to FIG. 9, a right, front perspective view of cleaning fluid drawer 210 with ice backstop 212 is shown in accordance with an illustrative embodiment. Referring to FIG. 10, a left, front perspective view of drawer base 400 is shown in accordance with an illustrative embodiment.

In an illustrative embodiment, an ice level sensor 900 is mounted within a sensor housing 902 that is mounted to a bottom surface of a support bottom wall 922 of drawer base 400. Ice level sensor 900 points down towards the ice pile and is configured to measure a height of the ice pile that is provided to the ice maker controller so that the ice maker controller can determine when to stop forming ice pieces and when to start forming more ice pieces. For example, ice level sensor 900 may be an infrared sensor though other types of sensors may be used. Additionally, ice level sensor 900 may be mounted in alternative locations within bin 202 in alternative embodiments.

Ice level sensor 900 ensures that the ice does not spill out of aperture wall 214 by indicating when the ice pile has reached a predefined height within bin 202. Because the ice pile is biased toward the front of bin 202, ice level sensor 900 does not accurately indicate when additional ice pieces should be formed. To overcome this problem, ice backstop 212 is positioned an ice stop mounting distance 802 (shown referring to FIG. 8) from an end of ice chute 420 beyond which the ice drops into bin 202.

For illustration, ice stop mounting distance 802 may be selected to direct the ice pieces received from ice chute 420 toward a center of bin 202 to result in an approximately even distribution of the ice pieces across the top surface of bottom wall 206 of bin 202. Ice stop mounting distance 802 is too far to serve the purpose of even ice distribution when an insufficient number of ice pieces strike ice backstop 212 after being discharged from ice chute 420. Ice stop mounting distance 802 is too close to serve the purpose of even ice distribution when ice pieces become stuck between ice backstop 212 and ice chute 420. Ice stop mounting distance 802 may also be selected such that ice backstop 212 is far enough from aperture wall 214 so that ice backstop 212 does not interfere with the removal of ice from bin 202. An acceptable range of distance values for ice stop mounting distance 802 is between the distance that is too close and the distance that is too far.

A width 904 of ice backstop 212 may be selected to cover an ice release zone width relative to from ice chute 420. Height 906 of ice backstop 212 may be selected to extend a sufficient distance below a horizontal exit plane 806 from ice chute 420. For example, height 906 may be selected to include a momentum distance 808 below horizontal exit plane 806 to ensure that ice pieces strike ice backstop 212. As ice backstop 212 is moved away from the end of ice chute 420, thereby increasing ice stop mounting distance 802, momentum distance 808 also increases.

A type of material and a thickness of ice backstop 212 may further be selected to flex when the ice pieces strike ice backstop 212 to avoid trapping the ice pieces between ice backstop 212 and ice chute 420. For illustration, ice stop mounting distance 802 was selected as 1.26 inches and momentum distance 808 was selected as 1.54 inches with a slope of ice chute 420 equal to 30 degrees. In an illustrative embodiment, ice backstop 212 was a 0.03 inch thick sheet of Acrylonitrile butadiene styrene, which is a thermoplastic polymer. Other materials with various thicknesses can be used in alternative embodiments such as one or more layers of plastic, rubber, silicone, etc. Considerations in selecting the material for ice backstop 212 include an amount of noise created when ice strikes ice backstop 212, corrosion resistance, strength, hardness, etc.

To illustrate the effect of ice backstop 212 on the ice distribution, an illustrative design for ice maker assembly 100 without ice backstop 212 was used. Ice level sensor 900 indicated that bin 202 was full when sixteen pounds of ice was stored in bin 202. Based on the illustrative design for ice maker assembly 100 with ice backstop 212, twenty-two pounds of ice was stored in bin 202 when ice level sensor 900 indicated that bin 202 was full. Due to the more even distribution of ice in bin 202, six additional pounds of ice was stored when using ice backstop 212.

Ice backstop 212 may include a right mounting slit wall 908 and a left mounting slit wall 910. Right mounting slit wall 908 formed through ice backstop 212 defines a right mounting tab 912. Left mounting slit wall 910 formed through ice backstop 212 defines a left mounting tab 914. A right mounting hook 916 is mounted to a right side of a support descending back wall 920 of drawer base 400 in the illustrative embodiment. A left mounting hook 918 is mounted to a left side of support descending back wall 920.

Figure 11:
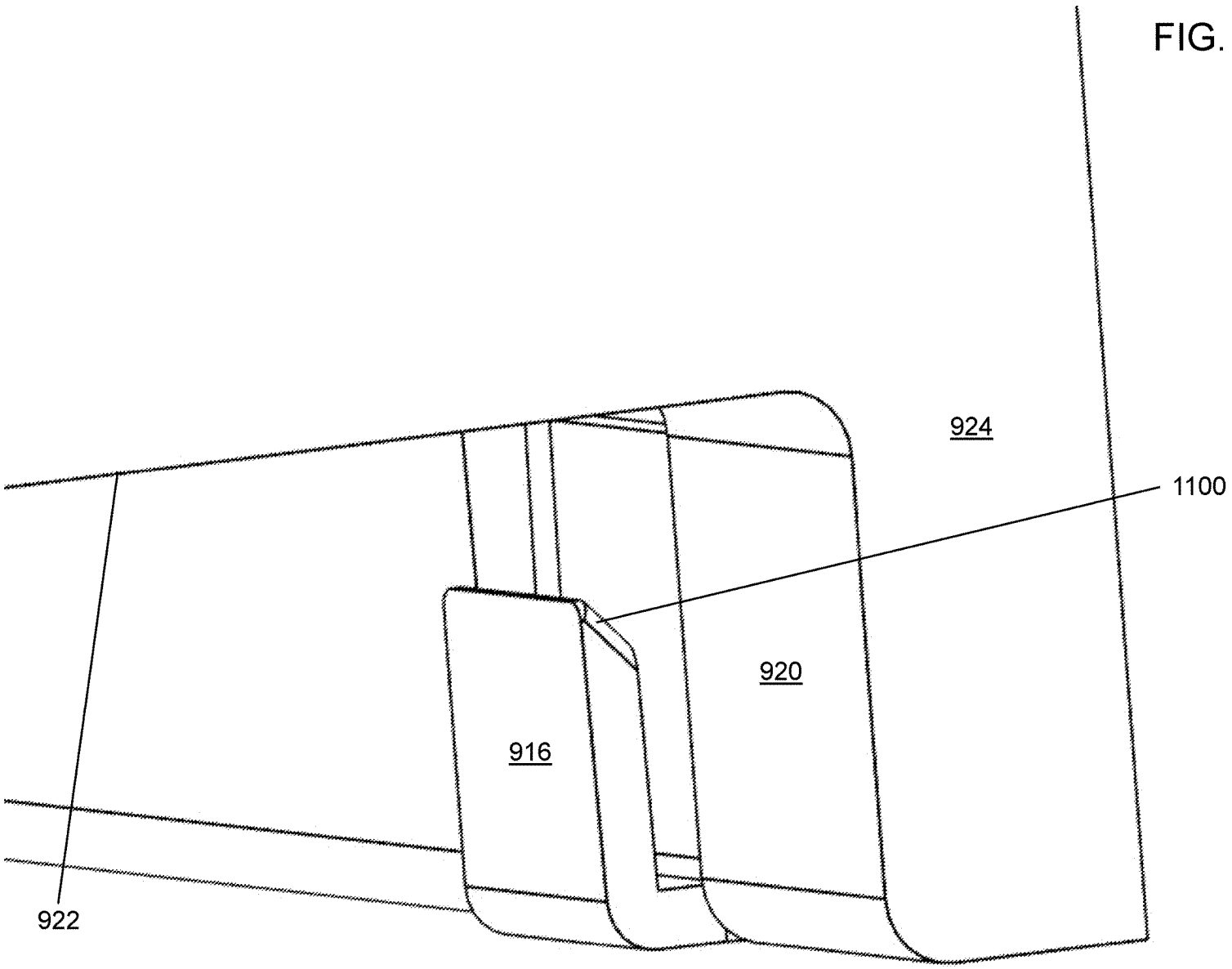
FIG. 11 depicts a zoomed left, front perspective view of a right mounting hook of the ice stop mounting hooks of FIG. 10 in accordance with an illustrative embodiment.
Figure 12A:
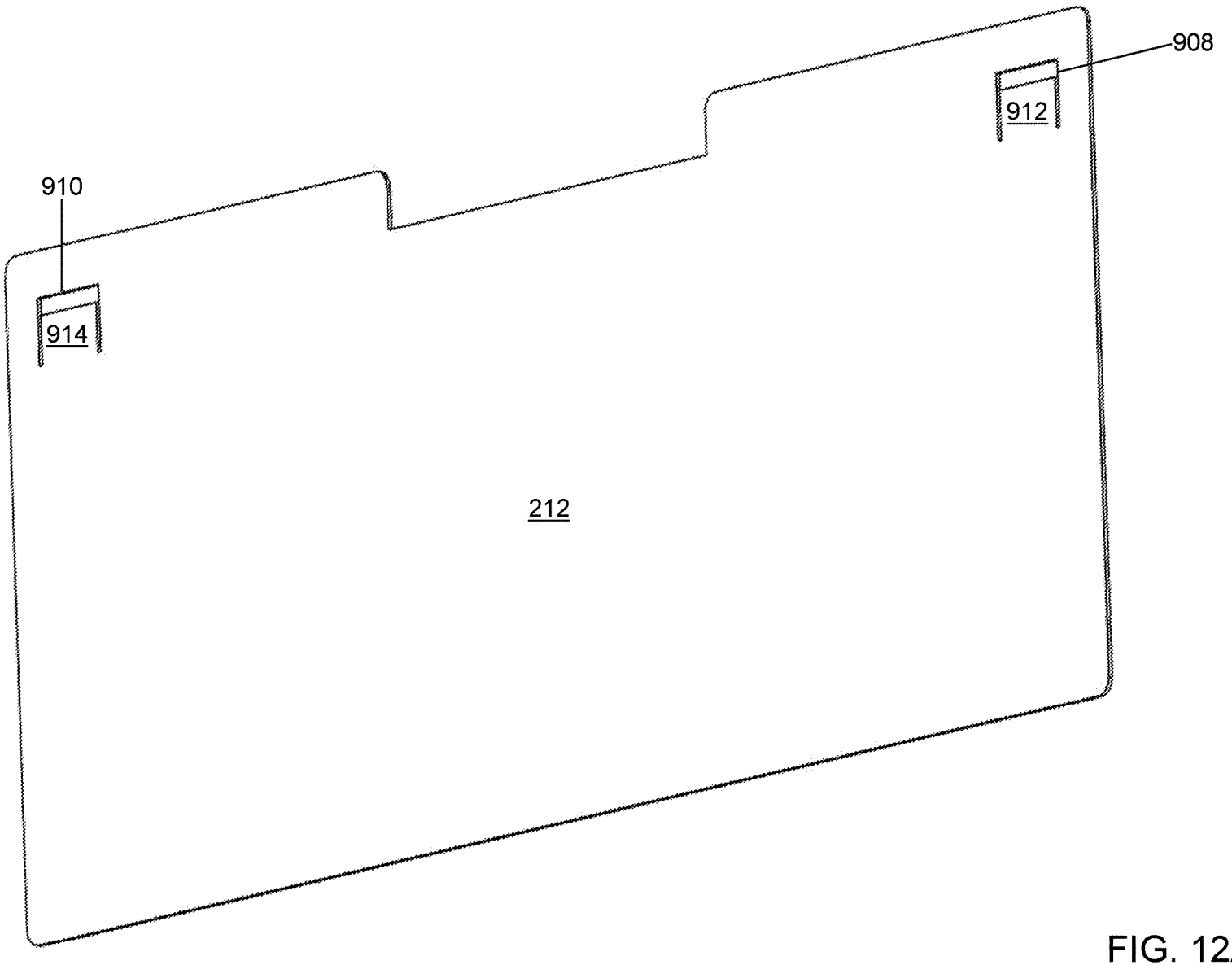
FIG. 12A depicts a front perspective view of the ice stop of FIG. 9 in accordance with an illustrative embodiment.
Figure 12B:
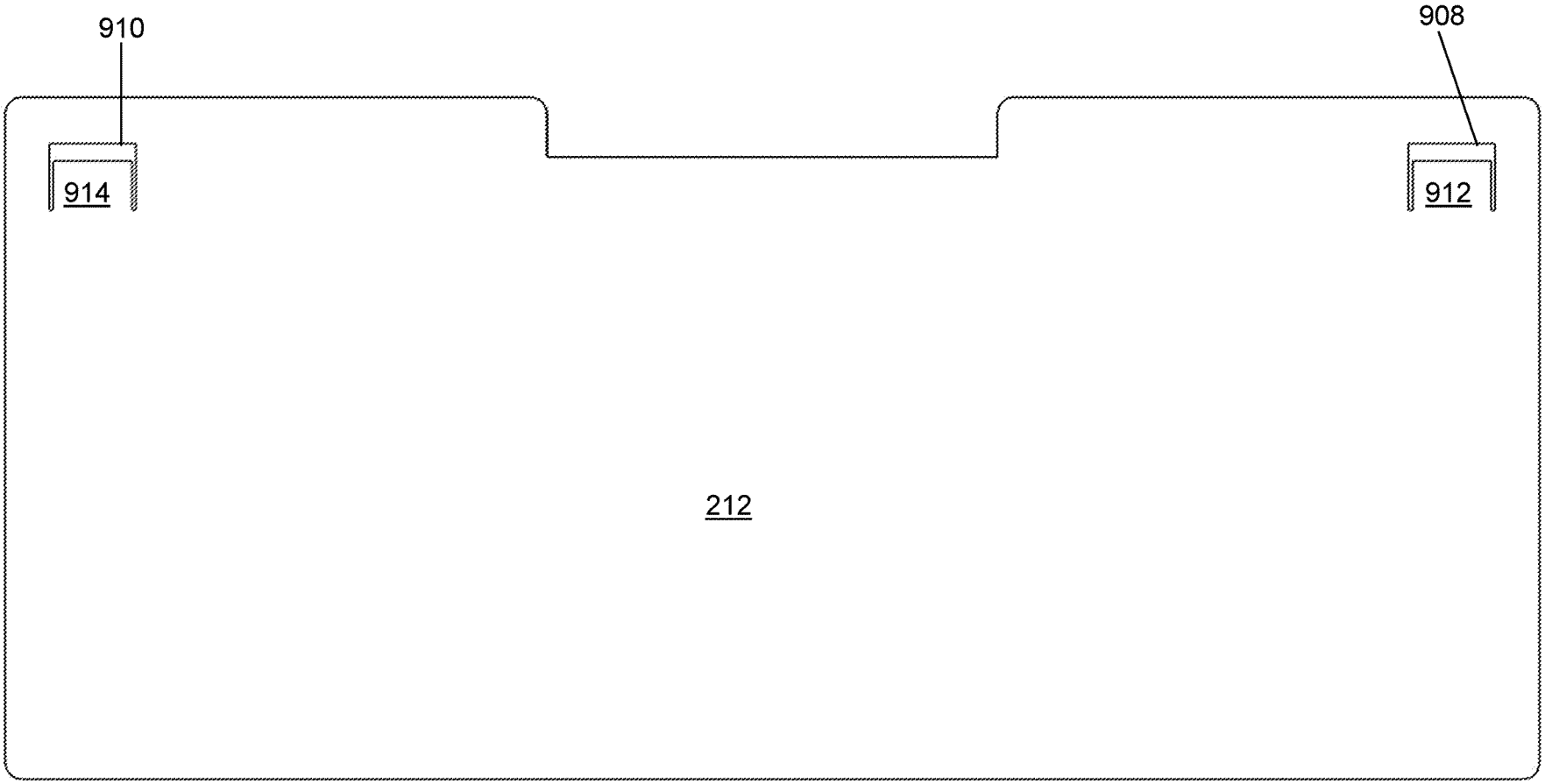
FIG. 12B depicts a front view of the ice stop of FIG. 12A in accordance with an illustrative embodiment.

Referring to FIG. 11, a zoomed left, front perspective view of right mounting hook 916 is shown in accordance with an illustrative embodiment. Right mounting hook 916 and left mounting hook 918 have a similar size and shape. Right mounting hook 916 and left mounting hook 918 extend outward away from support descending back wall 920 a sufficient distance to allow ice backstop 212 to hang vertically down toward the top surface of bottom wall 206 of bin 202 when mounted to right mounting hook 916 and left mounting hook 918.

Support descending back wall 920 is mounted to extend downward away from support bottom wall 922 of drawer base 400. In the illustrative embodiment, ice backstop 212 is mounted within bin 202 by inserting right mounting hook 916 through right mounting slit wall 908 and inserting left mounting hook 918 through left mounting slit wall 910. In the illustrative embodiment, right mounting hook 916 and left mounting hook 918 have a top edge 1100 that is sloped towards support descending back wall 920 to further facilitate mounting of ice backstop 212 within bin 202. Use of mounting hooks and slits allows ice backstop 212 to be easily installed and removed when needed. A greater or a fewer number of slits and mounting hooks may be used in alternative embodiments to mount ice backstop 212 within bin 202. Other mounting mechanisms may be used in alternative embodiments to mount ice backstop 212 within bin 202 in the selected location relative to curtain fingers 422. For example, a screw, a rivet, adhesive, etc. may be used in alternative embodiments. ice backstop 212 further may be mounted to extend vertically downward from other components of ice maker assembly 100 such as downward from an interior surface of top wall 108.

Drawer base 400 may include a support right sidewall 924, a support front wall 926, a support left sidewall 928, support bottom wall 922, support descending back wall 920, a right mounting arm 932, and a left mounting arm 934. A finger depression wall 930 may be formed in support bottom wall 922 to facilitate insertion of a finger of a user to grab drawer 404 and pull drawer 404 away from support front wall 926. Right mounting arm 932 has an L-shape and extends upward away from a top edge of support right sidewall 924. Left mounting arm 934 has an L-shape and extends upward away from a top edge of support left sidewall 928. A first fastener may be inserted through a top tab of right mounting arm 932, and a second fastener may be inserted through a top tab of left mounting arm 934 to mount drawer base 400 to the interior surface of top wall 108. Other mounting mechanisms may be used in alternative embodiments to fixedly mount drawer base 400 to ice maker assembly 100 in an orientation to allow withdrawal of drawer 404 from drawer base 400. In the illustrative embodiment, support front wall 926 is split into a right portion and a left portion to define an aperture within which drawer 404 is slid.

Figure 13A:
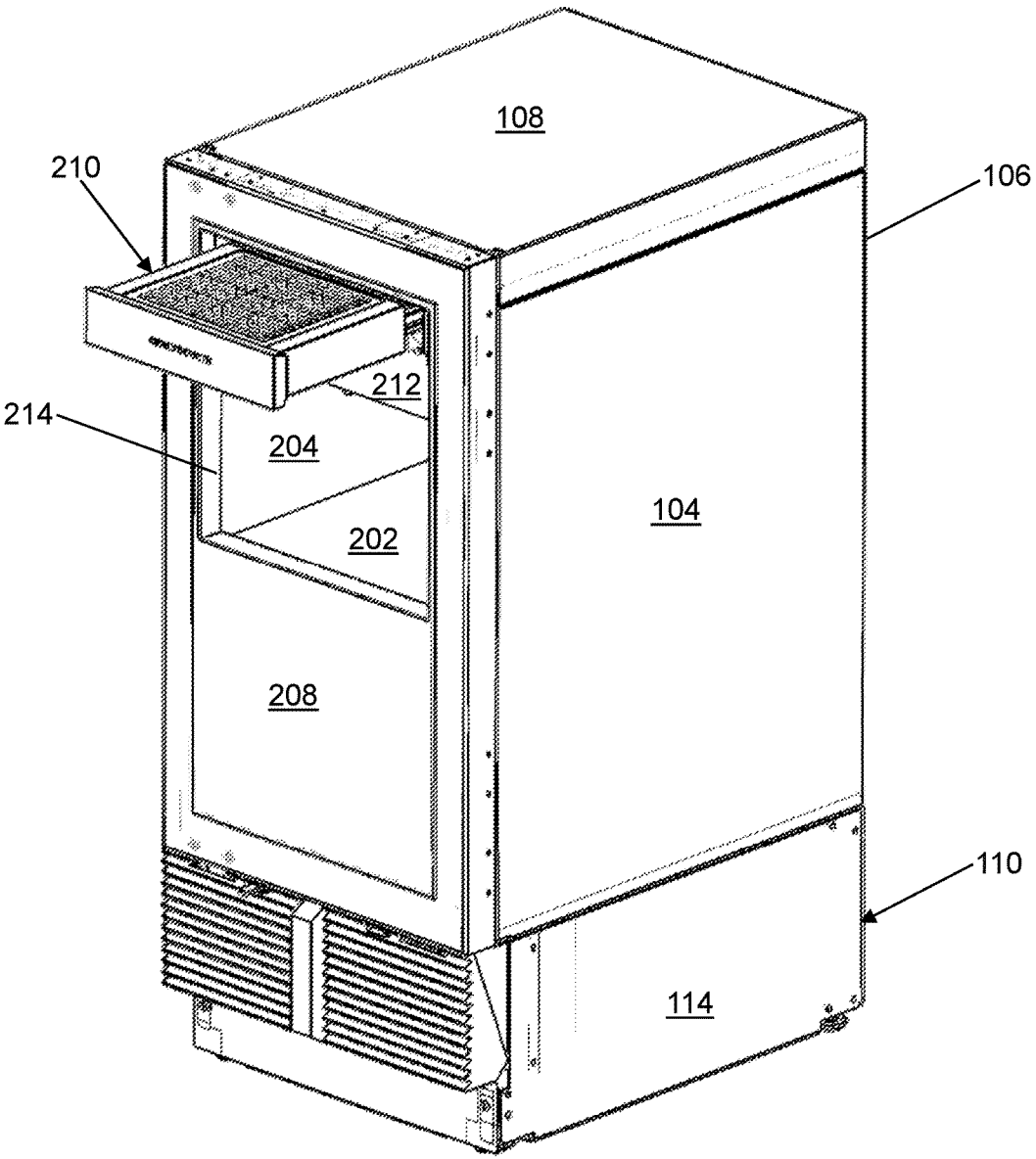
FIG. 13A depicts a right, front perspective view of the ice maker assembly of FIG. 2A with the cleaning fluid drawer in a fully open position in accordance with an illustrative embodiment.
Figure 13B:
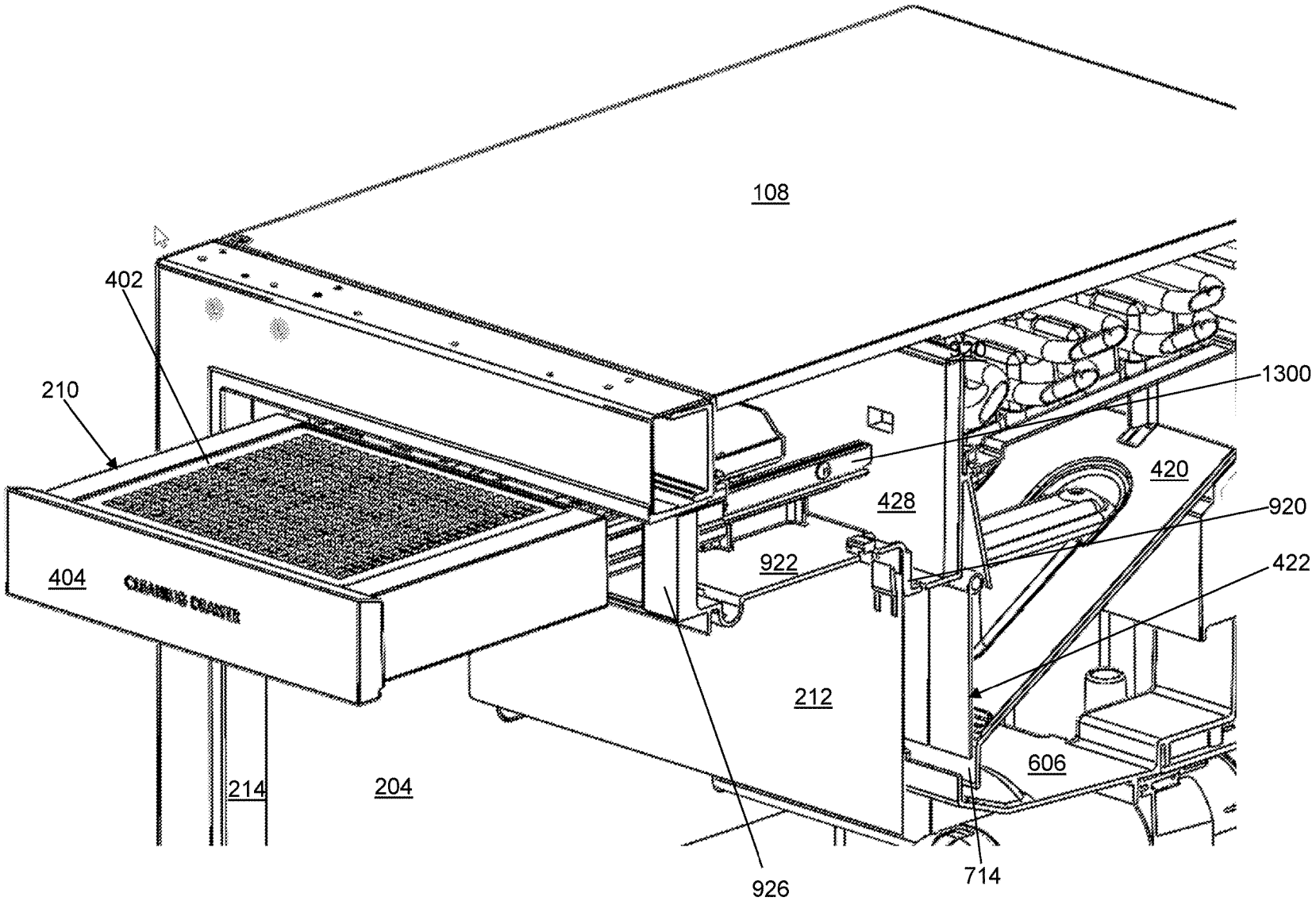
FIG. 13B depicts a right perspective cross-sectional view of the ice maker assembly of FIG. 2A with the cleaning fluid drawer in a fully open position in accordance with an illustrative embodiment.
Figure 13C:
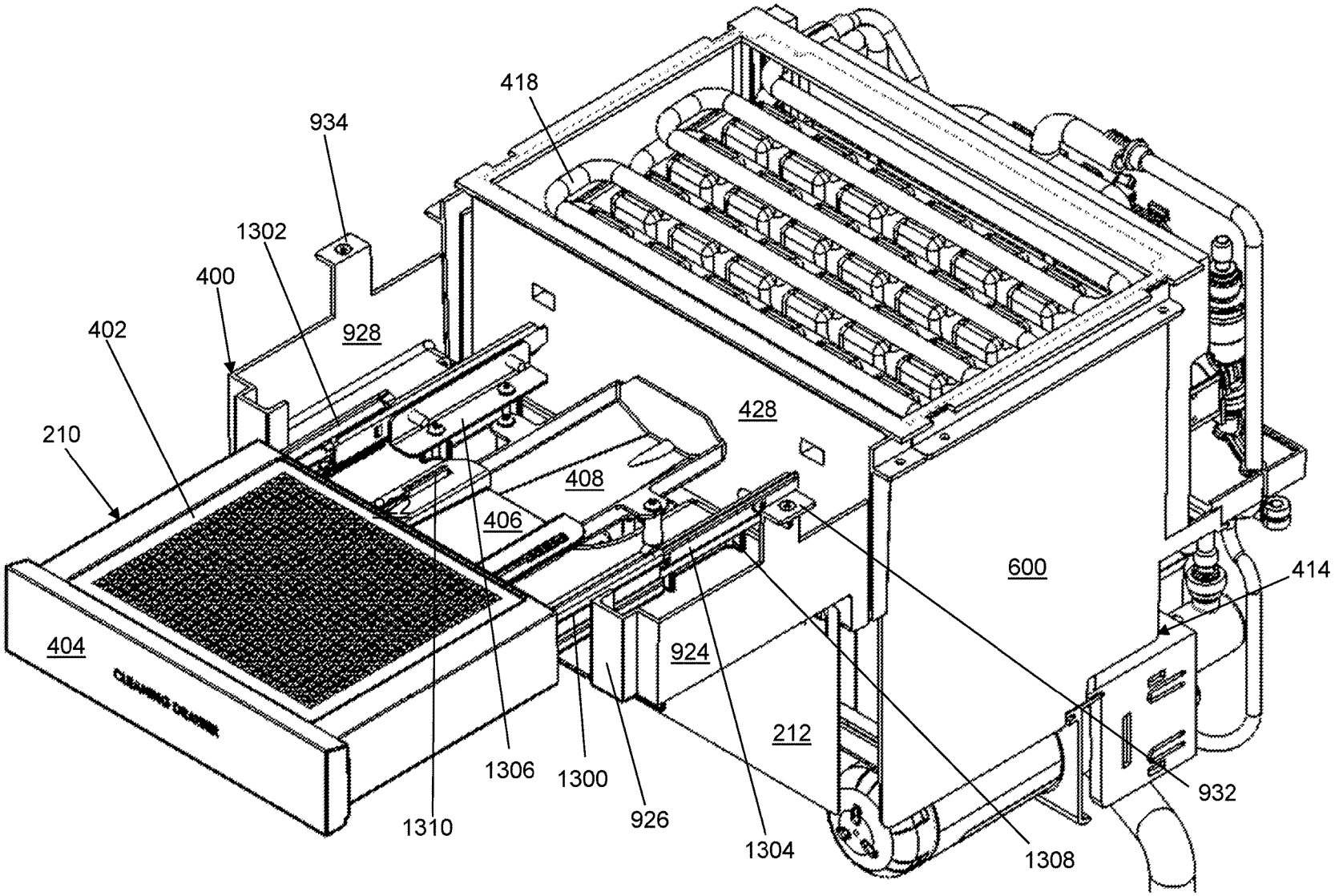
FIG. 13C depicts a right, front perspective view of the cleaning fluid drawer and the ice maker of FIG. 5 with the cleaning fluid drawer in the fully open position in accordance with an illustrative embodiment.
Figure 13D:
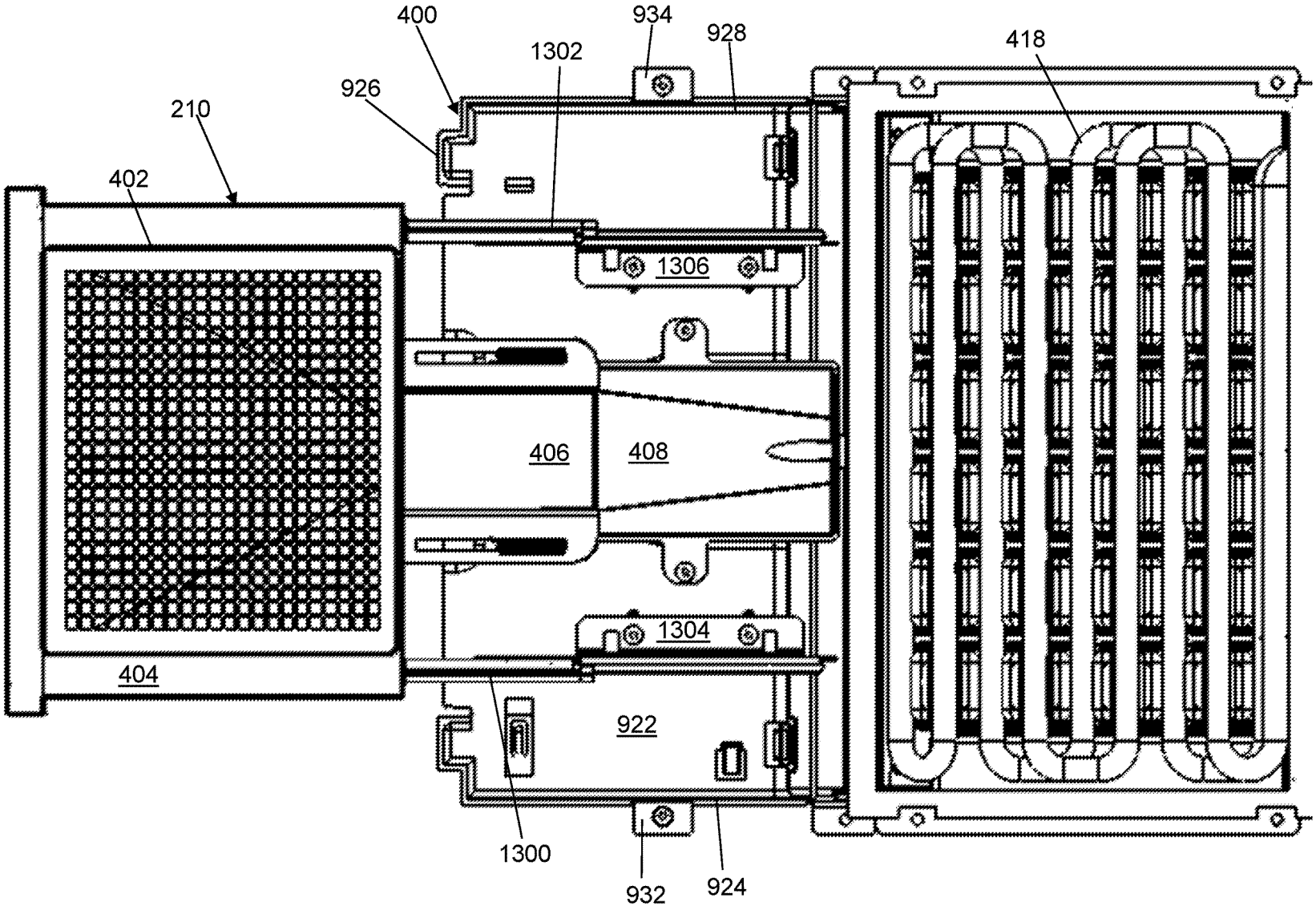
FIG. 13D depicts a top view of the cleaning fluid drawer and the ice maker of FIG. 13C with the cleaning fluid drawer in the fully open position in accordance with an illustrative embodiment.
Figure 13E:
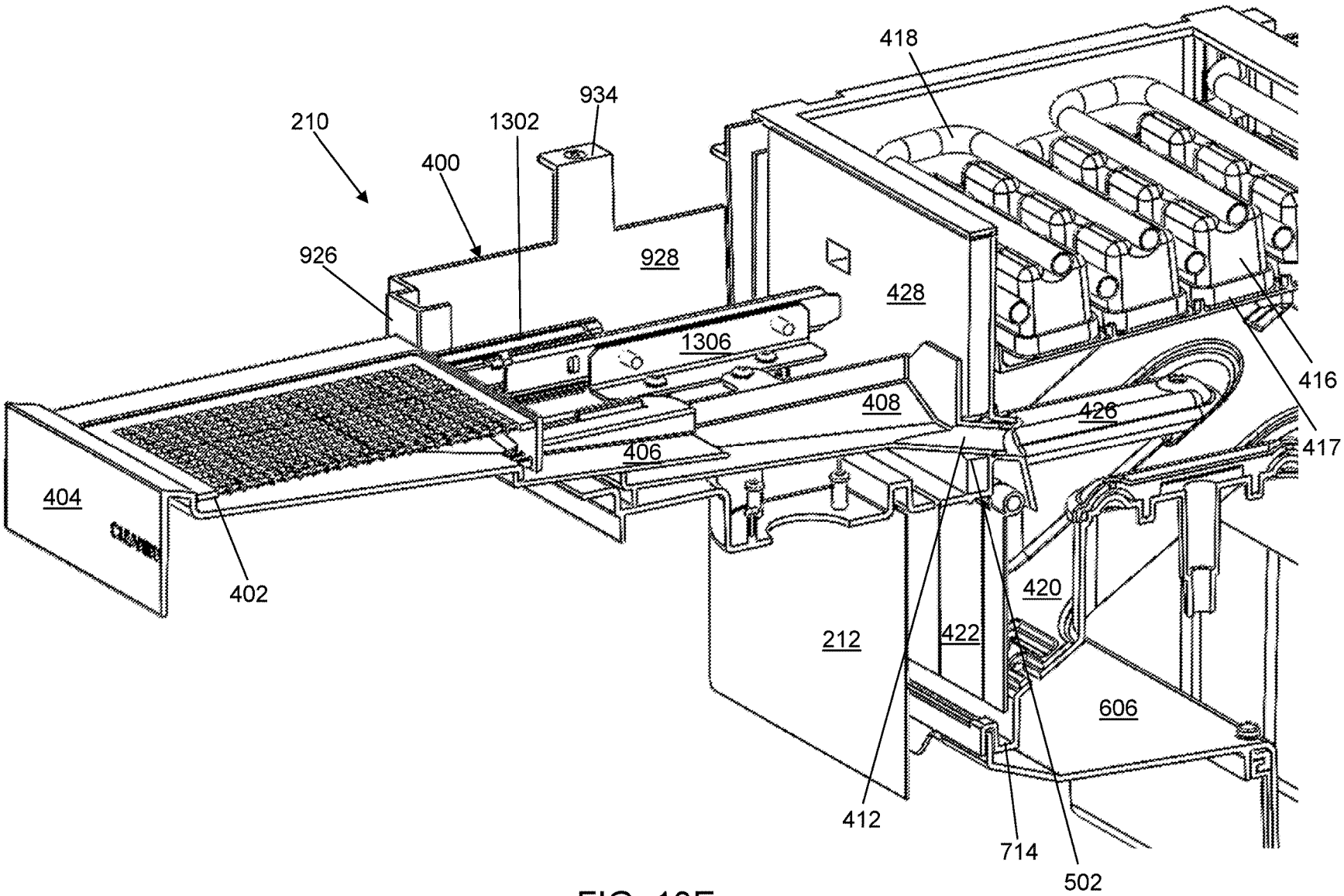
FIG. 13E depicts a right perspective cross-sectional view of the cleaning fluid drawer and the ice maker of FIG. 13C with the cleaning fluid drawer in the fully open position in accordance with an illustrative embodiment.
Figure 13F:
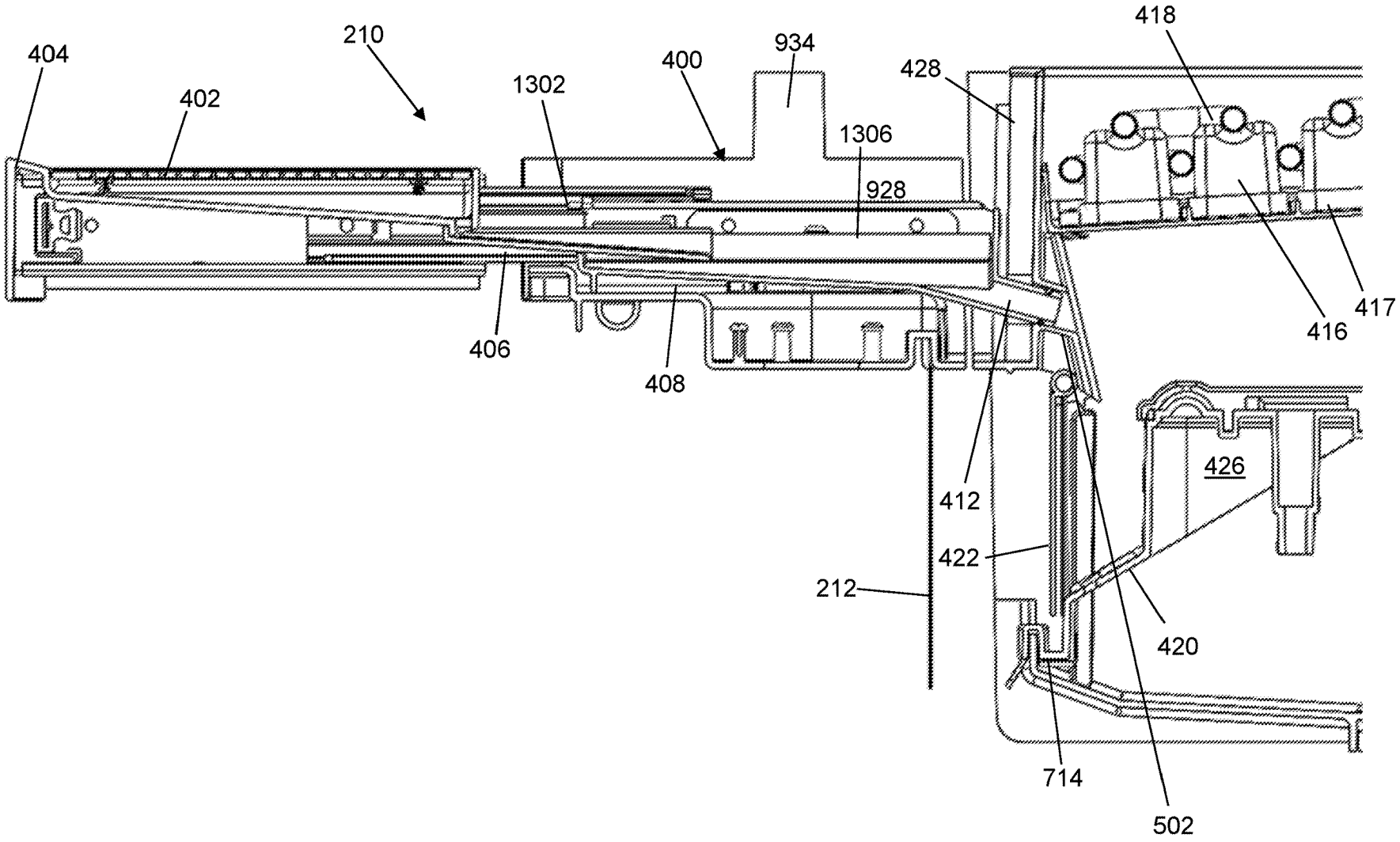
FIG. 13F depicts a right-side cross-sectional view of the cleaning fluid drawer and the ice maker of FIG. 13C with the cleaning fluid drawer in the fully open position in accordance with an illustrative embodiment.

Referring to FIG. 13A, a right, front perspective view of ice maker assembly 100 with cleaning fluid drawer 210 in a fully open position is shown in accordance with an illustrative embodiment. Referring to FIG. 13B, a right perspective cross-sectional view of ice maker assembly 100 with cleaning fluid drawer 210 in the fully open position is shown in accordance with an illustrative embodiment. Referring to FIG. 13C, a right, front perspective view of cleaning fluid drawer 210 and ice maker 200 with cleaning fluid drawer 210 in the fully open position is shown in accordance with an illustrative embodiment. Referring to FIG. 13D, a top view of cleaning fluid drawer 210 and ice maker 200 with cleaning fluid drawer 210 in the fully open position is shown in accordance with an illustrative embodiment. Referring to FIG. 13E, a right perspective cross-sectional view of cleaning fluid drawer 210 and ice maker 200 with cleaning fluid drawer 210 in the fully open position is shown in accordance with an illustrative embodiment. Referring to FIG. 13F, a right-side cross-sectional view of cleaning fluid drawer 210 and ice maker 200 with cleaning fluid drawer 210 in the fully open position is shown in accordance with an illustrative embodiment.

Cleaning fluid drawer 210 can be opened by inserting one or more fingers into finger depression wall 930 and pulling cleaning fluid drawer away from drawer base 400. In the illustrative embodiment, cleaning fluid drawer 210 is slid outward using a right slide 1300 and a left slide 1302 mounted to an inner surface of a right side of drawer 404 and an inner surface of a left side of drawer 404, respectively. Other sliding mechanisms may be used in alternative embodiments. For example, cleaning fluid drawer 210 may be slid outward using a track formed on or in support bottom wall 922.

Right slide 1300 is mounted to a right slide mounting brace 1304, and left slide 1302 is mounted to a left slide mounting brace 1306. Right slide mounting brace 1304 is mounted to a right support platform 1308 that is mounted to support bottom wall 922. Left slide mounting brace 1306 is mounted to a left support platform 1310 that is mounted to support bottom wall 922. In the illustrative embodiments, fasteners are used to mount the slides to a respective slide mounting brace and to mount the slide mounting braces to a respective support platform though other mounting mechanisms may be used in alternative embodiments.

Figure 14A:
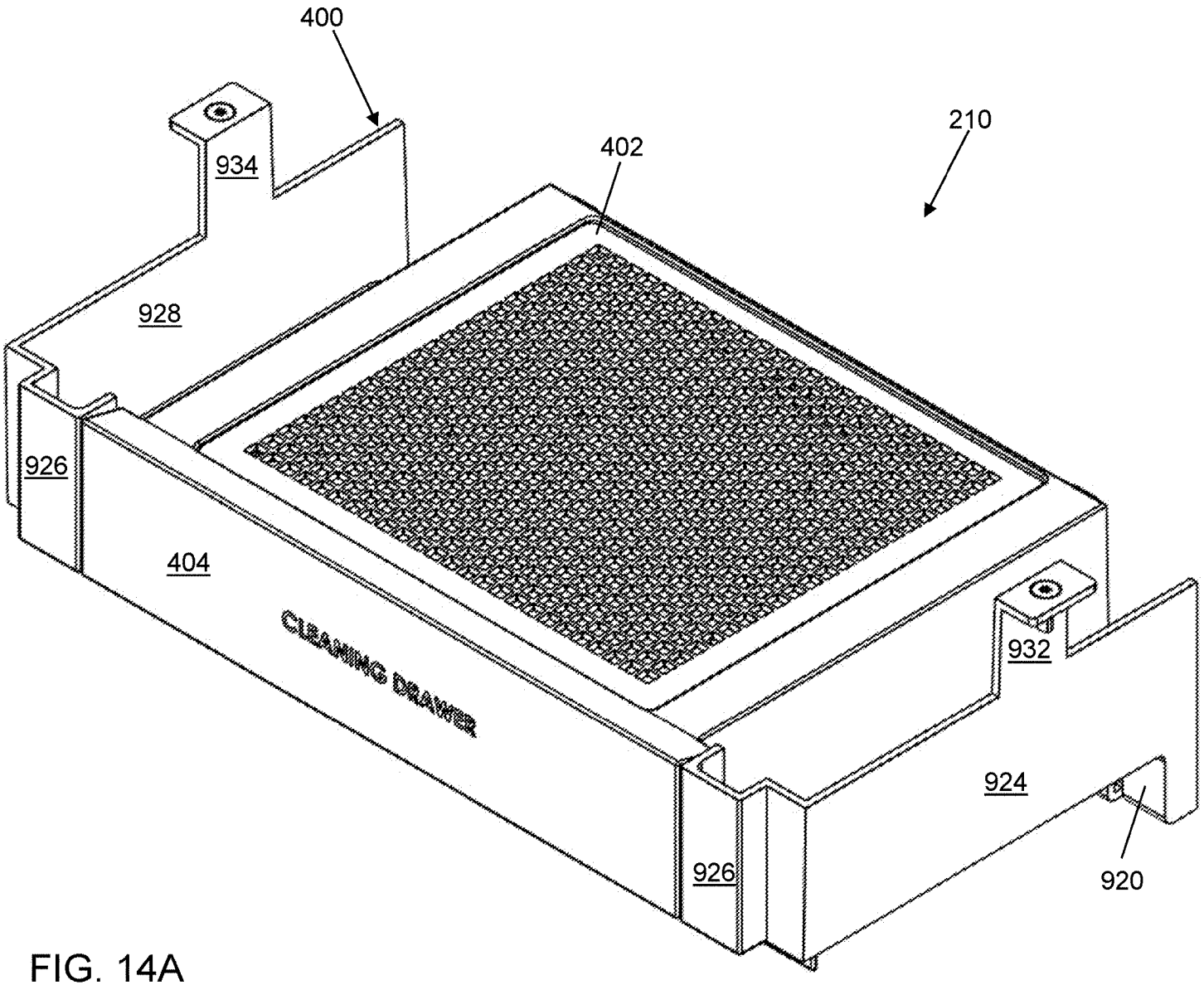
FIG. 14A depicts a right, front perspective view of the cleaning fluid drawer of FIG. 5 in accordance with an illustrative embodiment.
Figure 14B:
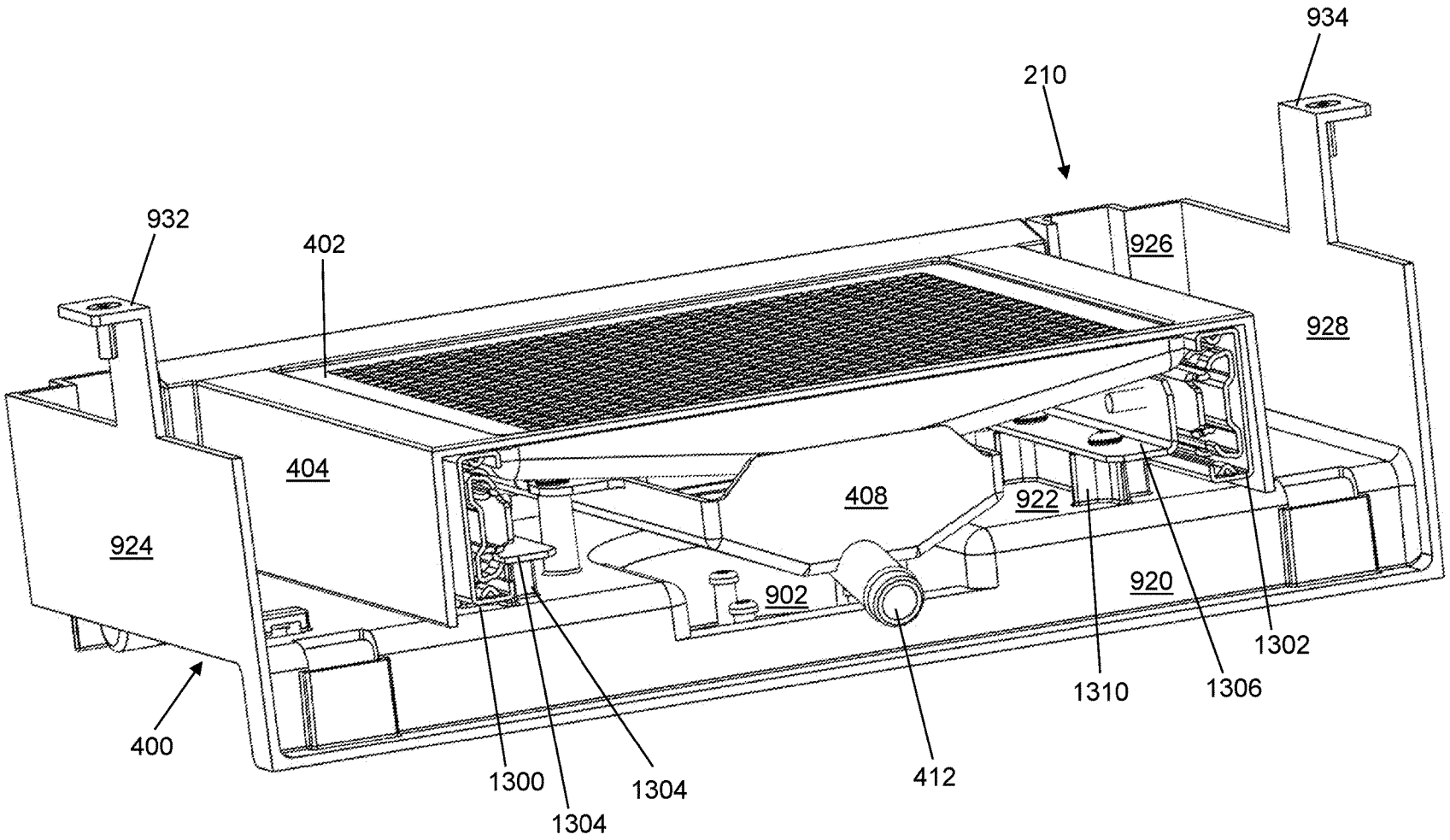
FIG. 14B depicts a right, back perspective view of the cleaning fluid drawer of FIG. 14A in accordance with an illustrative embodiment.
Figure 15:
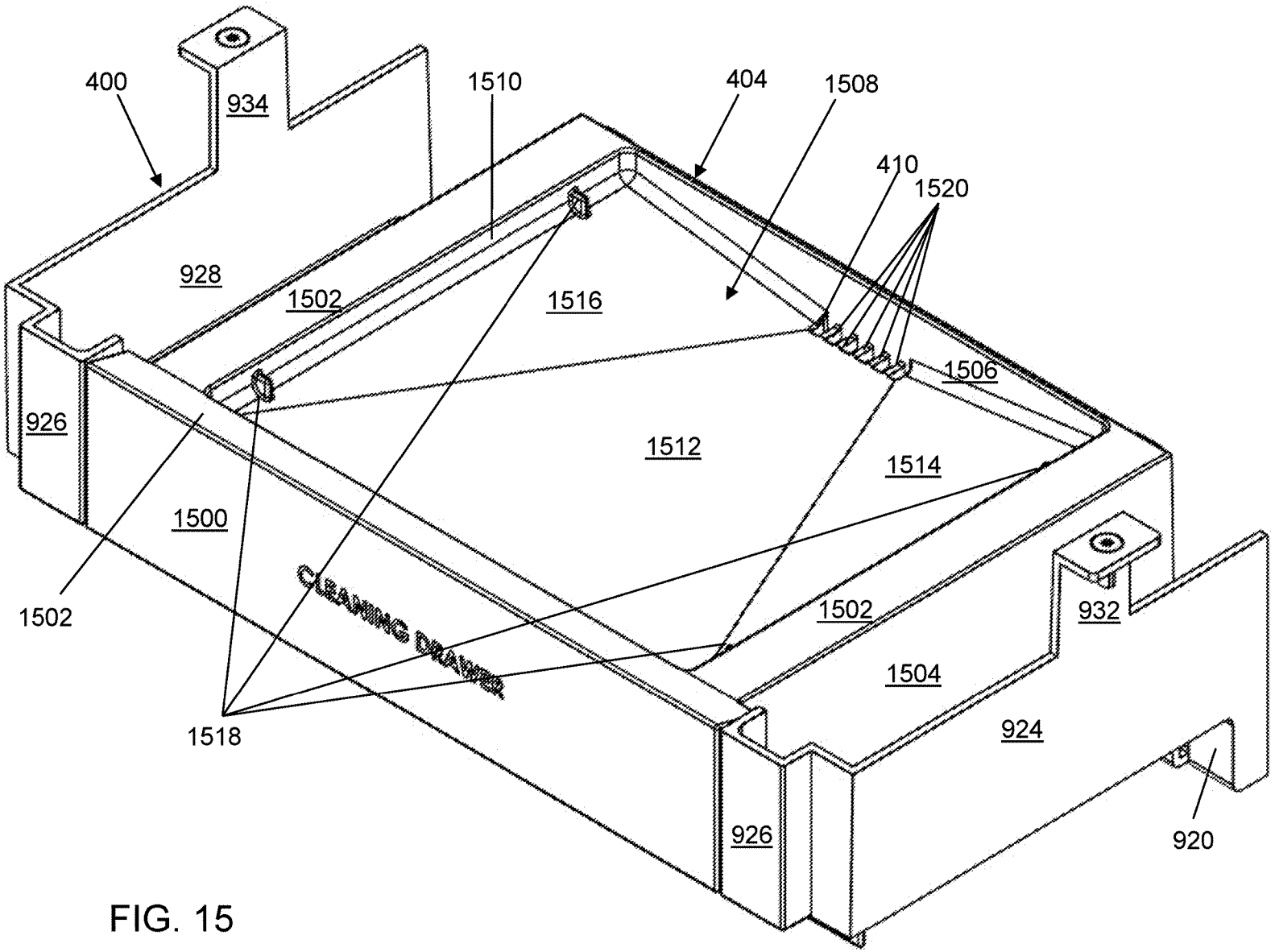
FIG. 15 depicts a right, front perspective view of the cleaning fluid drawer of FIG. 14A with a splash guard tray removed in accordance with an illustrative embodiment.

Referring to FIG. 14A, a right, front perspective view of cleaning fluid drawer 210 is shown in accordance with an illustrative embodiment. Referring to FIG. 14B, a right, back perspective view of cleaning fluid drawer 210 is shown in accordance with an illustrative embodiment. Referring to FIG. 15, a right, front perspective view of cleaning fluid drawer 210 with splash guard tray 402 removed is shown in accordance with an illustrative embodiment.

Drawer 404 may include a drawer front wall 1500, a drawer top wall 1502, a drawer right sidewall 1504, a drawer back wall 1506, a drawer left sidewall 2000 (shown referring to FIG. 20), and a drawer bottom wall 1508. Drawer 404 includes a drawer receptacle defined by a right receptacle wall 2002 (shown referring to FIG. 20), drawer back wall 1506, a left receptacle wall 1510, a front receptacle wall 1800 (shown referring to FIG. 20), and drawer bottom wall 1508. Right receptacle wall 2002 extends downward from an interior right edge of drawer top wall 1502 between drawer top wall 1502 and a right edge of drawer bottom wall 1508, and left receptacle wall 1510 extends downward from an interior left edge of drawer top wall 1502 between drawer top wall 1502 and a left edge of drawer bottom wall 1508. Front receptacle wall 2004 extends downward from an interior front edge of drawer top wall 1502 between drawer top wall 1502 and a front edge of drawer bottom wall 1508.

Drawer bottom wall 1508 is sloped to form a funnel that directs fluid poured into the drawer receptacle toward top drawer drain 410 formed in drawer bottom wall 1508. In the illustrative embodiment, top drawer drain 410 is located approximately in a center of drawer back wall 1506 though top drawer drain 410 may be positioned in other locations as long as drawer bottom wall 1508 is sloped to form the funnel that directs the fluid toward top drawer drain 410. A size of the drawer receptacle and of top drawer drain 410 may be selected to accommodate an expected pour rate for the fluid to avoid spilling of the fluid outside of the drawer receptacle. A distance that drawer 404 can be withdrawn from drawer base 400 also may be selected to provide a sufficient area for the fluid to be poured into the drawer receptacle without spillage.

In the illustrative embodiment with top drawer drain 410 located approximately in the center of drawer back wall 1506, drawer bottom wall 1508 includes a center funnel floor 1512, a right funnel floor 1514, and a left funnel floor 1516. Center funnel floor 1512 is sloped toward top drawer drain 410. Right funnel floor 1514 is sloped toward center funnel floor 1512. Left funnel floor 1516 is sloped toward center funnel floor 1512. In the illustrative embodiment, top drawer drain 410 includes a plurality of grate walls 1520 though in an alternative embodiment, top drawer drain 410 may simply be an aperture formed through drawer bottom wall 1508.

A plurality of support feet 1518 are formed between right receptacle wall 2002 and right funnel floor 1514 and between left receptacle wall 1510 and left funnel floor 1516. Splash guard tray 402 may be mounted to drawer 404 by placing sides of splash guard tray 402 on a top surface of the plurality of support feet 1518 so that splash guard tray 402 is positioned above drawer bottom wall 1508.

Figure 16:
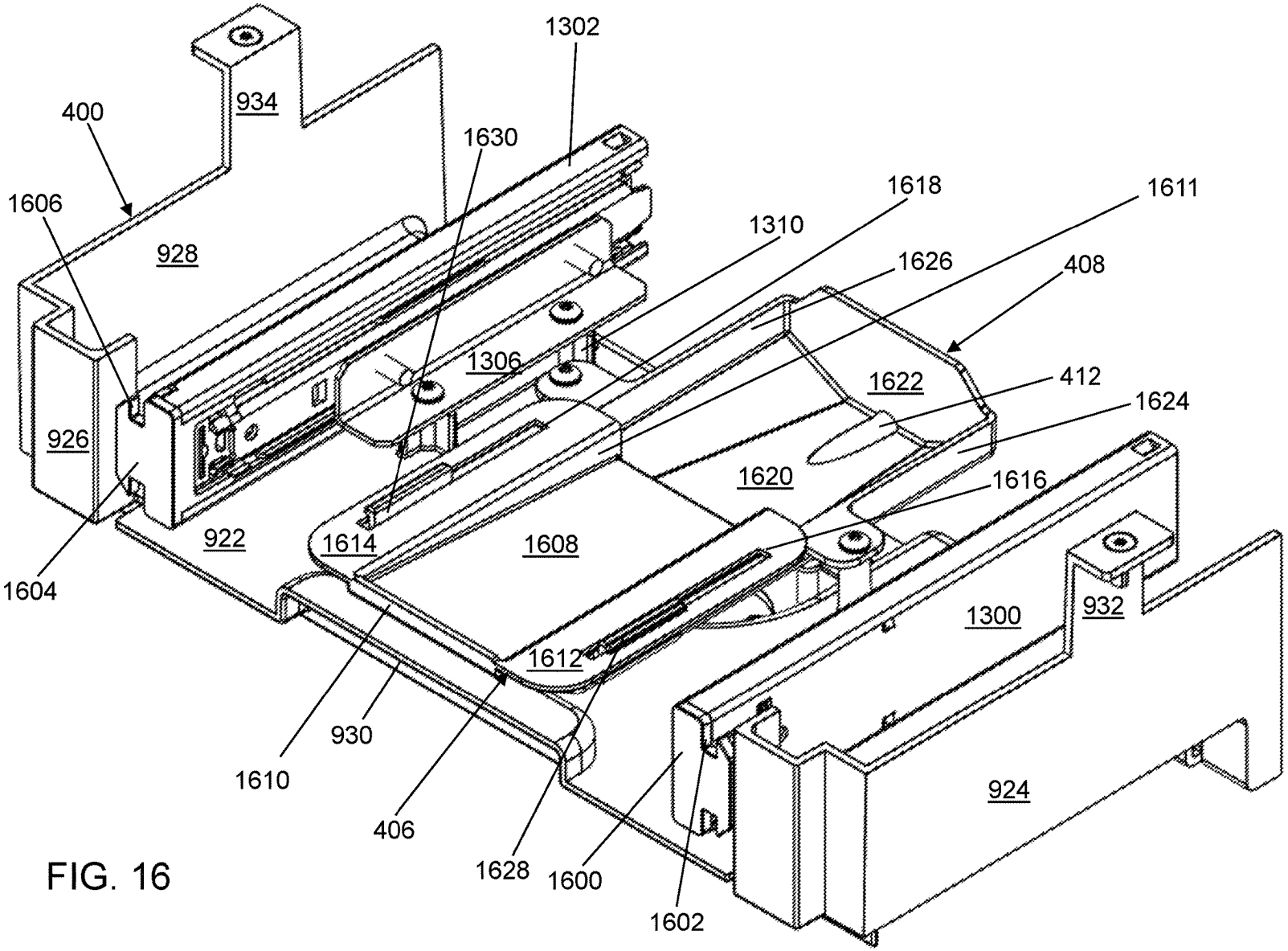
FIG. 16 depicts a right, front perspective view of the cleaning fluid drawer of FIG. 14A with the splash guard tray and a drawer removed in accordance with an illustrative embodiment.

Referring to FIG. 16, a right, front perspective view of cleaning fluid drawer 210 with splash guard tray 402 and drawer 404 removed is shown in accordance with an illustrative embodiment. Transition tray 406 may include a transition tray bottom wall 1608, a transition tray front wall 1610, a transition tray right sidewall 2100 (shown referring to FIG. 21B), a transition tray left sidewall 1611, a transition tray right top wall 1612, a transition tray left top wall 1614, a right slide aperture wall 1616, and a left slide aperture wall 1618. Transition tray front wall 1610 extends upward from a front edge of transition tray bottom wall 1608. Transition tray right sidewall 2100 extends upward from a right edge of transition tray bottom wall 1608. Transition tray left sidewall 1611 extends upward from a left edge of transition tray bottom wall 1608. Transition tray right top wall 1612 extends outward from a top edge of transition tray right sidewall 2100. Transition tray left top wall 1614 extends outward from a top edge of transition tray left sidewall 1611. Transition tray bottom wall 1608 slopes downward from the front edge of transition tray bottom wall 1608 to a back edge of transition tray bottom wall 1608. Right slide aperture wall 1616 is formed as a slit through transition tray right top wall 1612. Left slide aperture wall 1618 is formed as a slit through transition tray left top wall 1614. Right slide aperture wall and eft slide aperture wall 1618 are formed to define a sliding path for transition tray 406.

Figure 17A:
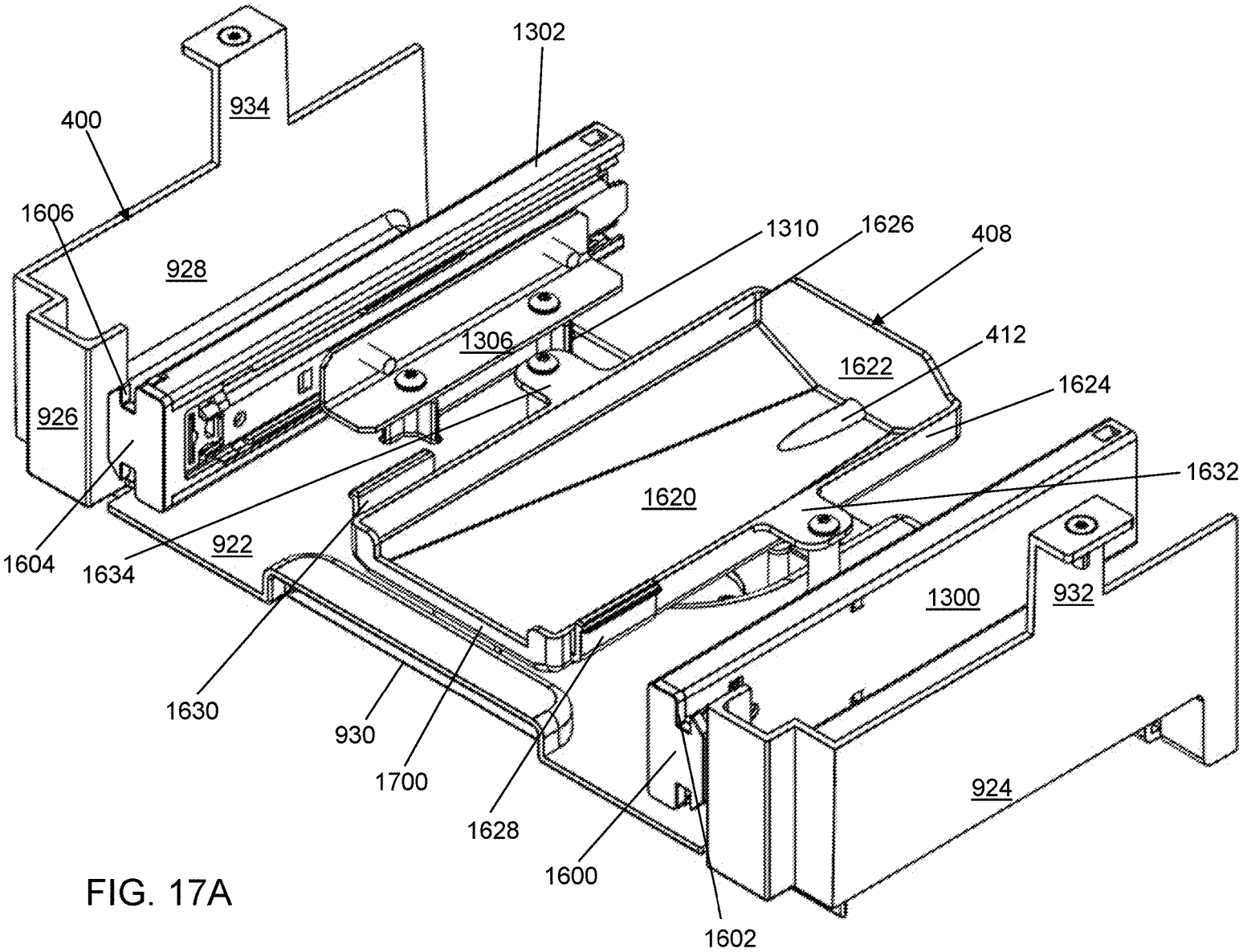
FIG. 17A depicts a right, front perspective view of the cleaning fluid drawer of FIG. 14A with the splash guard tray, the drawer, and a transition tray removed in accordance with an illustrative embodiment.
Figure 17B:
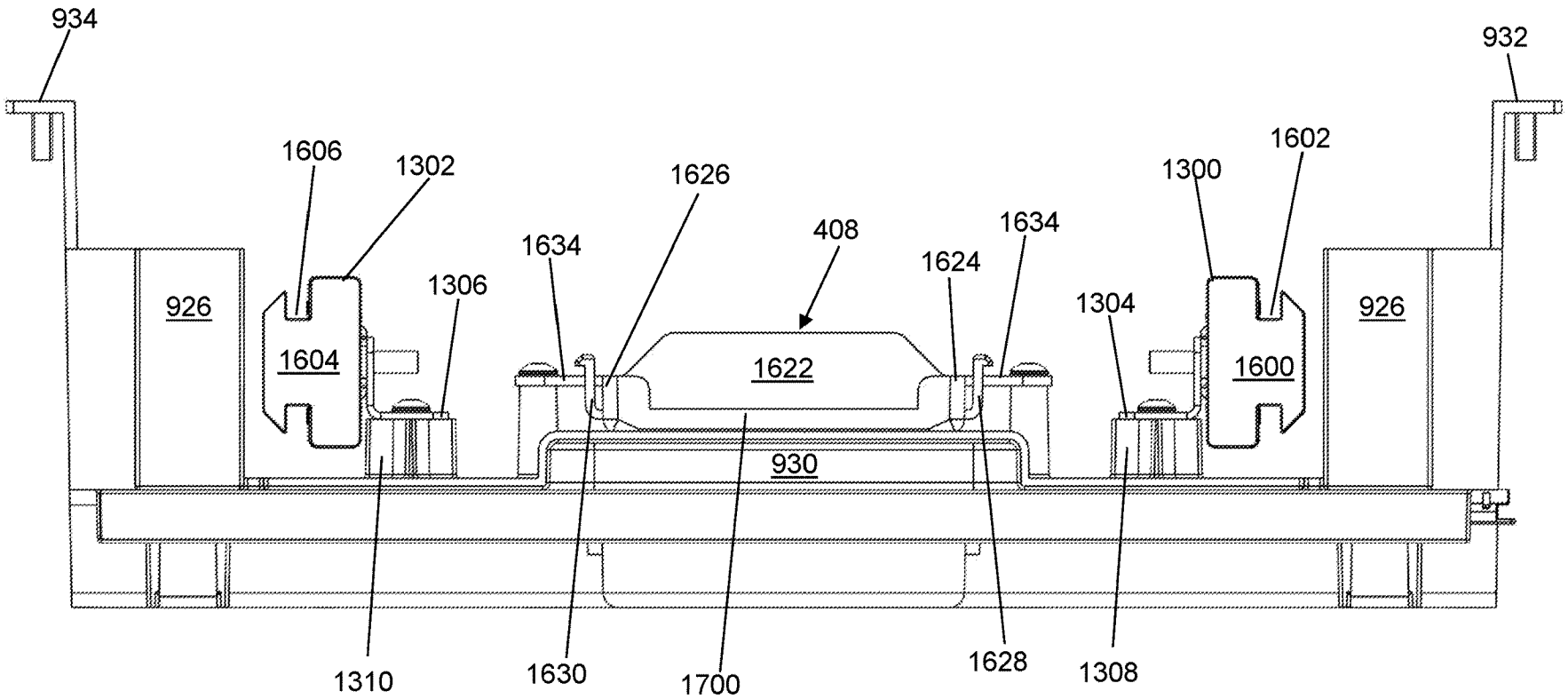
FIG. 17B depicts a front view of the cleaning fluid drawer of FIG. 17A in accordance with an illustrative embodiment.

Referring to FIG. 17A, a right, front perspective view of cleaning fluid drawer 210 with splash guard tray 402, drawer 404, and transition tray 406 removed is shown in accordance with an illustrative embodiment. Referring to FIG. 17B, a front view of cleaning fluid drawer 210 is shown in accordance with an illustrative embodiment. Right slide 1300 includes a first front face 1600 that includes a first upward facing channel 1602. Left slide 1302 includes a second front face 1604 that includes a second upward facing channel 1606.

Bottom tray 408 may include a bottom tray bottom wall 1620, a bottom tray back wall 1622, a bottom tray front wall 1700, a bottom tray right sidewall 1624, a bottom tray left sidewall 1626, a right mating tab 1628, a left mating tab 1630, a right mounting tab 1632, and a left mounting tab 1634. Bottom tray front wall 1700 extends upward from a front edge of bottom tray bottom wall 1620. Bottom tray back wall 1622 extends upward from a back edge of bottom tray bottom wall 1620. Bottom tray right sidewall 1624 extends upward from a right edge of bottom tray bottom wall 1620. Bottom tray left sidewall 1626 extends upward from a left edge of bottom tray bottom wall 1620. Bottom tray right mounting tab 1632 extends outward from a top edge of bottom tray right sidewall 1624. Bottom tray left mounting tab 1634 extends outward from a top edge of bottom tray left sidewall 1626. One or more fasteners may be used to mount right mounting tab 1632 and left mounting tab 1634 to support bottom wall 922 in an illustrative embodiment though other mounting mechanisms may be used in alternative embodiments.

Right mating tab 1628 mounts to bottom tray right sidewall 1624 and extends upward forming a hook shape. Left mating tab 1630 mounts to bottom tray right sidewall 1624 and extends upward forming the hook shape. Right mating tab 1628 and left mating tab 1630 may be used to mount transition tray 406 to bottom tray 408 as described further below.

Figure 18A:
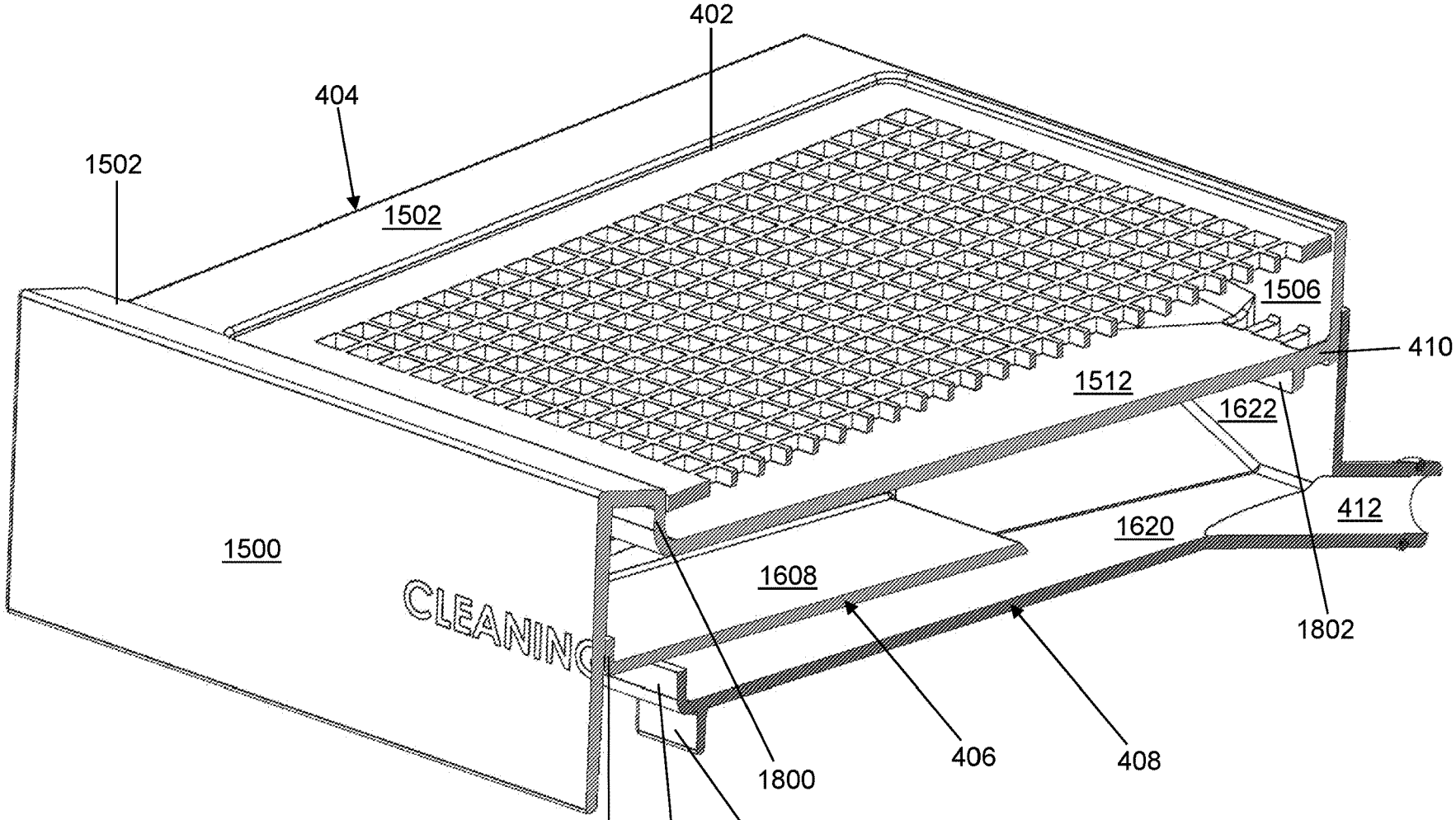
FIG. 18A depicts a right, front perspective cross-sectional view of the cleaning fluid drawer of FIG. 14A in the fully closed position in accordance with an illustrative embodiment.
Figure 18B:
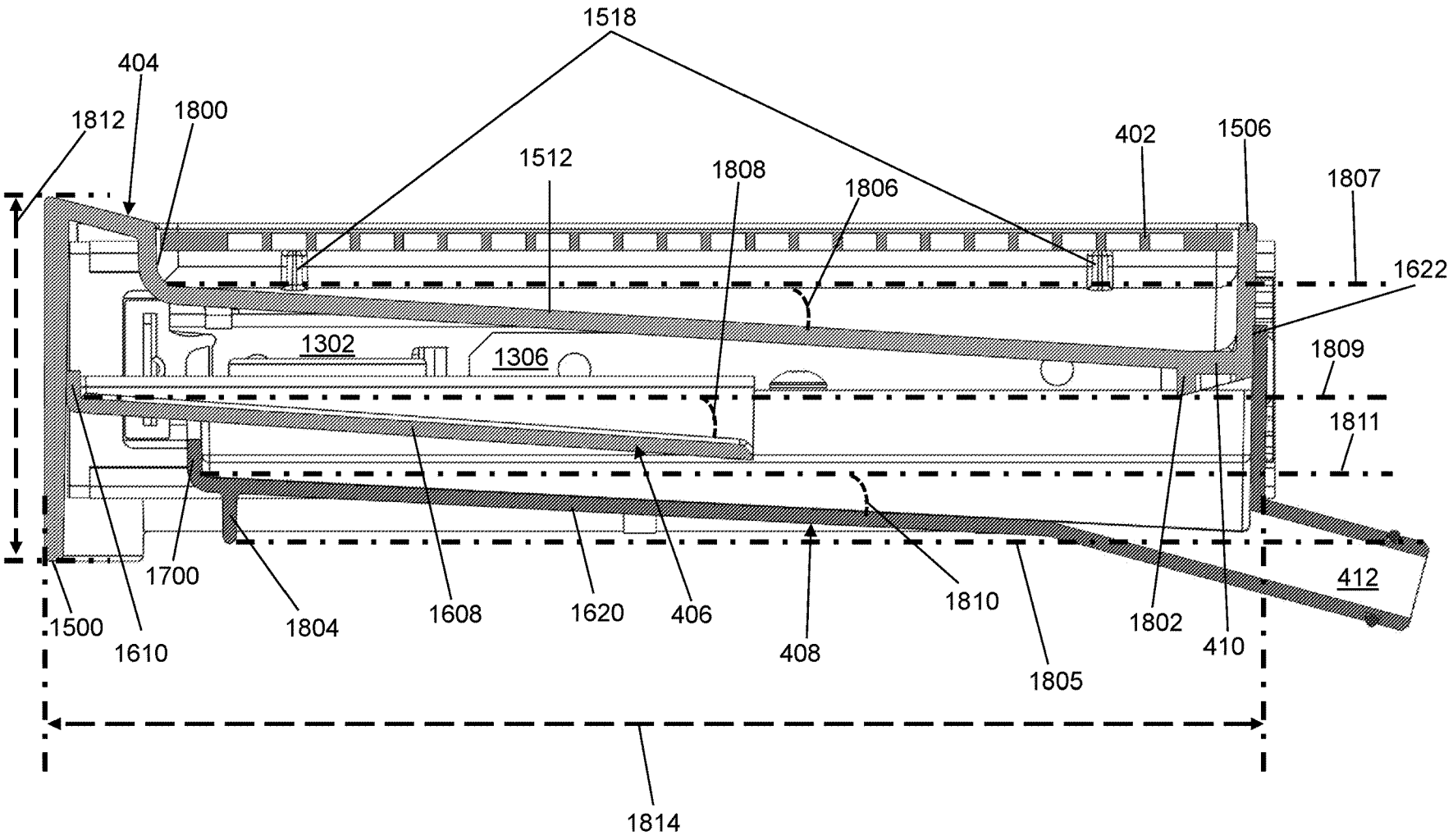
FIG. 18B depicts a right-side cross-sectional view of the cleaning fluid drawer of FIG. 18A in accordance with an illustrative embodiment.

Referring to FIG. 18A, a right, front perspective cross-sectional view of cleaning fluid drawer 210 in the fully closed position is shown in accordance with an illustrative embodiment. Referring to FIG. 18B, a right-side cross-sectional view of cleaning fluid drawer 210 in the fully closed position is shown in accordance with an illustrative embodiment. Drawer 404 further may include a stop wall 1802 that extends downward from center funnel floor 1512. Stop wall 1802 is positioned between front receptacle wall 1800 and top drawer drain 410. Bottom tray 408 further may include a support foot 1804 that extends downward from bottom tray bottom wall 1620. Support foot 1804 rests on support bottom wall 922, represented by a first horizontal plane 1805, to support a front of bottom tray 408.

Center funnel floor 1512 is sloped downward from front receptacle wall 1800 toward top drawer drain 410 at a first angle 1806 relative to a second horizontal plane 1807. Transition tray bottom wall 1608 is sloped downward from transition tray front wall 1610 toward drain tube 412 at a second angle 1808 relative to a third horizontal plane 1809. Transition tray bottom wall 1608 is sloped downward from transition tray front wall 1610 toward drain tube 412 at a third angle 1810 relative to a fourth horizontal plane 1811. First angle 1806, second angle 1808, and third angle 1810 may have the same or different values. For illustration, first angle 1806, second angle 1808, and third angle 1810 may be in the range of one to ten degrees. A minimum angle may be selected based on provision of a sufficient flow of the fluid from front to back in the illustrative embodiment. For example, the minimum angle may be based on a viscosity of the fluid. Depending on a location of cleaning fluid drawer 210 within ice maker assembly 100, the flow may not be front to back, but is downward from an exterior entry point such as drawer bottom wall 1508 to an interior exit point such as drain tube 412. A maximum angle may be selected based on a height 1812 and a depth 1814 for cleaning fluid drawer 210. For example, as the slope(s) increase a greater height 1812 is needed for a common depth 1814.

Figure 19:
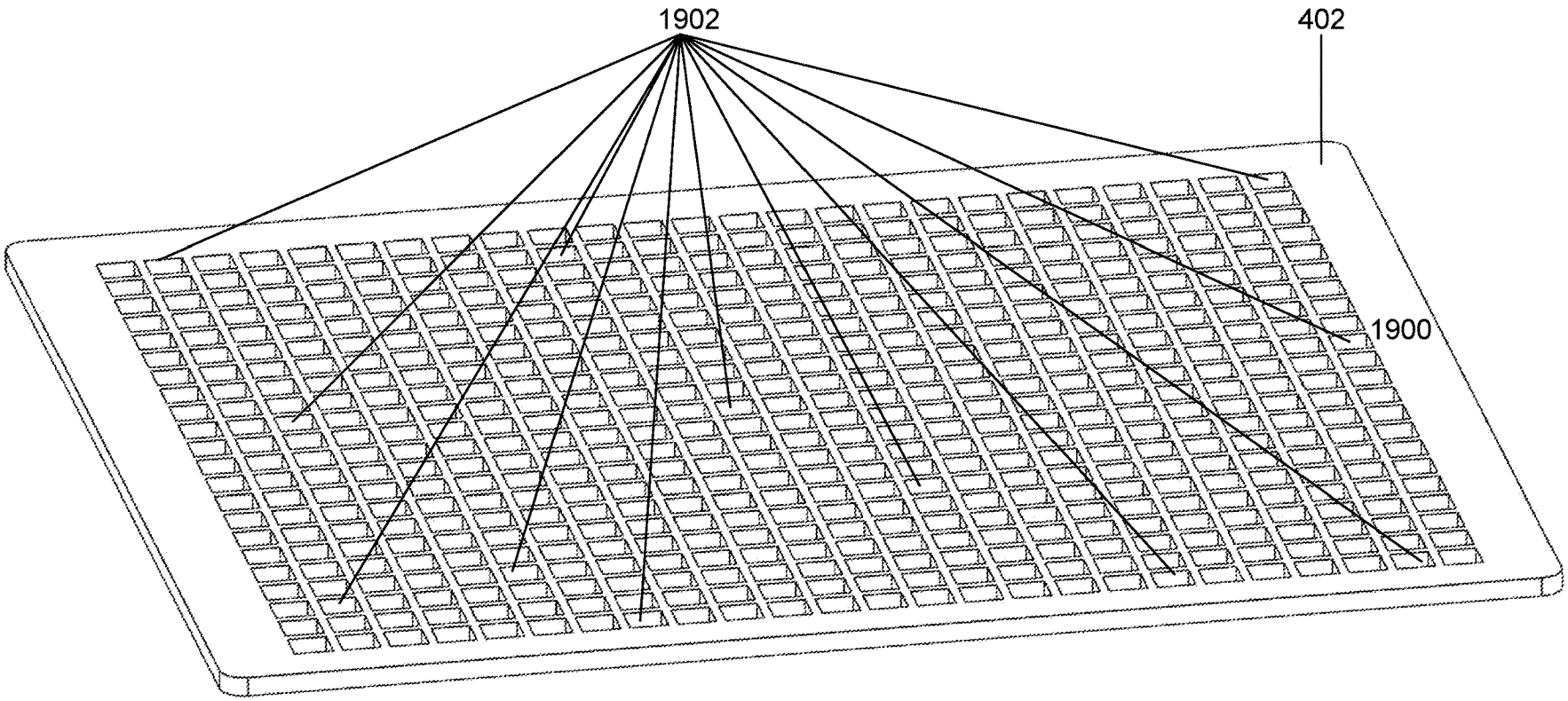
FIG. 19 depicts a right, front perspective view of the splash guard tray of FIG. 14A in accordance with an illustrative embodiment.

Referring to FIG. 19, a right, front perspective view of splash guard tray 402 is shown in accordance with an illustrative embodiment. Splash guard tray 402 is included to limit splashing of the fluid when the fluid is poured into drawer 404. Splash guard tray 402 may not be included in alternative embodiments. Splash guard tray 402 may include a plate 1900 with a grid of aperture walls 1902 formed through plate 1900. The fluid flows through apertures defined by the grid of aperture walls 1902 that block the splash from the fluid when the fluid strikes drawer bottom wall 1508. In the illustrative embodiment, plate 1900 is sized and shaped to rest on the plurality of support feet 1518 and fit within right receptacle wall 2002, drawer back wall 1506, left receptacle wall 1510, and front receptacle wall 1800 above drawer bottom wall 1508.

Figure 20A:
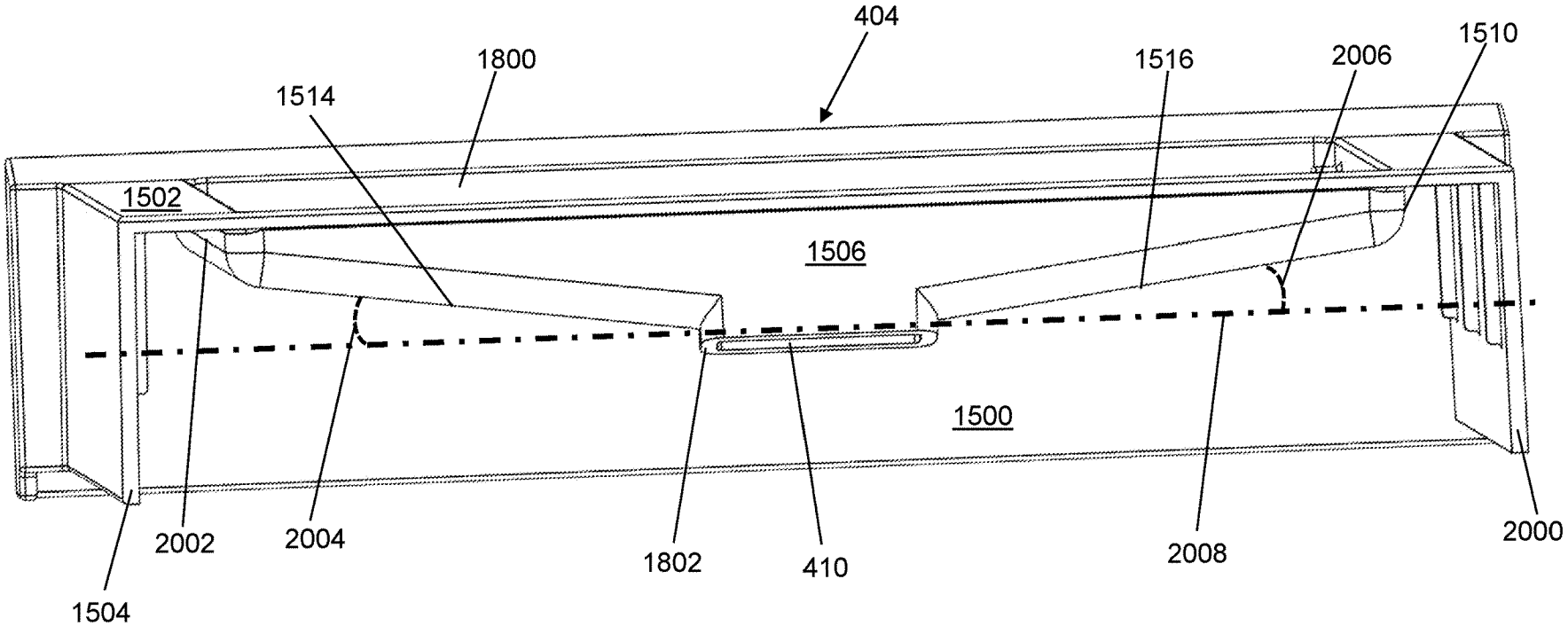
FIG. 20A depicts a right, back perspective view of the drawer of the cleaning fluid drawer of FIG. 14A in accordance with an illustrative embodiment.
Figure 20B:
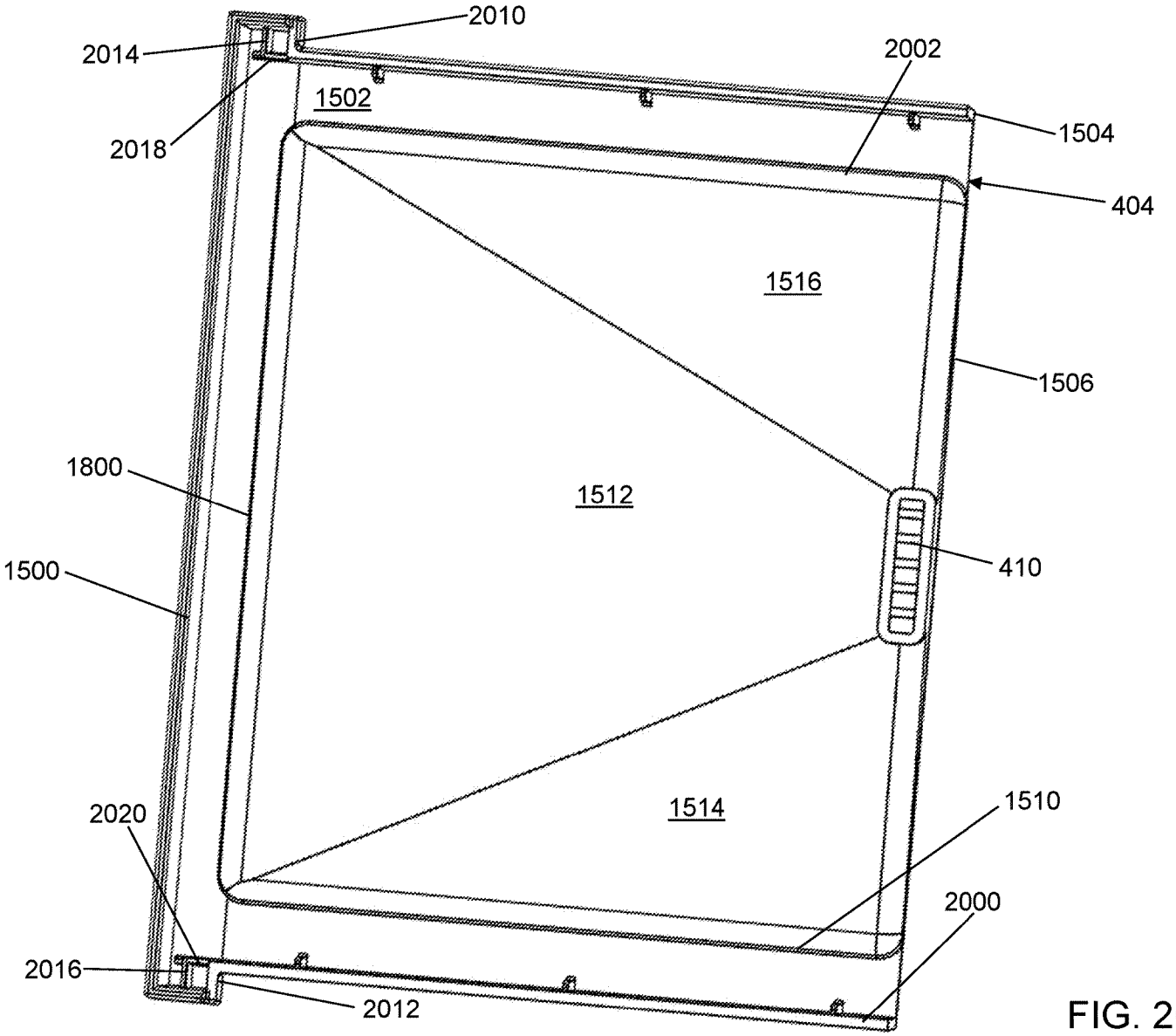
FIG. 20B depicts a bottom perspective view of the drawer of FIG. 20A in accordance with an illustrative embodiment.
Figure 20C:
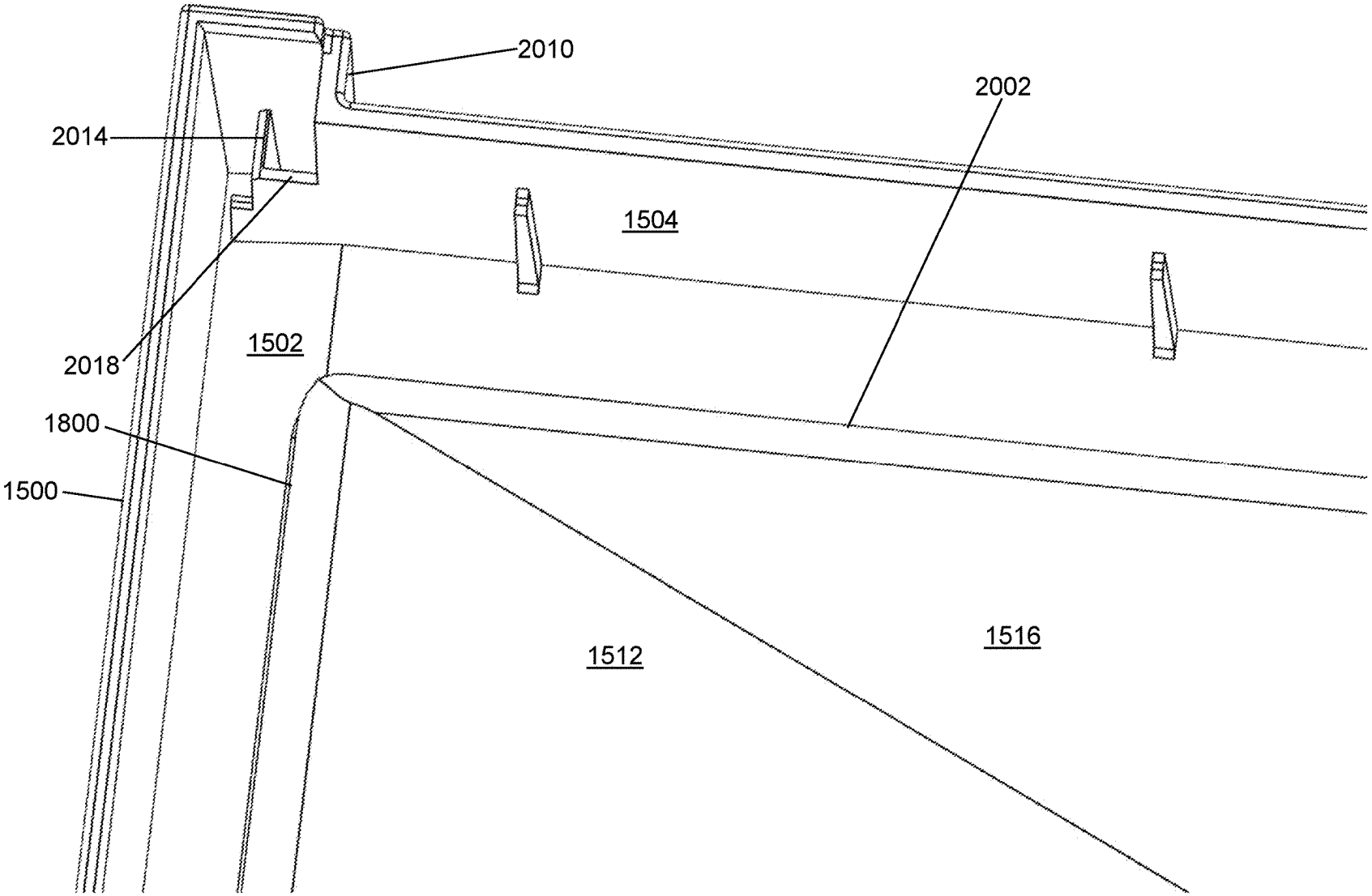
FIG. 20C depicts a zoomed bottom perspective view of the drawer of FIG. 20A in accordance with an illustrative embodiment.

Referring to FIG. 20A, a right, back perspective view of drawer 404 is shown in accordance with an illustrative embodiment. Referring to FIG. 20B, a bottom perspective view of drawer 404 is shown in accordance with an illustrative embodiment. Referring to FIG. 20C, a zoomed bottom perspective view of drawer 404 is shown in accordance with an illustrative embodiment. Right funnel floor 1514 is sloped downward from right receptacle wall 2002 toward center funnel floor 1512 at a fourth angle 2004 relative to a fifth horizontal plane 2008. Left funnel floor 1516 is sloped downward from left receptacle wall 1510 toward center funnel floor 1512 at a fifth angle 2006 relative to fifth horizontal plane 2008. First angle 1806, second angle 1808, third angle 1810, fourth angle 2004, and fifth angle 2006 may have the same or different values. For illustration, fourth angle 2004 and fifth angle 2006 may be in the range of one to ten degrees.

In the illustrative embodiment, right funnel floor 1514 is sloped toward center funnel floor 1512, and left funnel floor 1516 is sloped toward center funnel floor 1512. For illustration, center funnel floor 1512, right funnel floor 1514, and left funnel floor 1516 may have slopes of three to four degrees to provide sufficient flow of the fluid toward top drawer drain 410.

Drawer bottom wall 1508 may include a greater or a fewer number of funnel floors. For example, in the illustrative embodiment, top drawer drain 410 is positioned approximately in a center of drawer back wall 1506. Three funnel floors are included to direct the flow of the fluid toward the center of drawer back wall 1506. As an example, a single funnel floor may be used with top drawer drain 410 that extends a greater distance across drawer back wall 1506. As another example, two funnel floors may be used with top drawer drain 410 located in a corner of drawer back wall 1506. In alternative embodiments, top drawer drain 410 may be located at other locations on drawer bottom wall 1508.

In the illustrative embodiment, drawer front wall 1500 extends wider than drawer right sidewall 1504 and drawer left sidewall 2000. To align with drawer front wall 1500, drawer right sidewall 1504 includes a right protrusion wall 2010, and drawer left sidewall 2000 includes a left protrusion wall 2012. Right protrusion wall 2010 is generally parallel to drawer front wall 1500 and perpendicular to drawer right sidewall 1504 in the illustrative embodiment. Left protrusion wall 2012 is generally parallel to drawer front wall 1500 and perpendicular to drawer left sidewall 2000 in the illustrative embodiment.

In a space between right protrusion wall 2010 and drawer front wall 1500, a first right support wall 2014 is mounted to extend downward from drawer top wall 1502. First right support wall 2014 is generally parallel to drawer front wall 1500 and to right protrusion wall 2010 in the illustrative embodiment. A second right support wall 2018 is also mounted in the space between right protrusion wall 2010 and drawer front wall 1500. Second right support wall 2018 is mounted between right protrusion wall 2010 and first right support wall 2014 generally parallel to drawer right sidewall 1504 and perpendicular to first right support wall 2014 in the illustrative embodiment.

In a space between left protrusion wall 2012 and drawer front wall 1500, a first left support wall 2016 is mounted to extend downward from drawer top wall 1502. First left support wall 2016 is generally parallel to drawer front wall 1500 and to left protrusion wall 2012 in the illustrative embodiment. A second left support wall 2020 is also mounted in the space between left protrusion wall 2012 and drawer front wall 1500. Second left support wall 2020 is mounted between left protrusion wall 2012 and first left support wall 2016 generally parallel to drawer left sidewall 2000 and perpendicular to first left support wall 2016 in the illustrative embodiment.

First right support wall 2014 and second right support wall 2018 form a mirror image of first left support wall 2016 and second left support wall 2020 in the illustrative embodiment. First right support wall 2014, second right support wall 2018, first left support wall 2016, and second left support wall 2020 extend from drawer top wall 1502 a shorter distance than drawer right sidewall 1504 and drawer left sidewall 2000.

First right support wall 2014 and second right support wall 2018 form a first corner cavity, and first left support wall 2016 and second left support wall 2020 form a second corner cavity. In the illustrative embodiment, to mount drawer 404 to right slide 1300, a right corner formed by first right support wall 2014 and second right support wall 2018 is positioned within first upward facing channel 1602 of first front face 1600 of right slide 1300. First upward facing channel 1602 rests on second right support wall 2018 such that a remainder of a right portion of first front face 1600 of right slide 1300 is located within the first corner cavity. A left corner formed by first left support wall 2016 and second left support wall 2020 is positioned within second upward facing channel 1606 of second front face 1604 of left slide 1302. Second upward facing channel 1606 rests on second left support wall 2020 such that a remainder of a left portion of second front face 1604 of left slide 1302 is located within the second corner cavity. Drawer 404 may be mounted to right slide 1300 and to left slide 1302 using other mounting methods in an alternative embodiment.

Figure 21A:
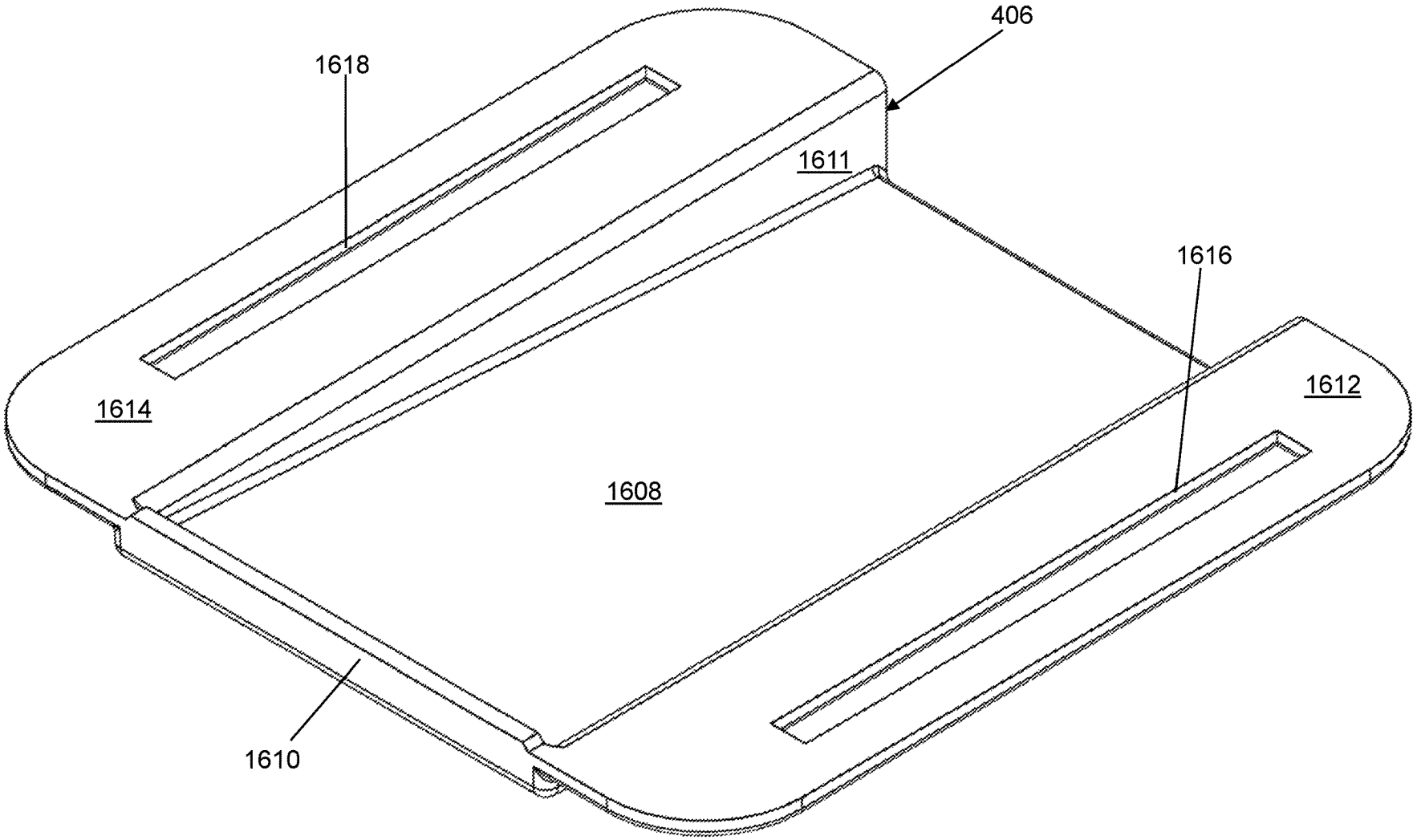
FIG. 21A depicts a right, front perspective view of the transition tray of the cleaning fluid drawer of FIG. 14A in accordance with an illustrative embodiment.
Figure 21B:
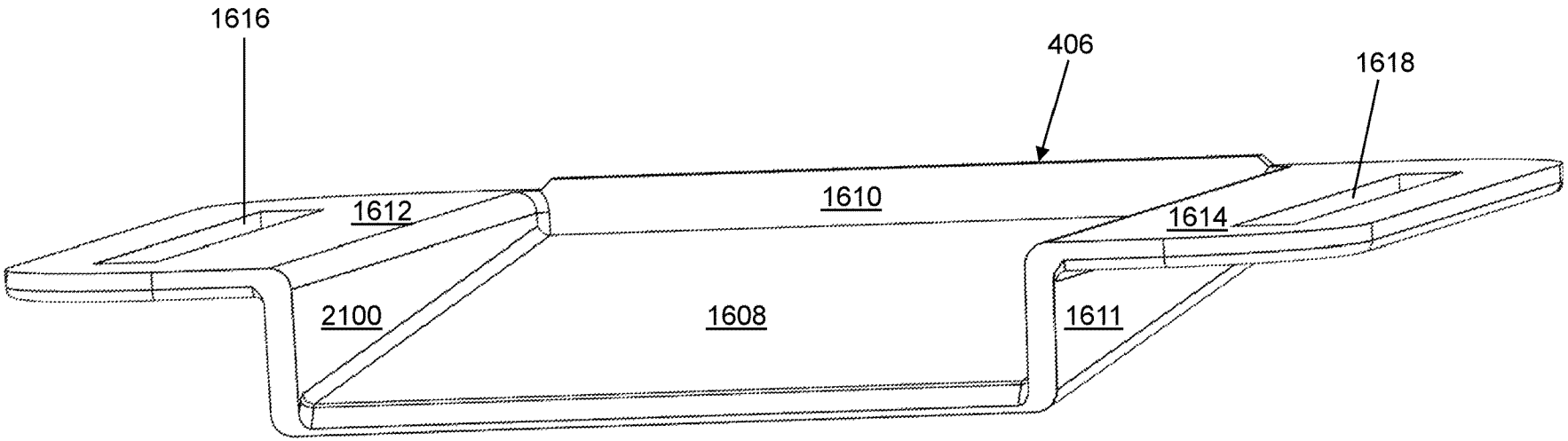
FIG. 21B depicts a back perspective view of the transition tray of the cleaning fluid drawer of FIG. 14A in accordance with an illustrative embodiment.

Referring to FIG. 21A, a right, front perspective view of transition tray 406 is shown in accordance with an illustrative embodiment. Referring to FIG. 21B, a back perspective view of transition tray 406 is shown in accordance with an illustrative embodiment. Transition tray 406 may not be included based on distance that the fluid is transported within ice bin 202.

Figure 22A:
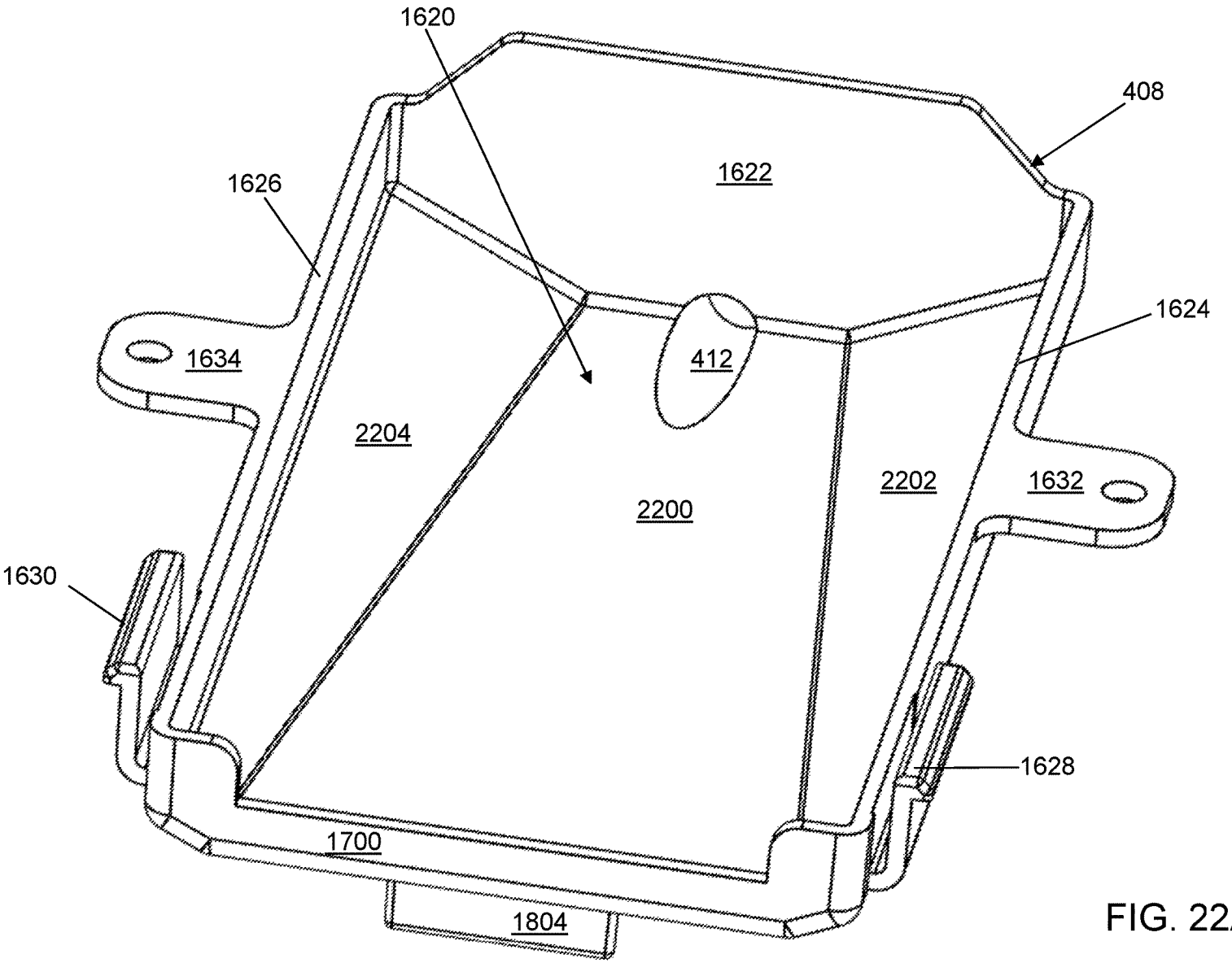
FIG. 22A depicts a top, front perspective view of a bottom tray of the cleaning fluid drawer of FIG. 14A in accordance with an illustrative embodiment.
Figure 22B:
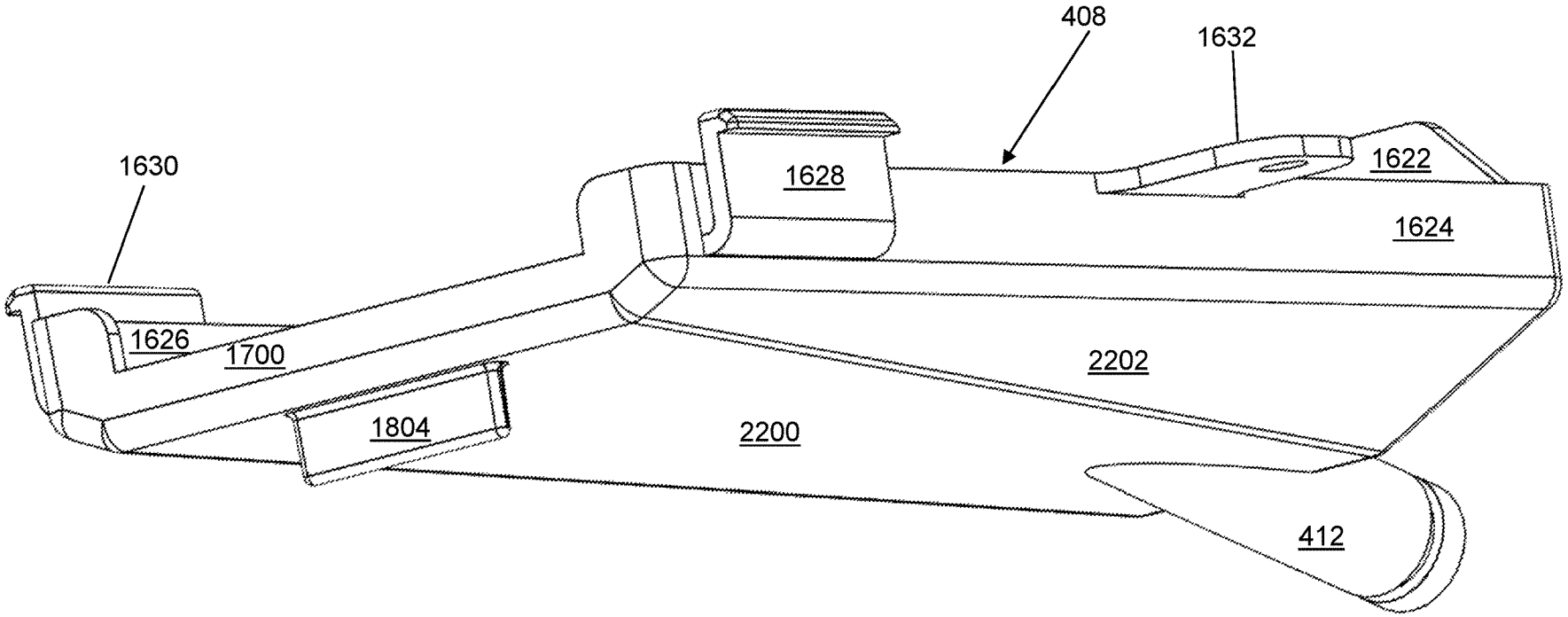
FIG. 22B depicts a right, front perspective view of the bottom tray of FIG. 22A in accordance with an illustrative embodiment.
Figure 22C:
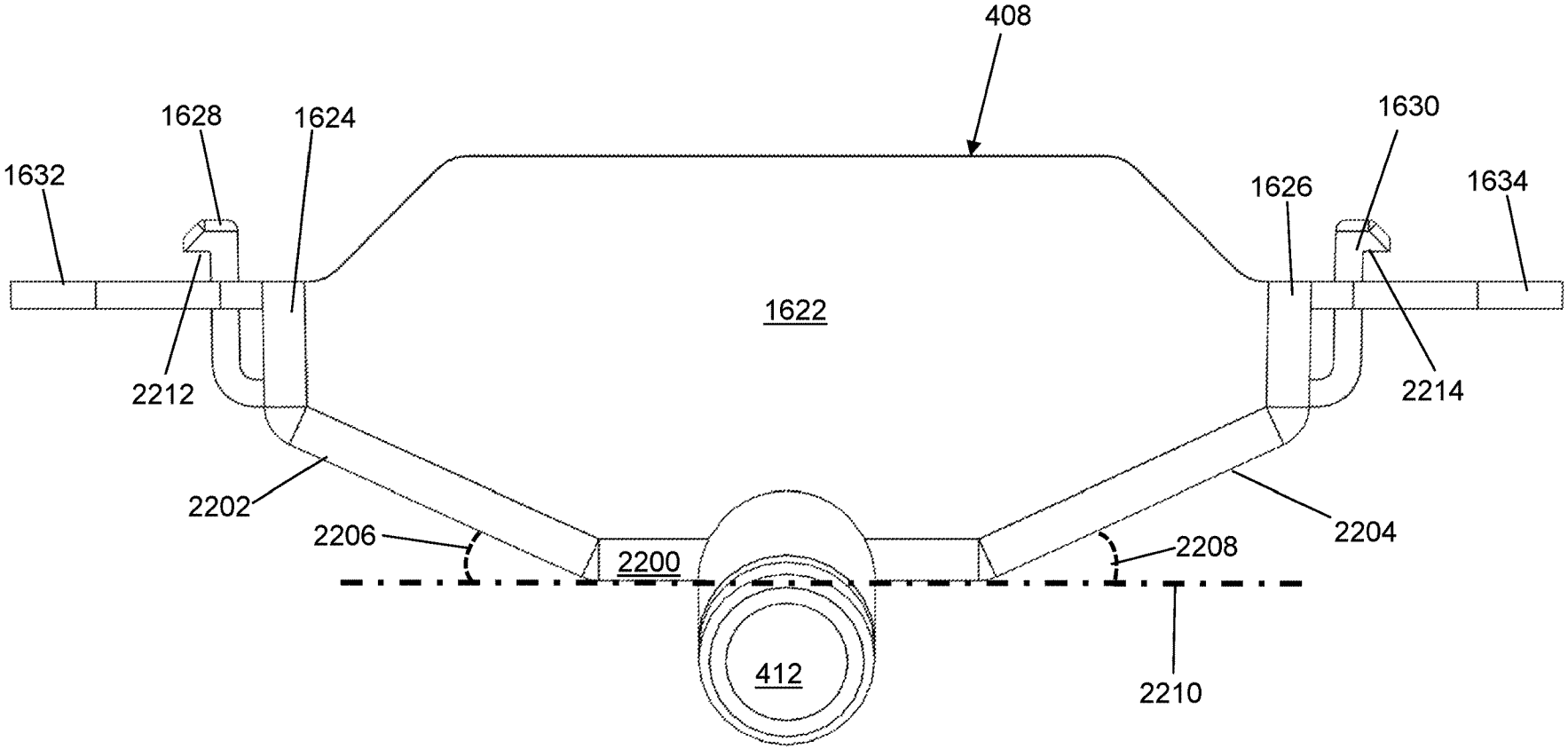
FIG. 22C depicts a back view of the bottom tray of FIG. 22A in accordance with an illustrative embodiment.

Referring to FIG. 22A, a top, front perspective view of bottom tray 408 is shown in accordance with an illustrative embodiment. Referring to FIG. 22B, a right, front perspective view of bottom tray 408 is shown in accordance with an illustrative embodiment. Referring to FIG. 22C, a back view of bottom tray 408 is shown in accordance with an illustrative embodiment. In the illustrative embodiment with drain tube 412 located approximately in the center of bottom tray back wall 1622 and in a back edge of bottom tray bottom wall 1620, bottom tray bottom wall 1620 includes a center bottom funnel floor 2200, a right bottom funnel floor 2202, and a left bottom funnel floor 2204. Center bottom funnel floor 2200 is sloped downward from bottom tray front wall 1700 toward drain tube 412 at third angle 1810. Right bottom funnel floor 2202 is sloped downward from bottom tray right sidewall 1624 toward center bottom funnel floor 2200 at a sixth angle 2206 relative to a sixth horizontal plane 2210. Left bottom funnel floor 2204 is sloped downward from bottom tray left sidewall 1626 toward center bottom funnel floor 2200 at a seventh angle 2208 relative to sixth horizontal plane 2210. Third angle 1810, sixth angle 2206, and seventh angle 2208 may have the same or different values. For illustration, sixth angle 2206 and seventh angle 2208 may be in the range of one to ten degrees to provide sufficient flow of the fluid toward drain tube 412. Similar to drawer bottom wall 1508, bottom tray bottom wall 1620 may include a greater or a fewer number of funnel floors.

Right mating tab 1628 includes a right shelf 2212 that extends outward to define a horizontal surface adjacent a top edge of right mating tab 1628. Left mating tab 1630 includes a left shelf 2214 that extends outward to define a horizontal surface. Right shelf 2212 slides along transition tray right top wall 1612 within right slide aperture wall 1616. Left shelf 2214 slides along transition tray left top wall 1614 within left slide aperture wall 1618. Right mating tab 1628 extends away from bottom tray right sidewall 1624. Left mating tab 1630 extends away from bottom tray left sidewall 1626.

Drain tube 412 forms a nozzle that is inserted into drain aperture wall 502 formed through cover 428 when cleaning fluid drawer 210 is mounted to ice maker 200. The fluid is provided into the sump cavity through drain tube 412 to clean and sanitize the ice making components when the ice maker controller enters a cleaning cycle.

A user pulls drawer 404 out from ice maker assembly 100 until the drawer receptacle is open a sufficient distance to avoid spillage. In the illustrative embodiment, drawer 404 can be withdrawn from a closed position shown in FIG. 18B to a fully open position shown in FIG. 13F. The fully open position may be restricted by a maximum extent of right slide 1300 and of left slide 1302. Transition tray 406 is included to provide a withdrawal distance that is greater than a depth of drawer 404. In alternative embodiments, transition tray 406 may not be included.

Once stop wall 1802 contacts transition tray front wall 1610 of transition tray 406, transition tray 406 slides with drawer 404 until right mating tab 1628 reaches a front edge of right slide aperture wall 1616 and left mating tab 1630 reaches a front edge of left slide aperture wall 1618. A length of right slide aperture wall 1616 and left slide aperture wall 1618 from front to back defines a withdrawal distance for transition tray 406.

Stop wall 1802 is positioned to ensure that top drawer drain 410 overhangs at least a portion of transition tray bottom wall 1608 of transition tray 406 so that the fluid flows down transition tray bottom wall 1608 and onto bottom tray bottom wall 1620 without spillage. When transition tray 406 is not included, stop wall 1802 contacts bottom tray front wall 1700 of bottom tray 408 that limits further withdrawal of drawer 404 from ice make assembly 100.

A user pours the fluid into the drawer receptacle of drawer 404 with or without splash guard tray 402. The fluid flows by gravity down the sloped walls of drawer bottom wall 1508 through top drawer drain 410 onto transition tray bottom wall 1608 of transition tray 406 and/or onto bottom tray bottom wall 1620 of bottom tray 408. The fluid flows through drain tube 412 into the sump cavity.

The dimensions of the various components of cleaning fluid drawer 210 are selected to provide the connection between drawer 404 and the sump cavity through drain tube 412.

Figure 23A:
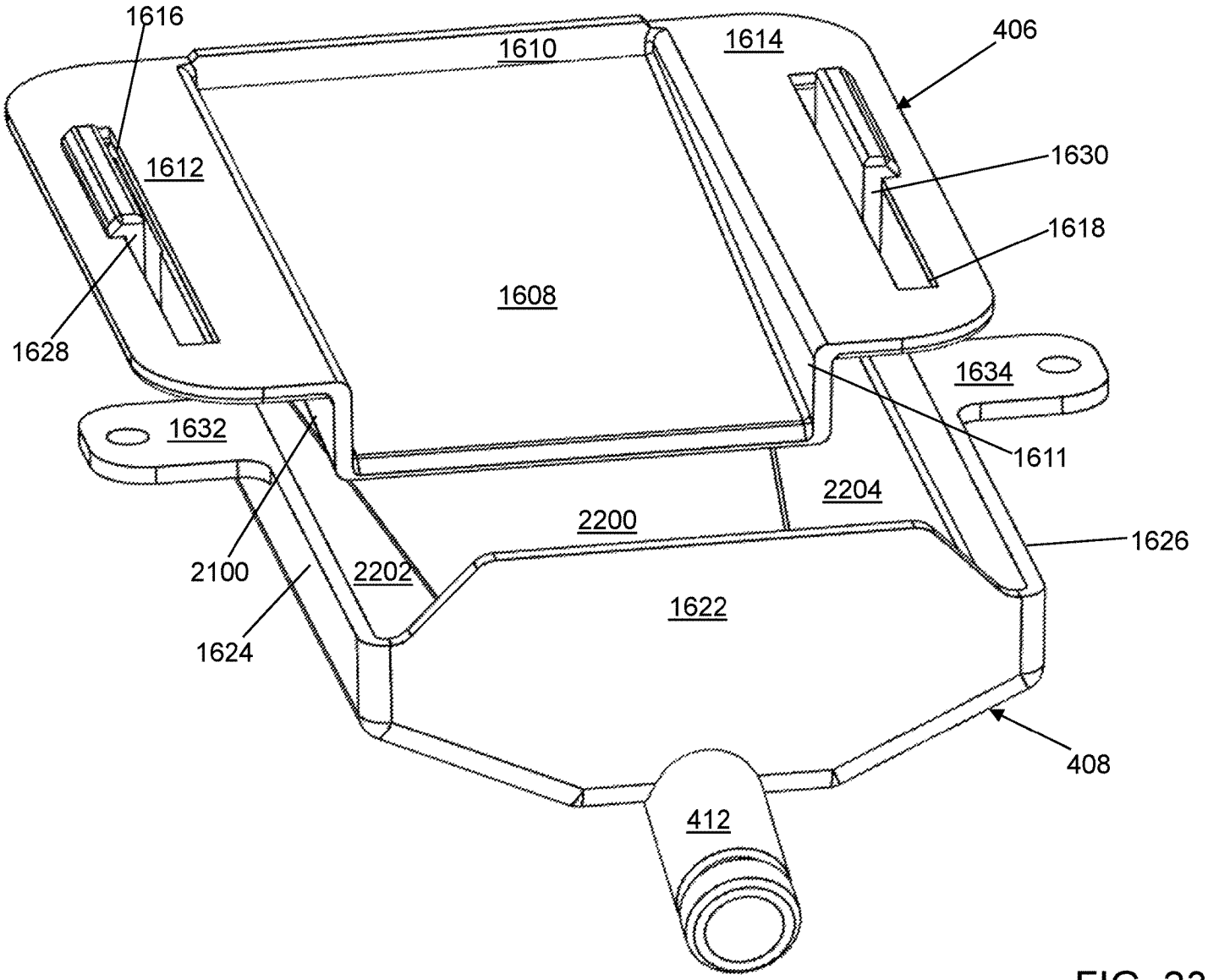
FIG. 23A depicts a top, back perspective view of the transition tray mounted to the bottom tray of the cleaning fluid drawer of FIG. 14A in accordance with an illustrative embodiment.
Figure 23B:
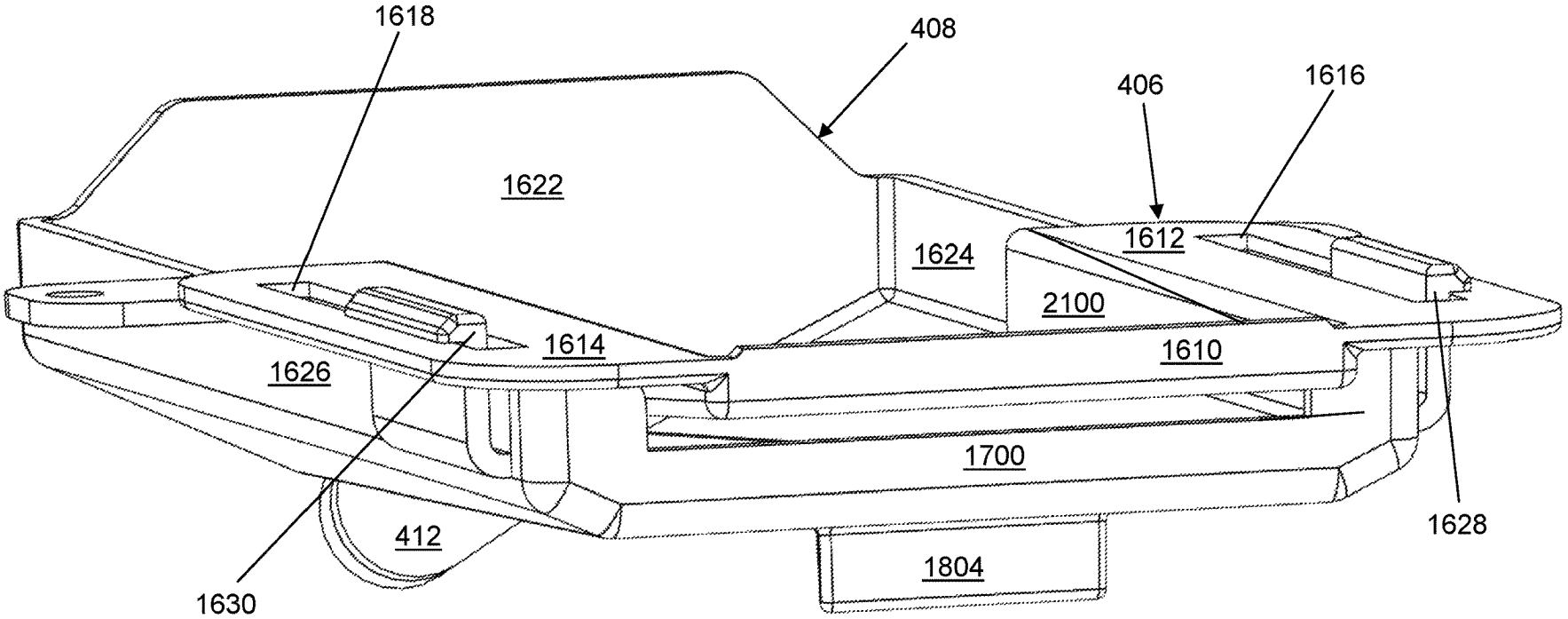
FIG. 23B depicts a left, front perspective view of the transition tray mounted to the bottom of the cleaning fluid drawer of FIG. 23A in accordance with an illustrative embodiment.
Figure 23C:
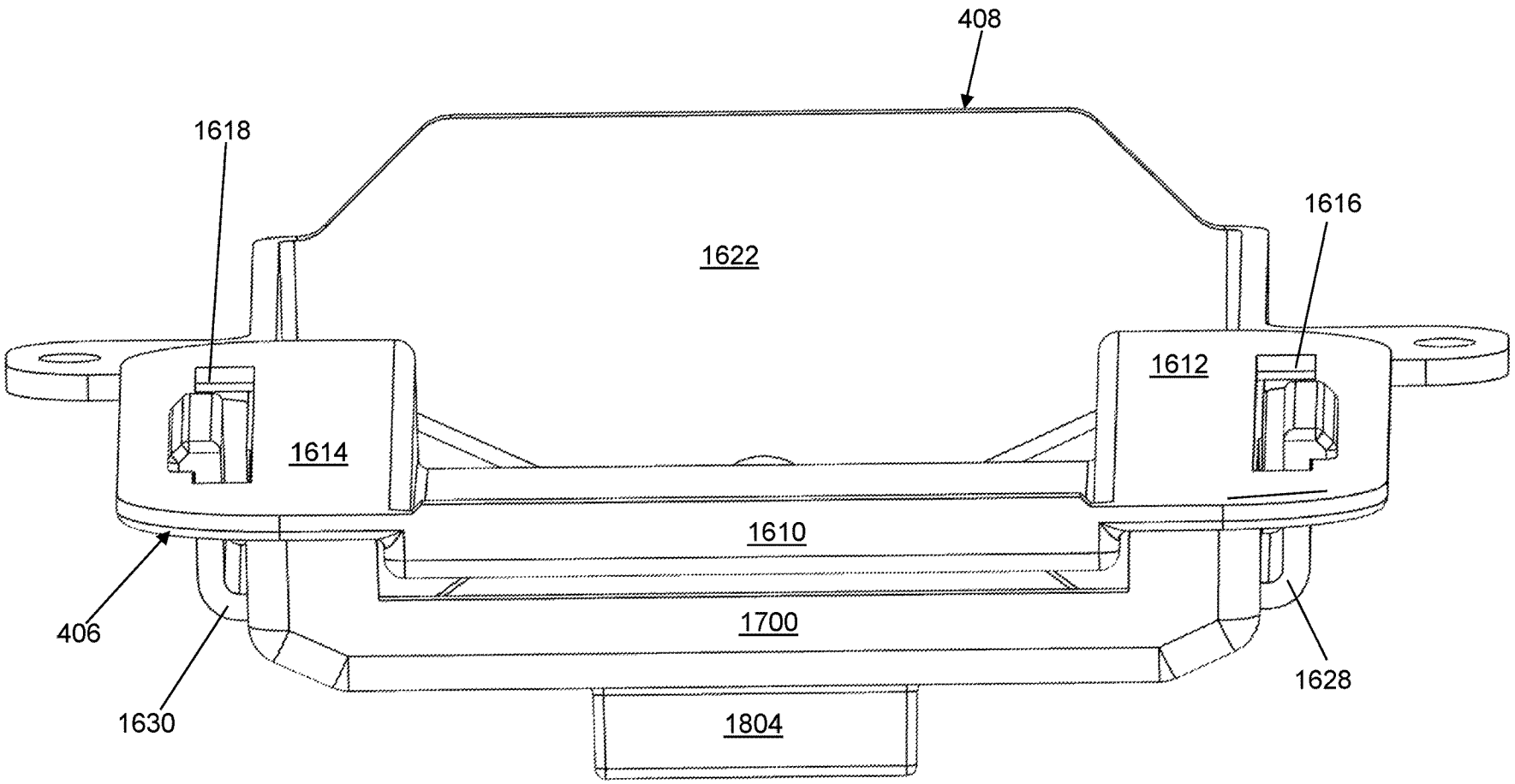
FIG. 23C depicts a top, front perspective view of the transition tray mounted to the bottom of the cleaning fluid drawer of FIG. 23A in accordance with an illustrative embodiment.

Referring to FIG. 23A, a top, back perspective view of transition tray 406 mounted to bottom tray 408 is shown in accordance with an illustrative embodiment. Referring to FIG. 23B, a left, front perspective view of transition tray 406 mounted to bottom tray 408 is shown in accordance with an illustrative embodiment. Referring to FIG. 23C, a top, front perspective view of transition tray 406 mounted to bottom tray 408 is shown in accordance with an illustrative embodiment.

Transition tray 406 is mounted to bottom tray 408 by inserting right mating tab 1628 into right slide aperture wall 1616 and left mating tab 1630 into left slide aperture wall 1618. In the illustrative embodiment, right mating tab 1628 and left mating tab 1630 are flexible and biased away from bottom tray right sidewall 1624 and bottom tray left sidewall 1626, respectively, so that right shelf 2212 abuts transition tray right top wall 1612 and left shelf 2214 abuts transition tray left top wall 1614. Transition tray right sidewall 2100 and transition tray left sidewall 1611 are sized to fit within bottom tray bottom wall 1620.

Cleaning fluid drawer can similarly be incorporated into other appliances such as a washing machine. Cleaning fluid drawer 210 may be mounted so that drawer 404 is accessible to the user and opens a sufficient distance to avoid spilling of the fluid. A greater or a fewer number of trays may be included with dimensions sufficient to provide the fluid to the appropriate location within the appliance. Drain tube 412 may be shorter or longer and may be straight or include bends as needed to reach the appropriate location within the appliance.

As used in this disclosure, the term "mount" is intended to define a structural connection between two or more structural components and includes join, unite, connect, couple, associate, insert, hang, hold, affix, attach, fasten, bind, paste, secure, bolt, screw, rivet, solder, weld, glue, adhere, form over, layer, and other similar terms. The phrases "mounted on" and "mounted to" include any interior or exterior portion of the components referenced. These phrases also encompass direct mounting (in which the referenced components are in direct contact) and indirect mounting (in which the referenced components are not in direct contact). Components referenced as mounted to each other may further be integrally formed together, for example, using a molding process as understood by a person of skill in the art. Though described as including multiple structural components mounted to each other, components described herein may be formed of a single continuous piece of material, for example, by molding, or may be formed of multiple distinct pieces mounted together, for example, attached to each other using various fasteners including adhesives, screws, rivets, welded joints, etc. The components of ice maker assembly 100 may be formed of one or more materials, such as metal, glass, and/or plastic having a sufficient strength and rigidity and aesthetic value to provide the illustrated and/or described function.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A drawer assembly comprising:

a drawer base mounted to a housing to which the drawer assembly is mounted;

a drawer configured to slide relative to the drawer base, the drawer comprising a front wall; and a receptacle, the receptacle comprising a bottom wall comprising a front edge and a back edge, wherein the front edge is mounted to the front wall, wherein the bottom wall forms a first funnel that slopes downward from the front edge to the back edge at a first angle of at least one degree; and a bottom tray mounted to the drawer base below the receptacle, wherein the bottom tray is mounted not to slide relative to the drawer base, the bottom tray comprising a tray wall comprising a second front edge and a second back edge, wherein the tray wall forms a second funnel that slopes downward from the second front edge of the tray wall to the second back edge of the tray wall at a second angle of at least one degree; and a drain aperture wall mounted to the tray wall at a lowest elevation of the second funnel.

2. The drawer assembly of claim 1, further comprising a splash guard tray comprising a plate and a grid of aperture walls formed through the plate, wherein the splash guard tray is mounted above the receptacle.

3. The drawer assembly of claim 1, wherein the drawer further comprises a second drain aperture wall defining a drain aperture, wherein the second drain aperture wall is positioned along the back edge of the bottom wall of the first funnel.

4. The drawer assembly of claim 3, wherein the second drain aperture wall is positioned in a center of the back edge of the bottom wall of the first funnel.

5. The drawer assembly of claim 3, wherein the second drain aperture wall is positioned in a corner of the back edge of the bottom wall of the first funnel.

6. The drawer assembly of claim 3, wherein the drawer further comprises a stop wall that extends downward away from a bottom surface of the bottom wall of the first funnel between the second drain aperture wall and the front edge of the receptacle.

7. The drawer assembly of claim 6, wherein the bottom tray further comprises a second front wall that extends upward from the second front edge of the tray wall of the second funnel, wherein the stop wall is configured to contact the second front wall when the drawer is slid out of the housing a predefined distance.

8. The drawer assembly of claim 1, wherein the first angle and the second angle are less than or equal to ten degrees.

9. The drawer assembly of claim 1, wherein at least a portion of the drain aperture wall forms an enclosed tube.

10. The drawer assembly of claim 1, wherein the drain aperture wall is positioned along the back edge of the tray wall of the second funnel.

11. The drawer assembly of claim 10, wherein the second drain aperture wall is positioned in a center of the back edge of the tray wall of the second funnel.

12. The drawer assembly of claim 10, wherein the second drain aperture wall is positioned in a corner of the back edge of the tray wall of the second funnel.

13. The drawer assembly of claim 1, further comprising a transition tray mounted below the drawer and above the bottom tray, wherein the transition tray comprises a transition tray floor comprising a third front edge and a third back edge, wherein the transition tray floor forms a third funnel that slopes downward from the third front edge of the transition tray floor to the third back edge of the transition tray floor at a third angle of at least one degree.

14. The drawer assembly of claim 13, wherein the drawer further comprises a stop wall that extends downward away from a bottom surface of the bottom wall of the first funnel between the front edge of the receptacle and the back edge of the receptacle.

15. The drawer assembly of claim 14, wherein the transition tray further comprises a second front wall that extends upward from the third front edge of the transition tray floor of the third funnel, wherein the stop wall is configured to contact the third front wall when the drawer is slid out of the housing a predefined distance.

16. The drawer assembly of claim 15, wherein the transition tray is mounted to slide with the drawer when the drawer is slid out of the housing further than the predefined distance.

17. The drawer assembly of claim 15, wherein the transition tray is mounted to the bottom tray to slide with the drawer when the drawer is slid out of the housing further than the predefined distance.

18. The drawer assembly of claim 13, wherein the first angle, the second angle, and the third angle are less than or equal to ten degrees.

19. An appliance comprising:

a housing;

a drawer assembly comprising a drawer base mounted to the housing;

a drawer configured to slide relative to the drawer base, the drawer comprising a front wall; and a receptacle, the receptacle comprising a bottom wall comprising a front edge and a back edge, wherein the front edge is mounted to the front wall, wherein the bottom wall forms a first funnel that slopes downward from the front edge to the back edge at a first angle of at least one degree; and a bottom tray mounted to the drawer base below the receptacle, wherein the bottom tray is mounted not to slide relative to the drawer base, the bottom tray comprising a tray wall comprising a second front edge and a second back edge, wherein the tray wall forms a second funnel that slopes downward from the second front edge of the tray wall to the second back edge of the tray wall at a second angle of at least one degree; and a drain aperture wall mounted to the tray wall at a lowest elevation of the second funnel.

20. The appliance of claim 19, wherein the appliance is an ice maker, wherein the drain aperture wall is further mounted to the ice maker.

* * * * *